US011409227B2

(12) United States Patent
Uesugi et al.

(10) Patent No.: US 11,409,227 B2
(45) Date of Patent: Aug. 9, 2022

(54) DRUM UNIT, CARTRIDGE, ELECTROPHOTOGRAPHIC IMAGE FORMING APPARATUS AND COUPLING MEMBER

(71) Applicant: CANON KABUSHIKI KAISHA, Tokyo (JP)

(72) Inventors: Tetsuo Uesugi, Suntou-gun (JP); Masato Tanabe, Susono (JP); Tomonori Mori, Numazu (JP); Daisuke Abe, Suntou-gun (JP); Tadayuki Tsuda, Susono (JP); Hideshi Kawaguchi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/336,472

(22) Filed: Jun. 2, 2021

(65) Prior Publication Data

US 2021/0286312 A1 Sep. 16, 2021

Related U.S. Application Data

(60) Division of application No. 16/858,822, filed on Apr. 27, 2020, now Pat. No. 11,067,942, which is a (Continued)

(51) Int. Cl.

| | |
|---|---|
| ***G03G 15/00*** | (2006.01) |
| ***G03G 21/16*** | (2006.01) |
| ***G03G 21/18*** | (2006.01) |

(52) U.S. Cl.

CPC ..... *G03G 21/1647* (2013.01); *G03G 15/751* (2013.01); *G03G 15/757* (2013.01); *G03G 21/1671* (2013.01); *G03G 21/186* (2013.01)

(58) Field of Classification Search

CPC ..... G03G 15/751; G03G 15/757; G03G 21/1647; G03G 21/1671; G03G 21/1676; (Continued)

(56) References Cited

U.S. PATENT DOCUMENTS

| | | | |
|---|---|---|---|
| 5,126,800 | A | 6/1992 | Shishido et al. |
| 5,151,734 | A | 9/1992 | Tsuda et al. |

(Continued)

FOREIGN PATENT DOCUMENTS

| | | | |
|---|---|---|---|
| CN | 101819400 | A | 9/2010 |
| CN | 101876808 | A | 11/2010 |

(Continued)

OTHER PUBLICATIONS

Feb. 27, 2020 Search Report in Russian Patent Application No. 2019135863 (with English translation).

(Continued)

*Primary Examiner* — Sophia S Chen
(74) *Attorney, Agent, or Firm* — Venable LLP

(57) ABSTRACT

A drum unit detachably mountable to a main assembly of an electrophotographic image forming apparatus includes a photosensitive drum and a coupling member provided on the photosensitive drum. The coupling member includes a driving force receiving portion and a supporting portion movably supporting the driving force receiving portion. The supporting portion includes a first extended portion and a second extended portion which extend at least in an axial direction of the photosensitive drum.

47 Claims, 65 Drawing Sheets

Related U.S. Application Data division of application No. 16/284,154, filed on Feb. 25, 2019, now Pat. No. 10,671,013, which is a continuation of application No. PCT/JP2016/075738, filed on Aug. 26, 2016.

(58) Field of Classification Search
CPC ..... G03G 21/1857; G03G 21/186; G03G 2221/1657; F16D 1/00
See application file for complete search history.

(56) References Cited

U.S. PATENT DOCUMENTS 5,206,682 A 4/1993 Yamada et al.
5,208,634 A 5/1993 Ikemoto et al.
5,223,893 A 6/1993 Ikemoto et al.
5,294,960 A 3/1994 Nomura et al.
5,331,372 A 7/1994 Tsuda et al.
5,345,294 A 9/1994 Nomura et al.
5,404,198 A 4/1995 Noda et al.
5,470,635 A 11/1995 Shirai et al.
5,475,470 A 12/1995 Sasago et al.
5,510,878 A 4/1996 Noda et al.
5,561,504 A 10/1996 Watanabe et al.
5,488,459 A 12/1996 Tsuda et al.
5,581,325 A 12/1996 Tsuda et al.
5,583,613 A 12/1996 Kobayashi et al.
5,602,623 A 2/1997 Nishibata et al.
5,608,509 A 3/1997 Shirai et al.
5,623,328 A 4/1997 Tsuda et al.
5,642,187 A 6/1997 Nomura et al.
5,650,841 A 7/1997 Matsuda et al.
5,659,847 A 8/1997 Tsuda et al.
5,669,042 A 9/1997 Kobayashi et al.
5,678,139 A 10/1997 Nomura et al.
5,682,579 A 10/1997 Nomura et al.
5,697,022 A 12/1997 Matsuda et al.
5,809,374 A 9/1998 Tsuda et al.
5,812,909 A 9/1998 Oguma et al.
5,825,472 A 10/1998 Araki et al.
5,828,928 A 10/1998 Sasago et al.
5,828,929 A 10/1998 Watanabe et al.
5,867,751 A 2/1999 Nomura et al.
5,878,304 A 3/1999 Watanabe et al.
5,907,749 A 5/1999 Nomura et al.
5,907,751 A 5/1999 Kawaguchi et al.
5,923,918 A 7/1999 Nakagawa et al.
5,926,672 A 7/1999 Nishibata et al.
5,953,562 A 9/1999 Kawaguchi et al.
5,987,278 A 11/1999 Nomura et al.
6,006,058 A 12/1999 Watanabe et al.
6,011,941 A 1/2000 Takashima et al.
6,041,196 A 3/2000 Nakagawa et al.
6,047,153 A 4/2000 Kawaguchi
6,058,278 A 5/2000 Tsuda et al.
6,064,843 A 5/2000 Isobe et al.
6,075,956 A 6/2000 Watanabe et al.
6,097,906 A 8/2000 Matsuzaki et al.
6,097,911 A 8/2000 Watanabe et al.
6,118,961 A 9/2000 Nomura et al.
6,131,011 A 10/2000 Kojima et al.
6,144,398 A 11/2000 Yokoyama et al.
6,154,623 A 11/2000 Suzuki et al.
6,157,792 A 12/2000 Mori et al.
6,173,145 B1 1/2001 Chadani et al.
6,178,301 B1 1/2001 Kojima et al.
6,236,822 B1 5/2001 Kawaguchi
6,266,503 B1 7/2001 Murayama et al.
6,272,299 B1 8/2001 Numagami et al.
6,272,300 B1 8/2001 Fujiwara et al.
6,298,217 B1 10/2001 Murayama et al.
6,311,026 B1 10/2001 Higeta et al.
6,314,266 B1 11/2001 Murayama et al.
6,324,363 B1 11/2001 Watanabe et al.
6,334,035 B1 12/2001 Abe et al.
6,377,759 B1 4/2002 Abe et al.
6,404,996 B1 6/2002 Mori et al.
6,415,121 B1 7/2002 Suzuki et al.
6,424,811 B1 7/2002 Tsuda et al.
6,463,225 B1 10/2002 Abe et al.
6,473,585 B2 10/2002 Abe et al.
6,505,008 B2 1/2003 Abe
6,519,431 B1 2/2003 Toba et al.
6,535,699 B1 3/2003 Abe et al.
6,542,706 B2 4/2003 Toba et al.
6,603,939 B1 8/2003 Toba et al.
6,654,578 B2 11/2003 Suzuki et al.
6,823,155 B2 11/2004 Tsuda et al.
6,826,380 B2 11/2004 Karakama et al.
6,879,789 B2 4/2005 Yamada et al.
6,915,092 B2 7/2005 Yamaguchi et al.
6,920,298 B2 7/2005 Yamada
6,934,485 B2 8/2005 Miyabe et al.
6,980,759 B2 12/2005 Kanno et al.
6,993,264 B2 1/2006 Oguma et al.
7,062,192 B2 6/2006 Oguma et al.
7,082,276 B2 7/2006 Karakama et al.
7,085,509 B2 8/2006 Kubota et al.
7,162,176 B2 1/2007 Oguma et al.
7,174,113 B2 2/2007 Kubota et al.
7,200,347 B2 4/2007 Yokoi et al.
7,203,442 B2 4/2007 Matsubara et al.
7,209,676 B2 4/2007 Yokoi et al.
7,228,086 B2 6/2007 Kawaguchi et al.
7,231,164 B2 6/2007 Harada et al.
7,239,823 B2 7/2007 Oguma et al.
7,242,885 B2 7/2007 Abe et al.
7,315,706 B2 1/2008 Oguma et al.
7,386,241 B2 6/2008 Mori et al.
7,457,566 B2 11/2008 Koishi et al.
7,457,570 B2 11/2008 Kasai et al.
7,660,550 B2 2/2010 Mori et al.
7,715,746 B2 5/2010 Tanabe et al.
7,813,671 B2 10/2010 Nittani et al.
7,890,025 B2 2/2011 Chadani et al.
7,894,733 B2 2/2011 Tanabe et al.
7,899,364 B2 3/2011 Chadani et al.
7,953,340 B2 5/2011 Tanabe et al.
7,983,589 B2 7/2011 Sato et al.
8,116,661 B2 2/2012 Chadani et al.
8,135,304 B2 3/2012 Abe et al.
8,139,972 B2 3/2012 Abe et al.
8,301,054 B2 10/2012 Tanabe et al.
8,306,460 B2 11/2012 Chadani et al.
8,335,454 B2 12/2012 Chadani et al.
8,346,135 B2 1/2013 Kikuchi et al.
8,442,416 B2 5/2013 Chadani et al.
8,447,209 B2 5/2013 Chadani et al.
8,472,840 B2 6/2013 Abe et al.
8,583,007 B2 11/2013 Chadani et al.
8,588,647 B2 11/2013 Chadani et al.
8,639,160 B2 1/2014 Chadani et al.
9,063,464 B2 6/2015 Furutani et al.
9,134,679 B2 9/2015 Mori
9,134,688 B2 9/2015 Chadani et al.
9,146,500 B2 9/2015 Uesugi et al.
9,207,581 B2 12/2015 Wada et al.
9,302,801 B2 4/2016 Matsumura et al.
9,304,440 B2 4/2016 Yoshida et al.
9,310,717 B2 4/2016 Matsunaga et al.
9,354,553 B2 5/2016 Yoshida et al.
9,529,304 B2 12/2016 Uesugi et al.
9,581,958 B2 2/2017 Chadani et al.
9,632,479 B2 4/2017 Maeshima et al.
9,665,040 B2 5/2017 Matsuzaki et al.
9,880,517 B2 1/2018 Maeshima et al.
9,885,978 B2 2/2018 Matsuzaki et al.
9,983,542 B2 5/2018 Chadani et al.
10,025,266 B2 7/2018 Maeshima et al.
10,067,461 B2 9/2018 Anan et al.
10,095,180 B2 10/2018 Harada et al.
10,175,609 B2 1/2019 Matsuzaki et al.
2001/0043814 A1 11/2001 Abe
2002/0018666 A1 2/2002 Noda et al.
2002/0127029 A1 9/2002 Yamada et al.

(56) References Cited

U.S. PATENT DOCUMENTS

| | | | | |
|---|---|---|---|---|
| 2003/0185594 | A1* | 10/2003 | Okabe | G03G 15/0896 399/222 |
| 2006/0216061 | A1 | 9/2006 | Yamaguchi | |
| 2007/0280743 | A1 | 12/2007 | Nakajima et al. | |
| 2008/0138115 | A1 | 6/2008 | Chadani et al. | |
| 2008/0152388 | A1 | 6/2008 | Ueno et al. | |
| 2008/0170880 | A1 | 7/2008 | Hashimoto | |
| 2008/0240796 | A1 | 10/2008 | Morioka et al. | |
| 2008/0260428 | A1 | 10/2008 | Ueno et al. | |
| 2009/0060578 | A1 | 3/2009 | Oohara et al. | |
| 2010/0034561 | A1 | 2/2010 | Batori et al. | |
| 2010/0189432 | A1 | 7/2010 | Kawashima et al. | |
| 2010/0221036 | A1 | 9/2010 | Hara et al. | |
| 2010/0272470 | A1 | 10/2010 | Tomatsu et al. | |
| 2010/0278559 | A1 | 11/2010 | Komatsu et al. | |
| 2011/0020031 | A1 | 1/2011 | Sato et al. | |
| 2013/0223853 | A1 | 8/2013 | Chadani et al. | |
| 2013/0336674 | A1 | 12/2013 | Abe et al. | |
| 2014/0169829 | A1 | 6/2014 | Maeshima et al. | |
| 2014/0270845 | A1 | 9/2014 | Kawakami et al. | |
| 2014/0294476 | A1 | 10/2014 | Hashimoto et al. | |
| 2015/0050048 | A1 | 2/2015 | Huang | |
| 2015/0277367 | A1 | 10/2015 | Maeshima et al. | |
| 2016/0246250 | A1 | 8/2016 | Kamoshida et al. | |
| 2016/0370757 | A1 | 12/2016 | Sato et al. | |
| 2017/0248869 | A1 | 8/2017 | Matsumoto et al. | |
| 2017/0293255 | A1 | 10/2017 | Uratani et al. | |
| 2017/0351214 | A1 | 12/2017 | Uesugi et al. | |
| 2017/0371297 | A1 | 12/2017 | Ikeda et al. | |
| 2018/0188683 | A1 | 7/2018 | Maeshima et al. | |
| 2018/0246465 | A1 | 8/2018 | Chadani et al. | |
| 2018/0329359 | A1 | 11/2018 | Anan et al. | |
| 2019/0094759 | A1 | 3/2019 | Matsuzaki et al. | |
| 2019/0179249 | A1 | 6/2019 | Mori et al. | |

FOREIGN PATENT DOCUMENTS

| | | | |
|---|---|---|---|
| CN | 102037417 | A | 4/2011 |
| CN | 102890441 | A | 1/2013 |
| CN | 103149824 | A | 6/2013 |
| CN | 104076649 | A | 10/2014 |
| CN | 104919374 | A | 9/2015 |
| CN | 105573082 | A | 5/2016 |
| CO | 2017/0009086 | A | 1/2018 |
| DE | 11 2016 000 940 | T5 | 11/2007 |
| EP | 0 833 228 | A | 5/2003 |
| JP | H05-19550 | A | 1/1993 |
| JP | H08-87225 | A | 4/1996 |
| JP | H11-143338 | A | 5/1999 |
| JP | 2000-132014 | A | 5/2000 |
| JP | 3046506 | B | 5/2000 |
| JP | 2002-318490 | A | 10/2002 |
| JP | 3884973 | B | 2/2007 |
| JP | 2008-233867 | A | 10/2008 |
| JP | 4222401 | B | 2/2009 |
| JP | 2010-026473 | A | 2/2010 |
| JP | 2016-148783 | A | 8/2016 |
| KR | 10-1993-0004829 | A | 3/1993 |
| KR | 10-1995-0029867 | A | 11/1995 |
| KR | 10-1996-0042266 | A | 12/1996 |
| KR | 10-1998-0025029 | A | 7/1998 |
| KR | 10-2001-0066798 | A | 7/2001 |
| KR | 10-2005-0119978 | A | 12/2005 |
| KR | 10-2010-0134130 | A | 12/2010 |
| KR | 2010-0134136 | A | 12/2010 |
| KR | 10-2011-0076996 | A | 7/2011 |
| KR | 10-2012-0008090 | A | 1/2012 |
| KR | 2012-0121415 | A | 11/2012 |
| KR | 10-2017-0125887 | A | 11/2017 |
| RU | 2 376 620 | C2 | 12/2009 |
| RU | 2 5181 35 | C2 | 6/2014 |
| RU | 2 568 045 | C1 | 11/2015 |
| TW | 201546579 | A | 12/2015 |
| TW | 201621484 | A | 6/2016 |
| WO | 2016/137014 | A1 | 9/2016 |

OTHER PUBLICATIONS

Mar. 28, 2019 Office Action in Taiwanese Patent Application No. 107120554.

International Search Report and Written Opinion for International Patent Application No. PCT/JP2016/075738, dated Dec. 6, 2016.

Office Action in Taiwanese Patent Application No. 105127507, dated Oct. 6, 2017.

English translation of Japanese Patent Application Pub. No. H08-87225.

English translation of Japanese Patent Application Pub. No. H05-19550.

English translation of Japanese Patent Application Pub. No. 2002-318490.

Examination Report in Canadian Patent Application No. 3,034,781, dated Dec. 23, 2019.

Search Report in Russian Patent Application No. 2019135863, dated Feb. 27, 2020.

Mar. 12, 2020 Decision to Grant in Russian Patent Application No. 2019135863 (with English translation).

Apr. 9, 2020 Extended Search Report in European Patent Application No. 16 914 249.4.

Decision to Grant in Russian Patent Application No. 2019108453, dated Sep. 5, 2019 (with English translation).

Jun. 23, 2020 Notice of Acceptance in Australian Patent Application No. 2016420865.

Aug. 11, 2020 Office Action in Brazilian Patent Application No. BR112019003028-0 (with English translation).

Jul. 28, 2020 Office Action in Colombian Patent Application No. NC2019/0002116 (with English translation).

Oct. 19, 2020 Notice of Allowance in Korean Patent Application No. 10-2019-7008469.

Dec. 10, 2020 Decision to Grant in Russian Patent Application No. 20201115804 (with English translation).

Dec. 30, 2020 Office Action in Taiwanese Patent Application Pub. No. 10910399.

Jan. 12, 2021 Office Action in Chinese Patent Application No. 201680088723.9 (with English translation).

Feb. 4, 2021 Notice of Allowance in Korean Patent Application No. 10-2021-7001216.

Feb. 16, 2021 Examination Report in Indian Patent Application No. 201947009316.

Apr. 26, 2021 Office Action in United Kingdom Patent Application No. GB1902362.1.

Mar. 15, 2021 Office Action in Chilean Patent Application No. 201900465.

Aug. 25, 2021 Office Action in Chinese Patent Application No. 201680088723.9.

Jan. 3, 2022 Notice of Allowance in Korean Patent Application No. 10-2021-7013345.

Jan. 27, 2022 Office Action in German Patent Application No. 11 2016 007 180.9 (with English translation).

Feb. 3, 2022 Decision to Grant in Russian Patent Application No. 2021103031 (with English translation).

Jul. 21, 2021 Notice of Acceptance in Australian Patent Application No. 2020203959.

Mar. 9, 2022 Office Action in Indian Patent Application No. 202148036745.

Apr. 23, 2022 Office Action in Malaysian Patent Application No. PI2019000938.

Jun. 2, 2022 Office Action in Taiwan Patent Application No. 11120551640.

Jun. 6, 2022 Office Action in Chilean Patent Application No. 202003430.

* cited by examiner (a)

(b)

(A)

(B)

DRUM UNIT, CARTRIDGE, ELECTROPHOTOGRAPHIC IMAGE FORMING APPARATUS AND COUPLING MEMBER

TECHNICAL FIELD

The present invention relates to an electrophotographic image forming apparatus using an electrophotographic type process, a drum unit, a cartridge, a coupling member, and the like used for the electrophotographic image forming apparatus.

BACKGROUND ART

In an electrophotographic image forming apparatus, there has been is known a structure in which elements such as a photosensitive member drum and a developing roller as a rotatable member related to image formation are integrated into a cartridge and can be mounted to and dismounted from an image forming apparatus main assembly (hereinafter, the apparatus main assembly). With such a structure, in order to rotate the photosensitive drum in the cartridge, a structure that receives driving force from the apparatus main assembly is employed in many apparatuses. And, there is known a structure in which a driving force is transmitted by engaging a coupling member with a driving force transmitting portion such as a driving pin on the apparatus main assembly side on the cartridge side.

For example, Japanese Unexamined Patent Application Publication No. 2008-233867 discloses a cartridge including a coupling member provided at an end portion of the photosensitive drum so as to be tiltable with respect to the rotation axis of the photosensitive drum.

SUMMARY OF THE INVENTION

Problems to be Solved by the Invention

It is an object of the present invention to develop the above-mentioned conventional technique.

Means for Solving the Problem

The representative example structure is a drum unit detachably mountable to a main assembly of an electrophotographic image forming apparatus, the main assembly including a driving shaft provided with a recess, said drum unit comprising (1) a photosensitive drum; and (2) a coupling member provided on said photosensitive drum, said coupling member including, (2-1) a driving force receiving portion configured to enter the recess to receive a driving force for rotating said photosensitive drum, and (2-2) a supporting portion movably supporting said driving force receiving portion, wherein said supporting portion includes a first extended portion and a second extended portion which extend at least in an axial direction of said photosensitive drum, and said first extended portion and said second extended portion extend in directions different from each other in the axial direction.

Effect of the Invention

The above-mentioned conventional technique can be further developed.

Figure 21:
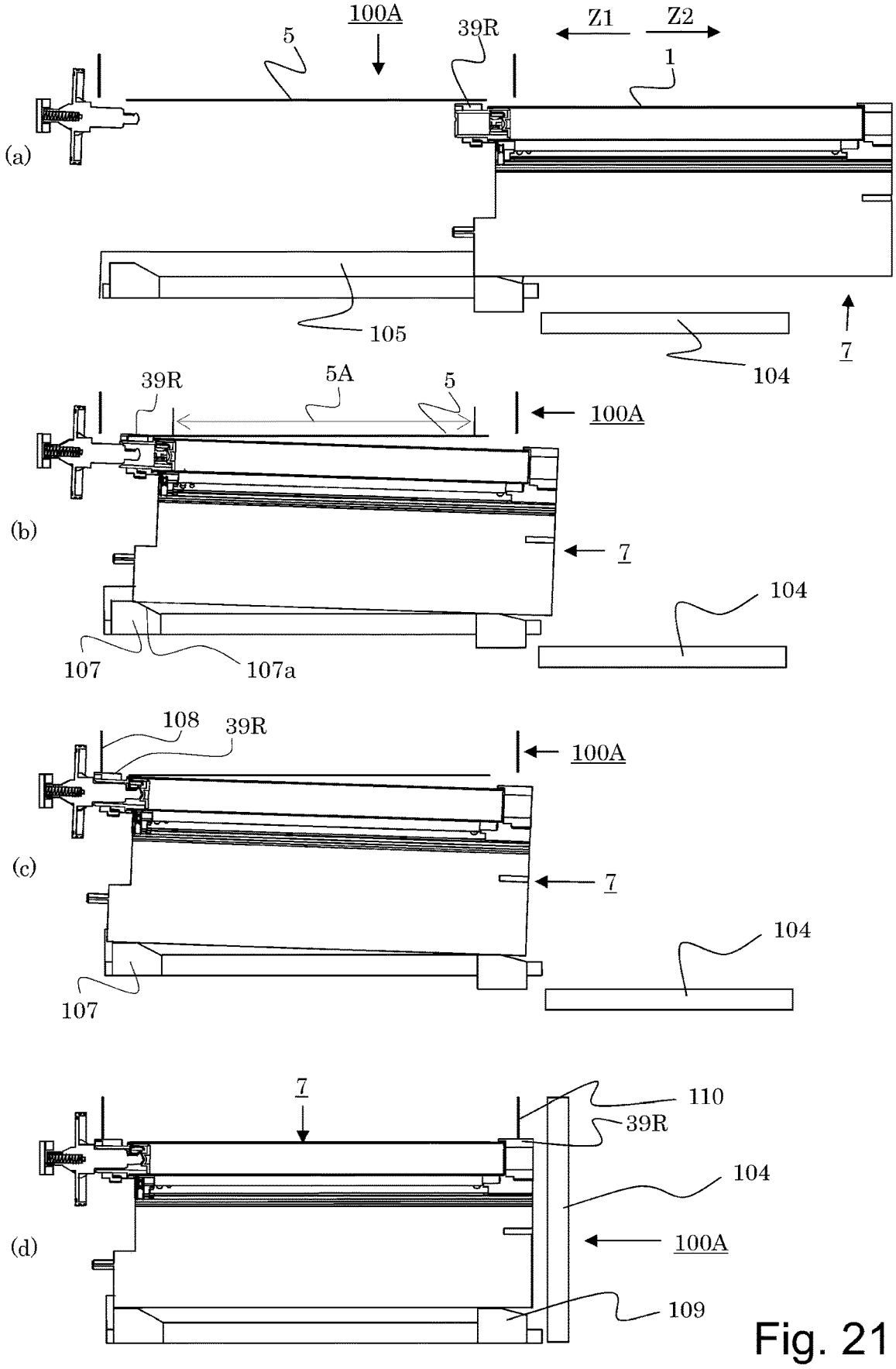

Parts (a), (b), (c) and (d) of FIG. 21 are cross-sectional views illustrating the mounting operation of the drum cartridge 13 to the image forming apparatus main assembly 100A.

Figure 22:
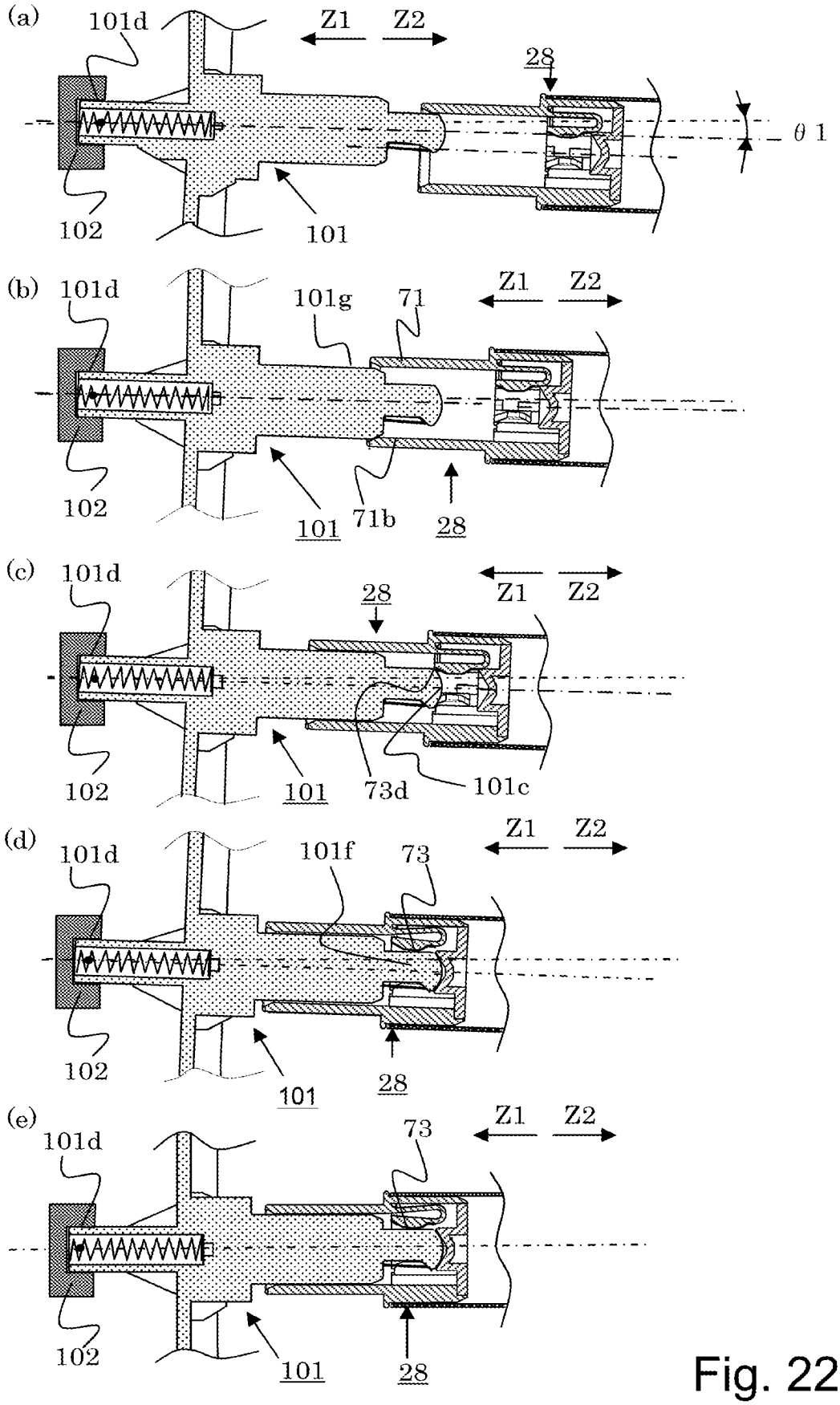

Parts (a), (b), (c), (d) and (e) of FIG. 22 are cross-sectional views illustrating the mounting operation of the coupling member 28 to the main assembly driving shaft 101.

Figure 23:
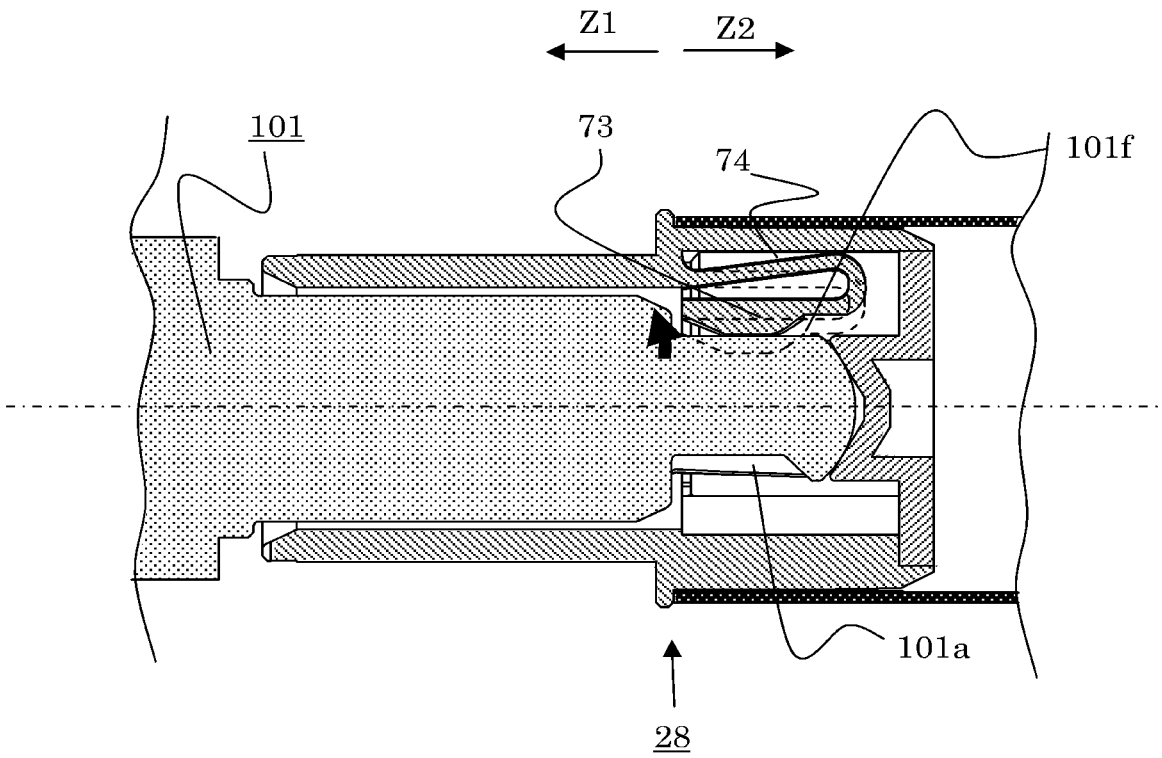
Figure 23:
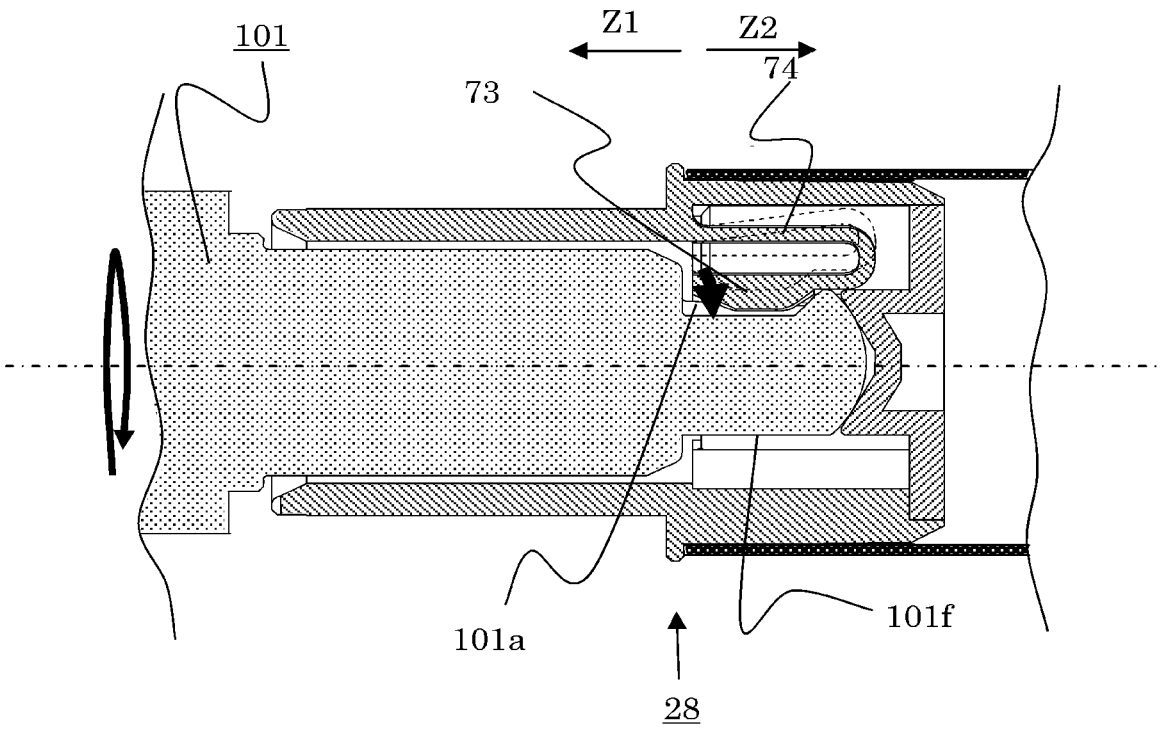

Parts (a) and (b) of FIG. 23 are sectional views illustrating the operation of mounting the coupling member 28 to the main assembly driving shaft 101 when the main assembly driving shaft 101 rotates from the state where a main assembly drive transmission groove 101*a* and an engagement portion 73 (drive receiving surface 73*a*) are out of phase to the state where they are aligned in phase.

Figure 24:
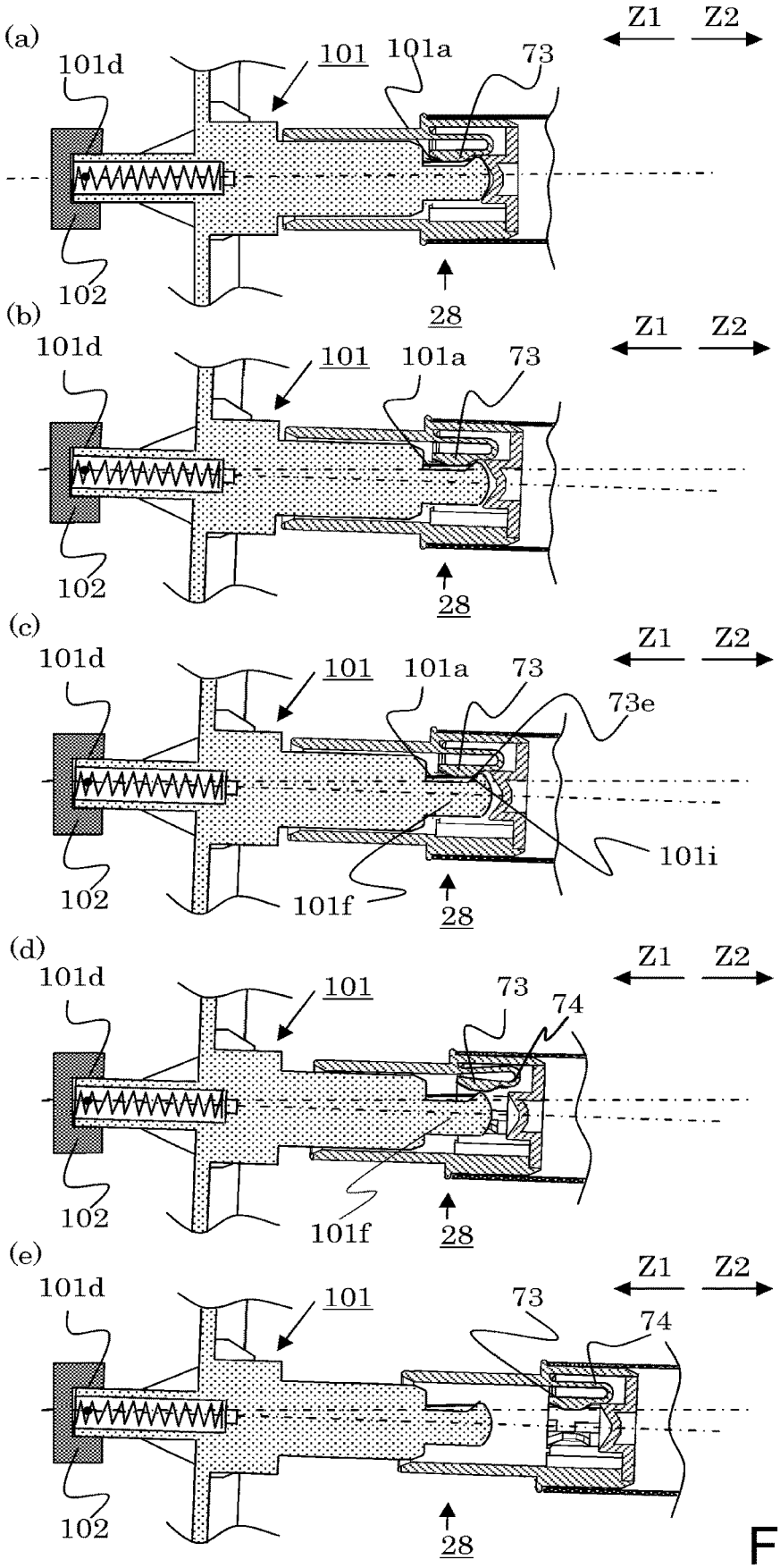

Parts (a), (b), (c), (d) and (e) of FIG. 24 are sectional views illustrating a removal operation of the coupling member 28 from the main assembly driving shaft 101.

Figure 25:
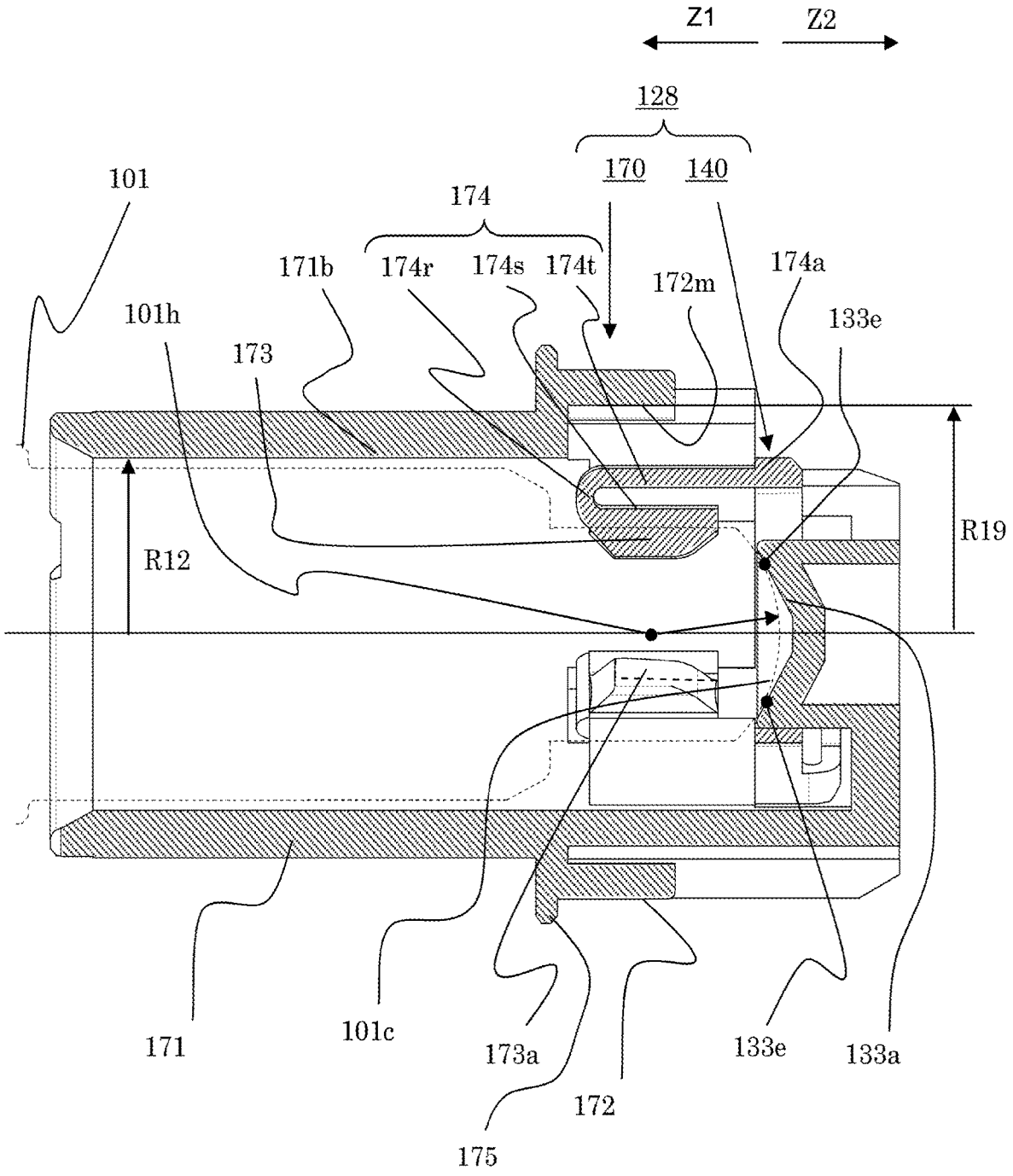

FIG. 25 is a cross-sectional view of a coupling member 128 according to Embodiment 2 taken along the rotation axis (center of rotation axis).

Figure 26:
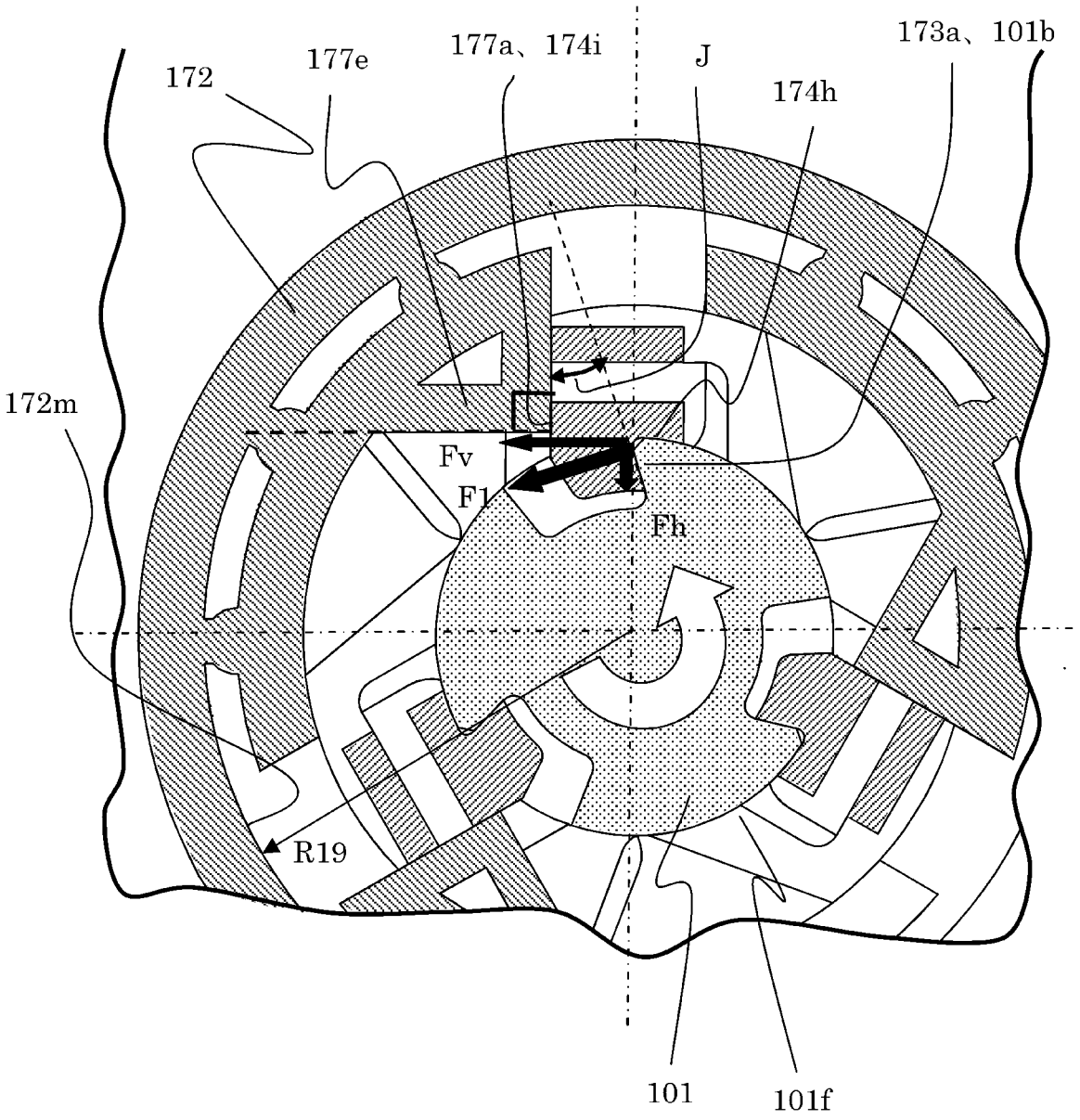

FIG. 26 is a cross-sectional view of the coupling member 128 and the main assembly driving shaft 101 according to Embodiment 2 taken along a plane perpendicular to the rotation axis at a position passing through the drive receiving surface 173*a*.

Figure 27:
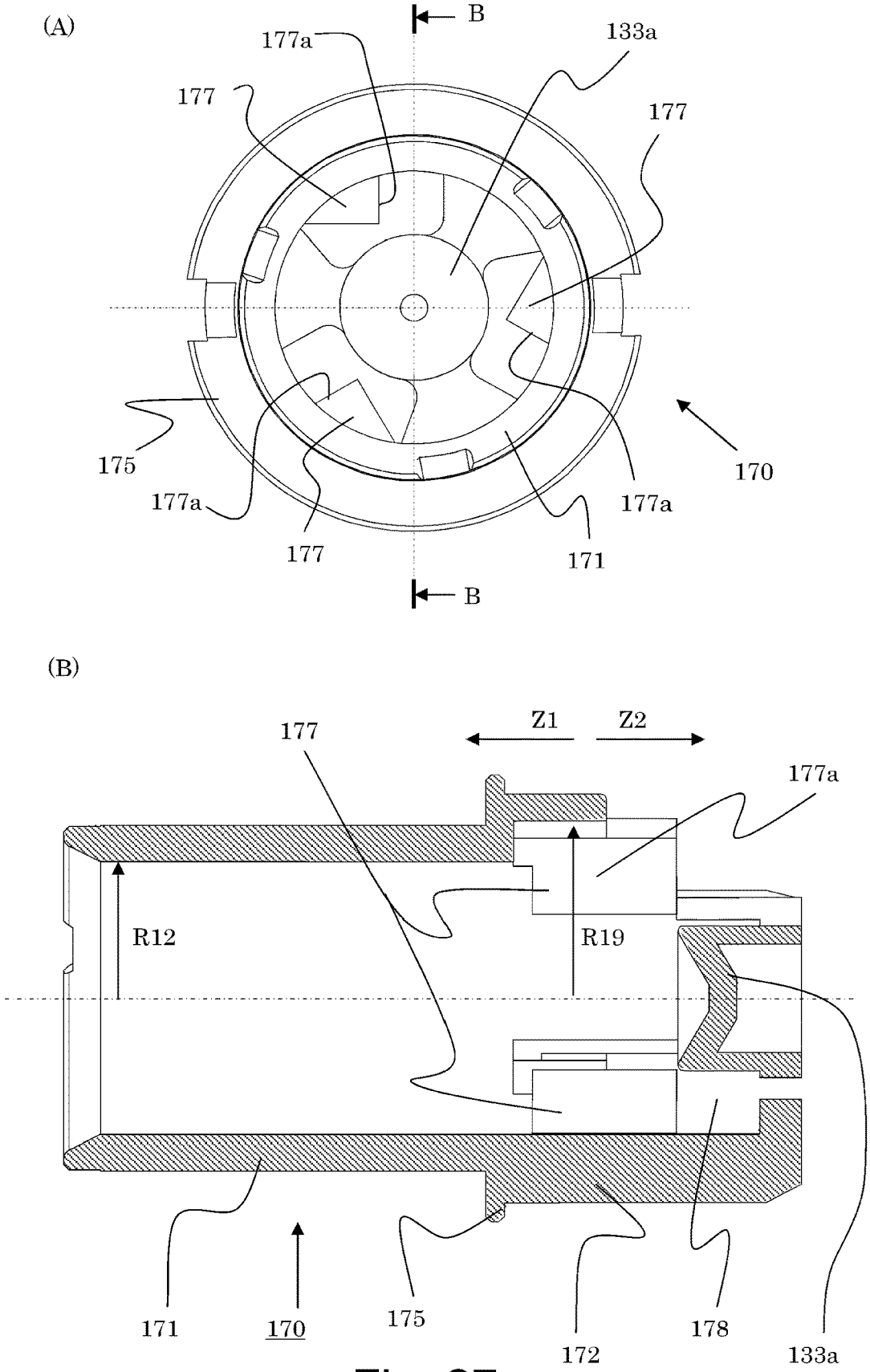

Part (A) and Part (B) of FIG. 27 are a view and a sectional view of a flange member 170 according to Embodiment 2, as viewed from an outside in the Z direction.

Figure 28:
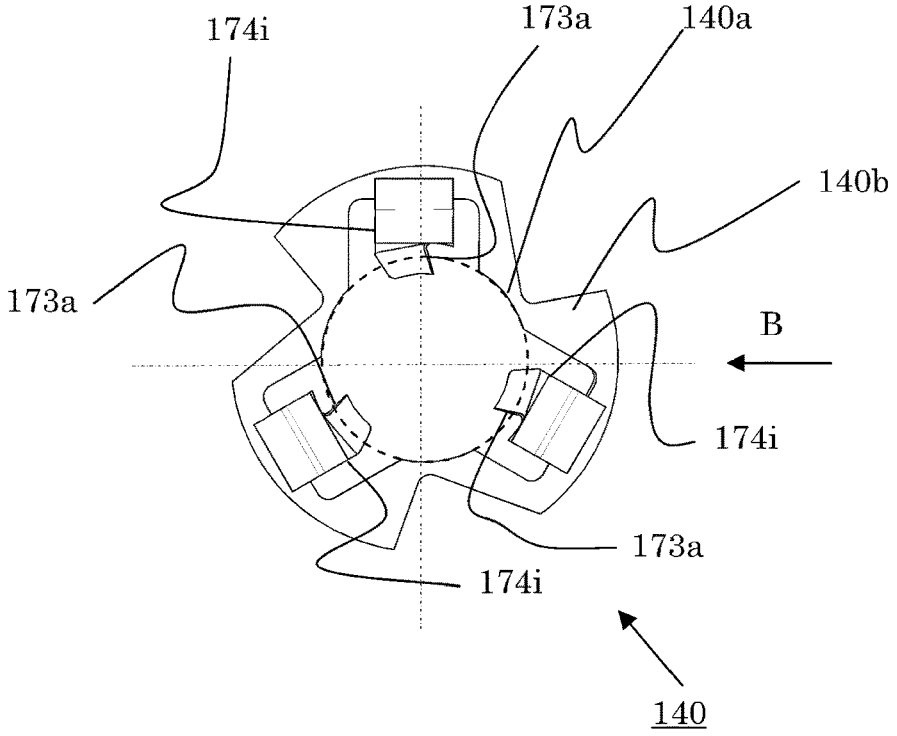
Figure 28:
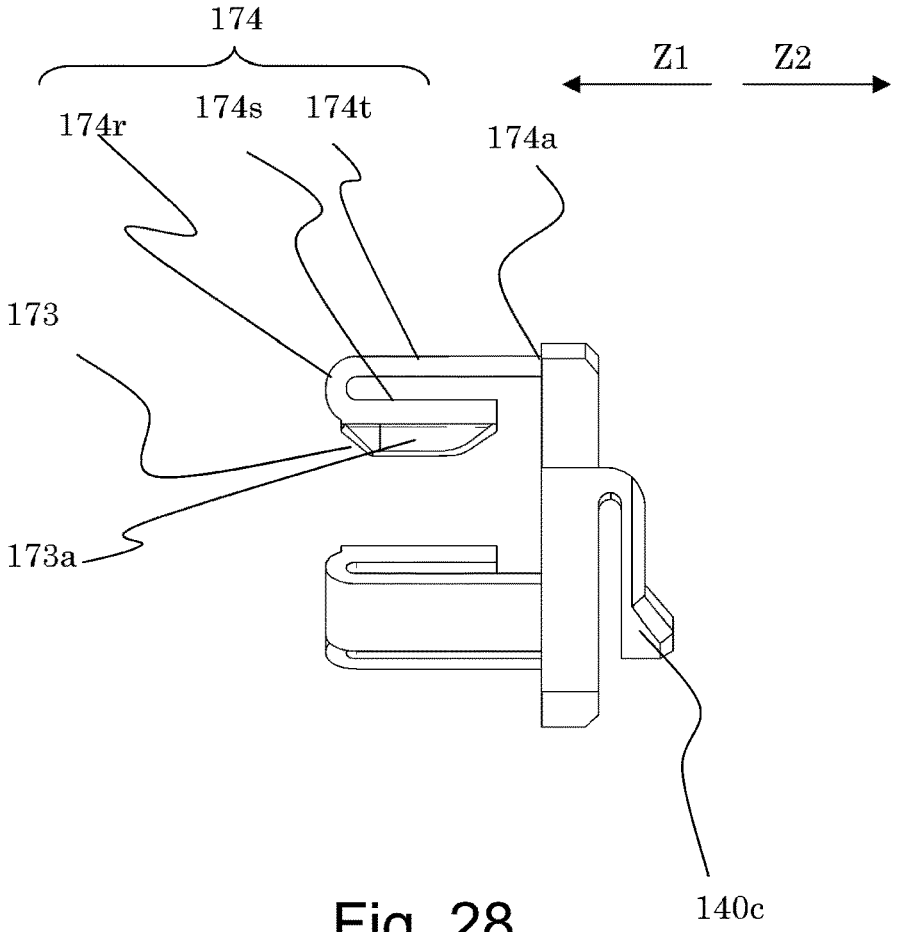

Part (A) and Part (B) of FIG. 28 are a view and a side view of the inner cylindrical member 140 according to Embodiment 2 as viewed in a direction from the Z1 side to the Z2 side.

Figure 29:
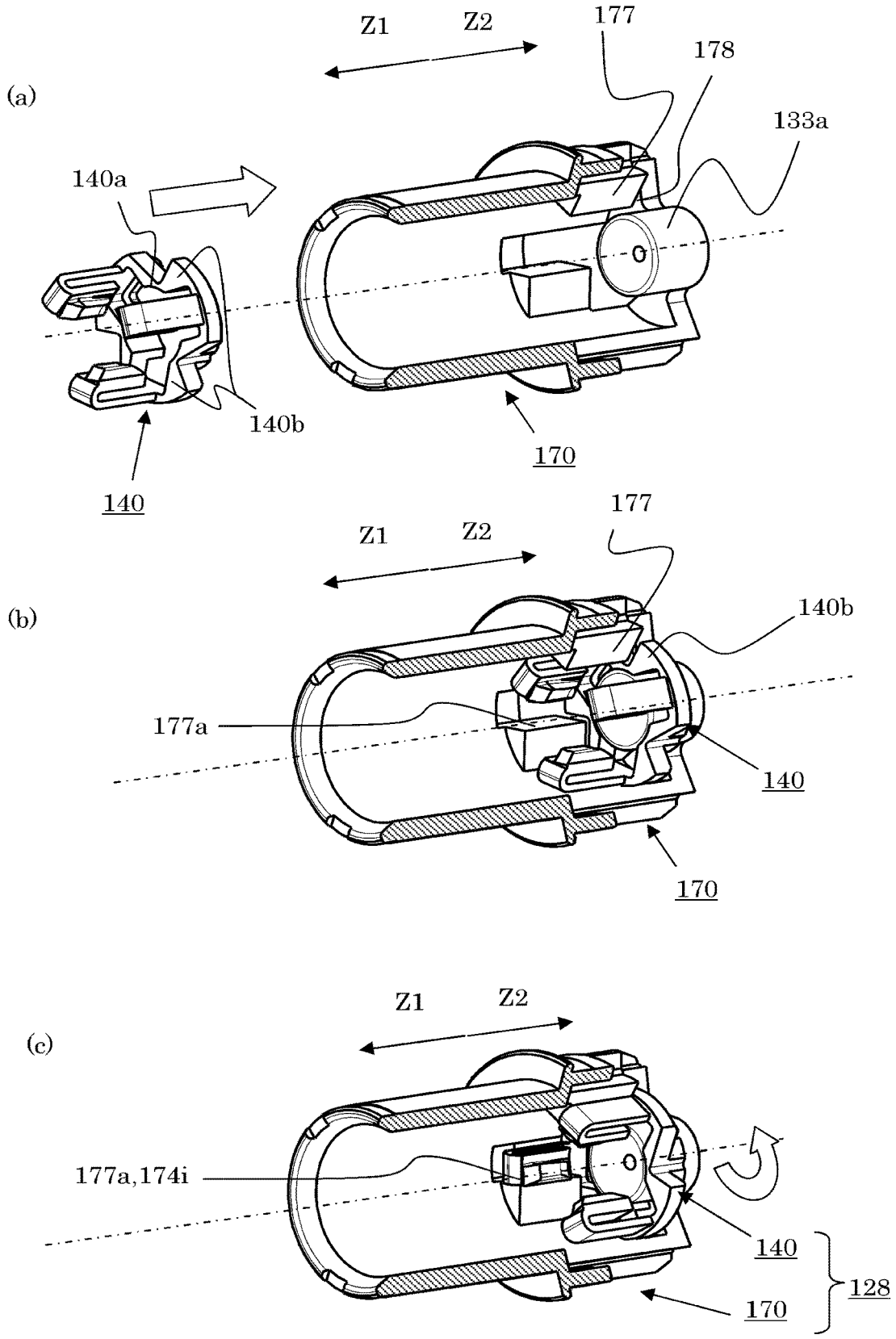

Parts (a), (b) and (c) of FIG. 29 are sectional views showing the assembling procedure of the coupling member 128 according to Embodiment 2.

Figure 30:
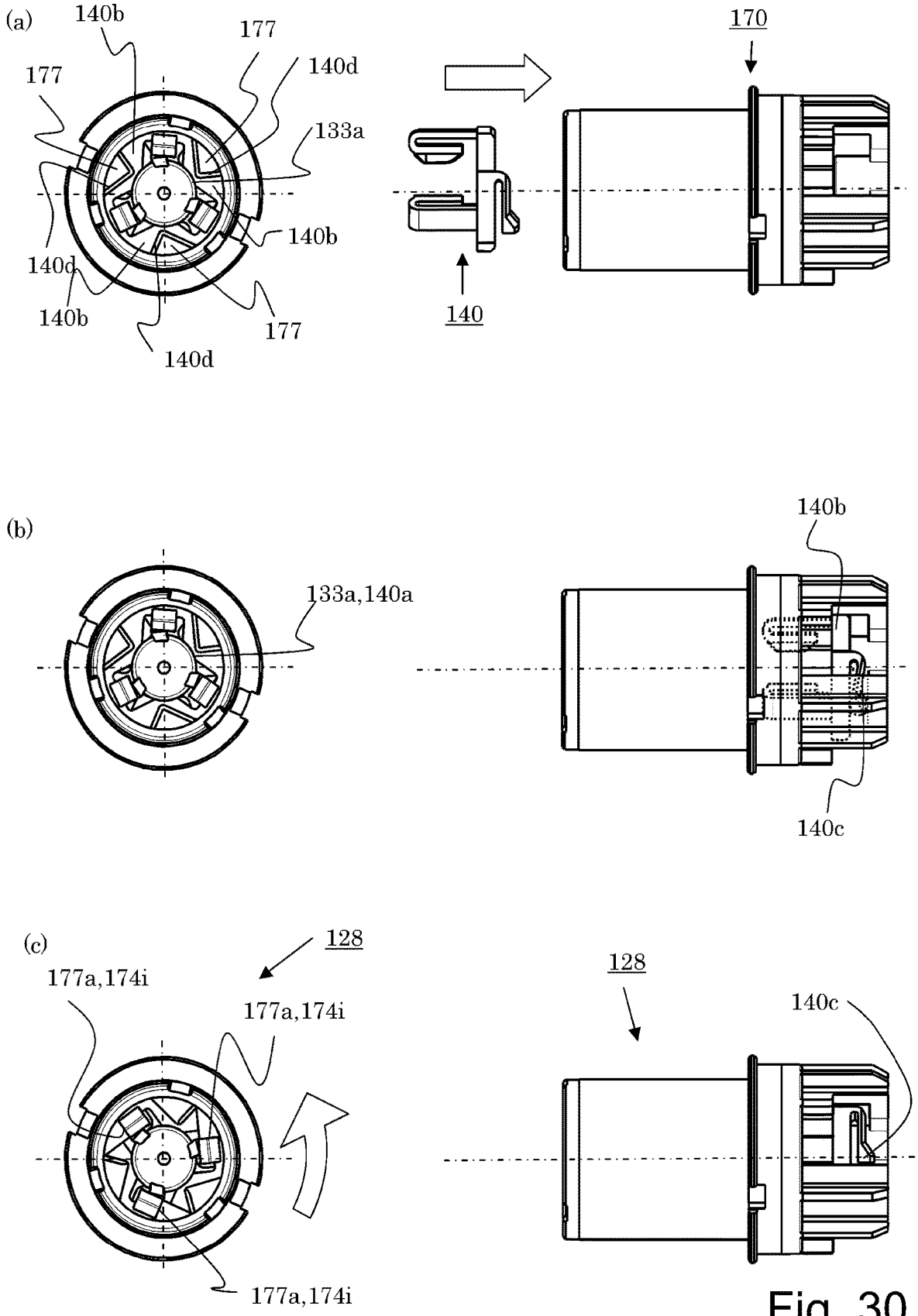

Parts (a), (b) and (c) of FIG. 30 are illustrations of the assembly procedure of the coupling member 128 according to Embodiment 2 as viewed from the outer side and from the lateral side in the Z direction.

Figure 31:
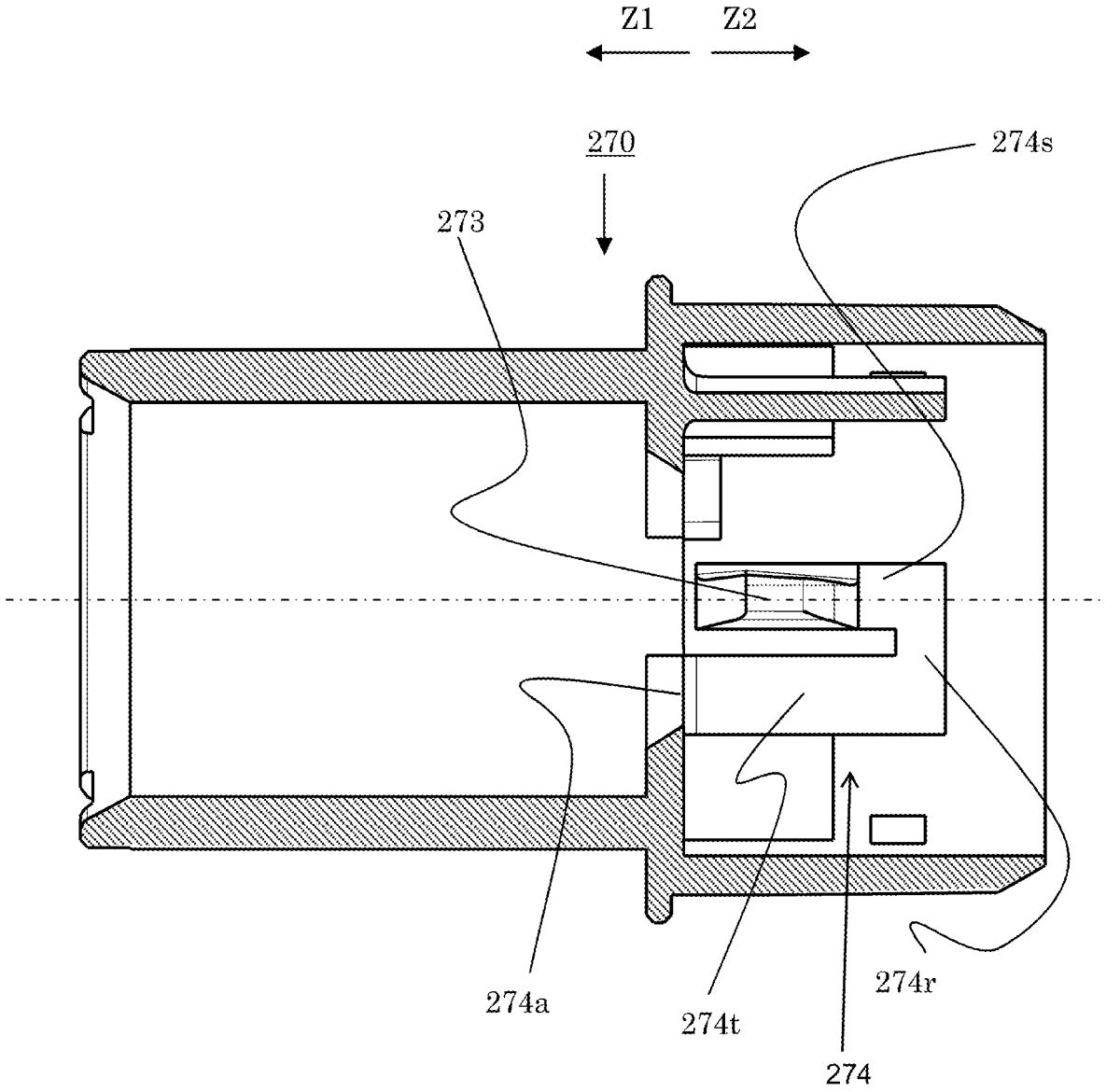

FIG. 31 is a cross-sectional view of the flange member 270 according to Embodiment 3 taken along the rotation axis (center of rotation axis).

Figure 32:
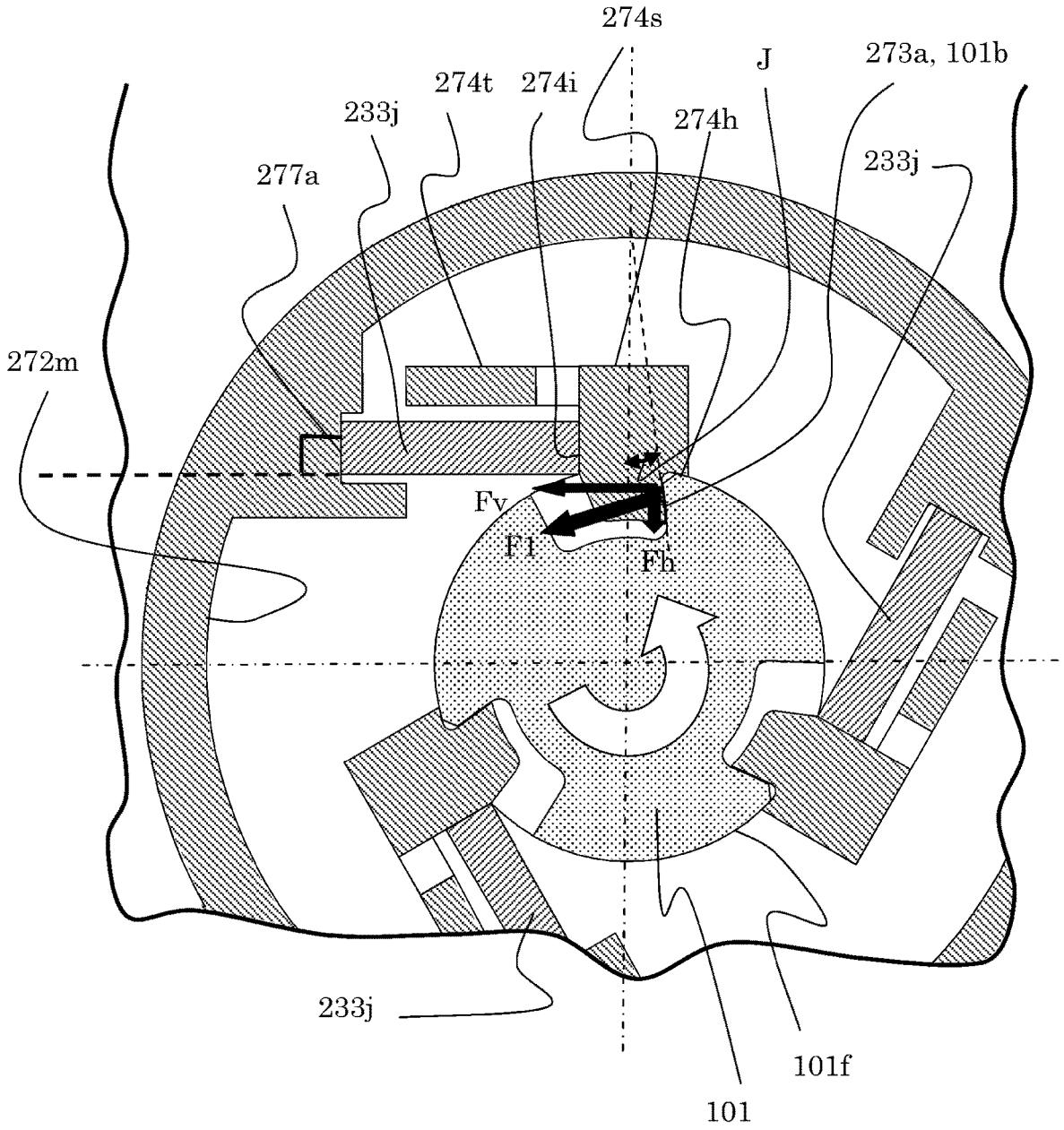

FIG. 32 is a cross-sectional view of the coupling member 228 according to Embodiment 3 and the main assembly driving shaft 101 taken along a plane perpendicular to the rotation axis at a position passing through a support portion 74 in a direction.

Figure 33:
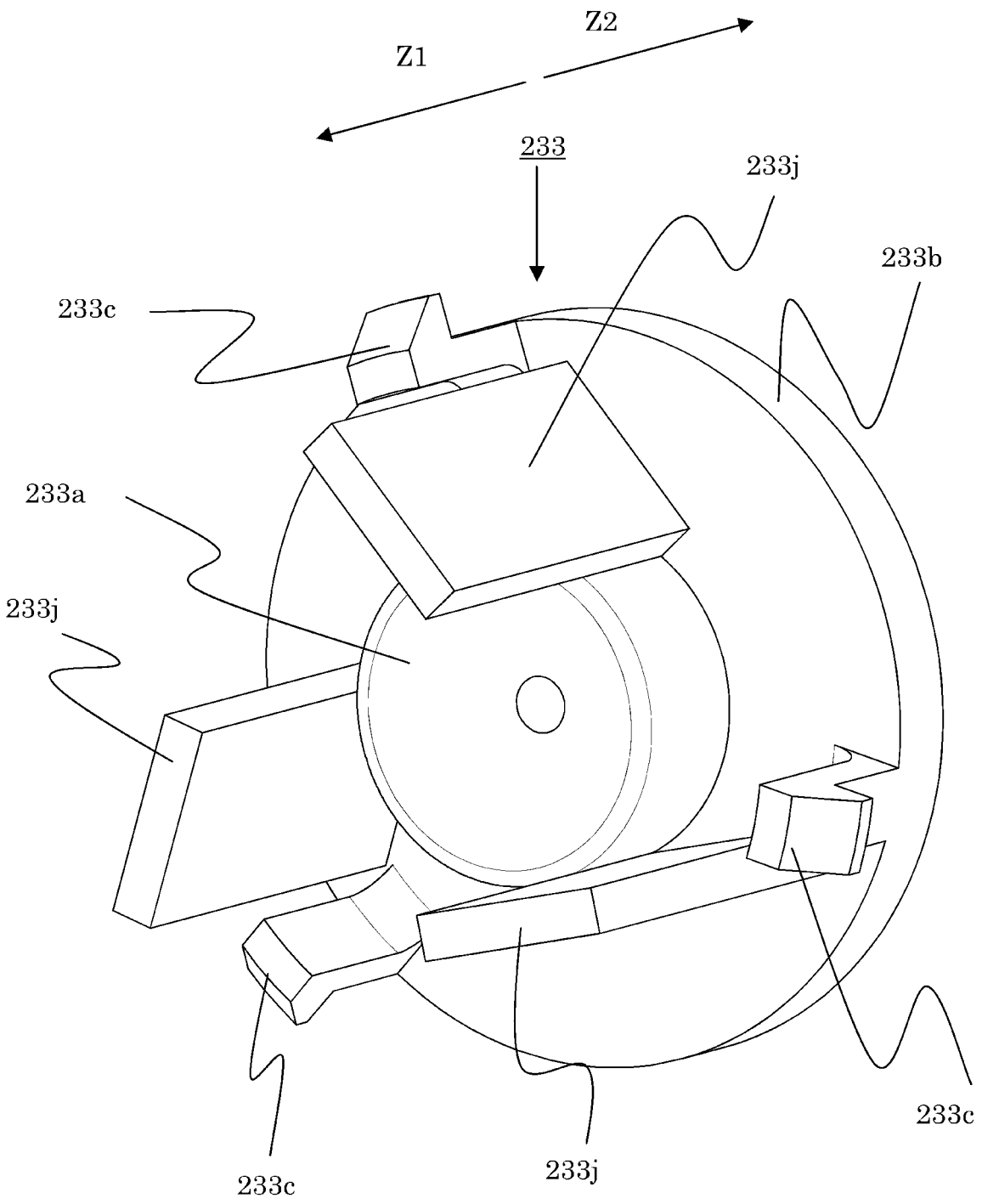

FIG. 33 is a perspective view of an aligning member 233 according to Embodiment 3.

Figure 34:
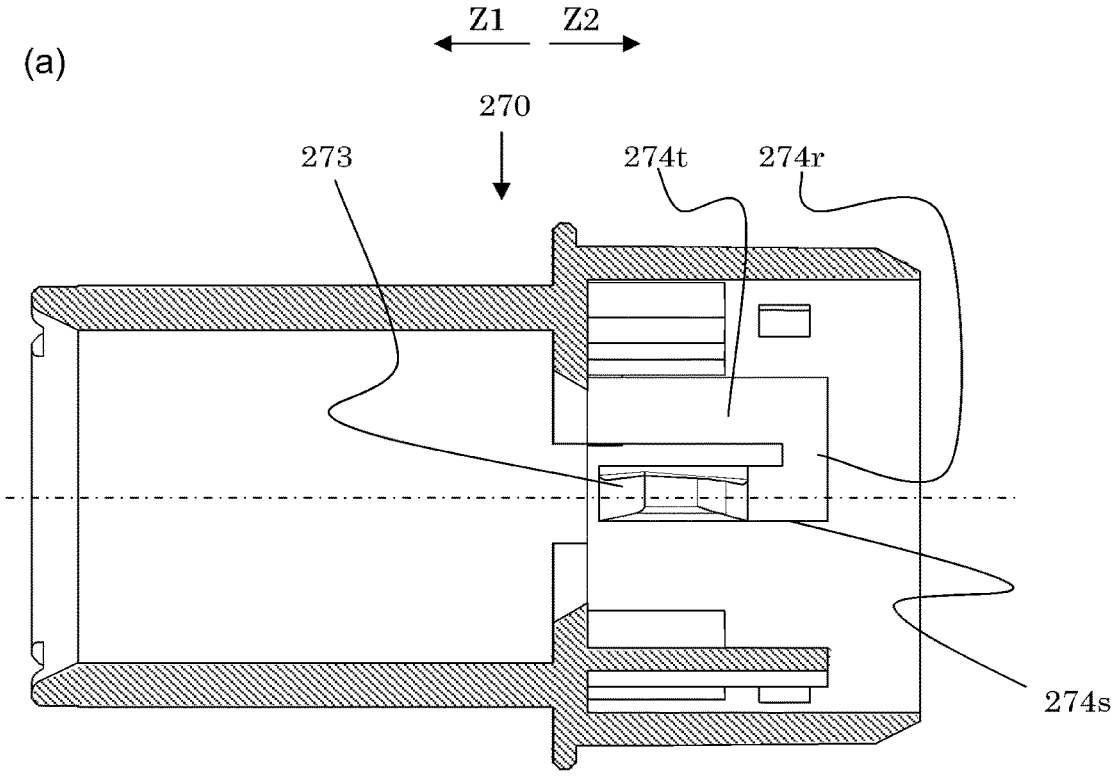
Figure 34:
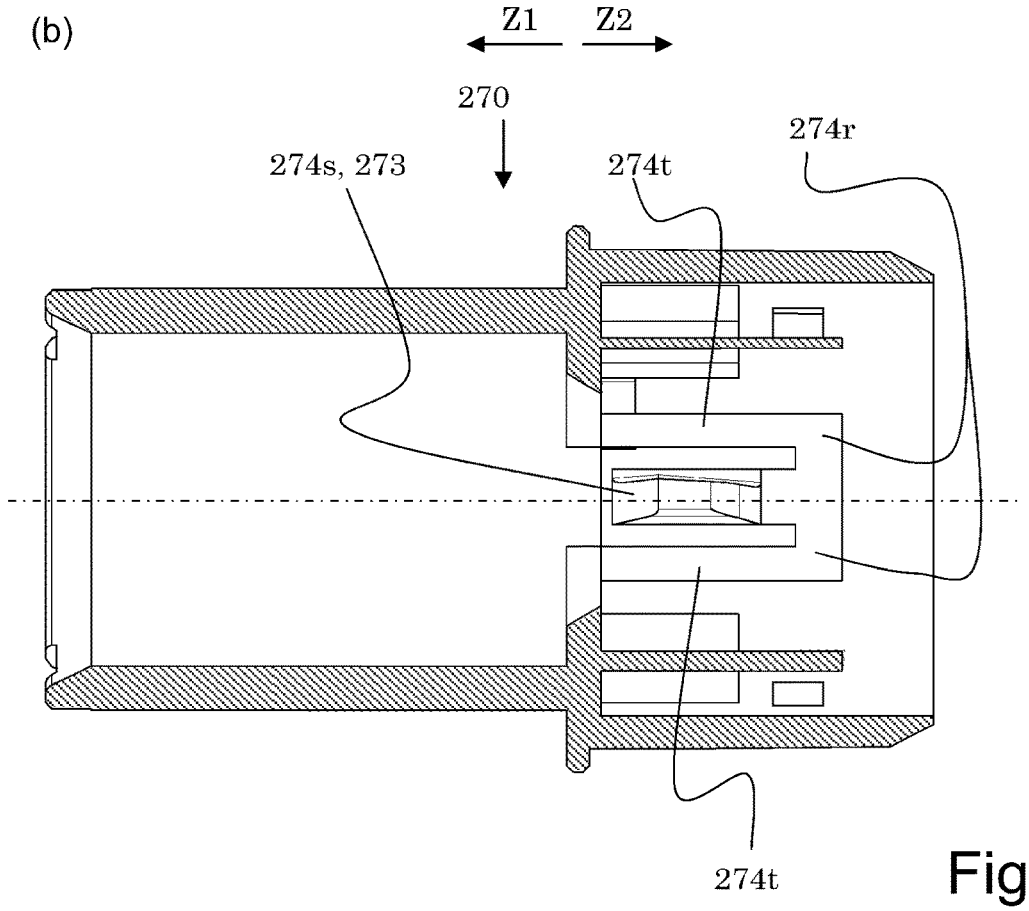

Parts (a) and (b) of FIG. 34 are views illustrating another embodiment of the coupling member 228 according to Embodiment 3.

Figure 35:
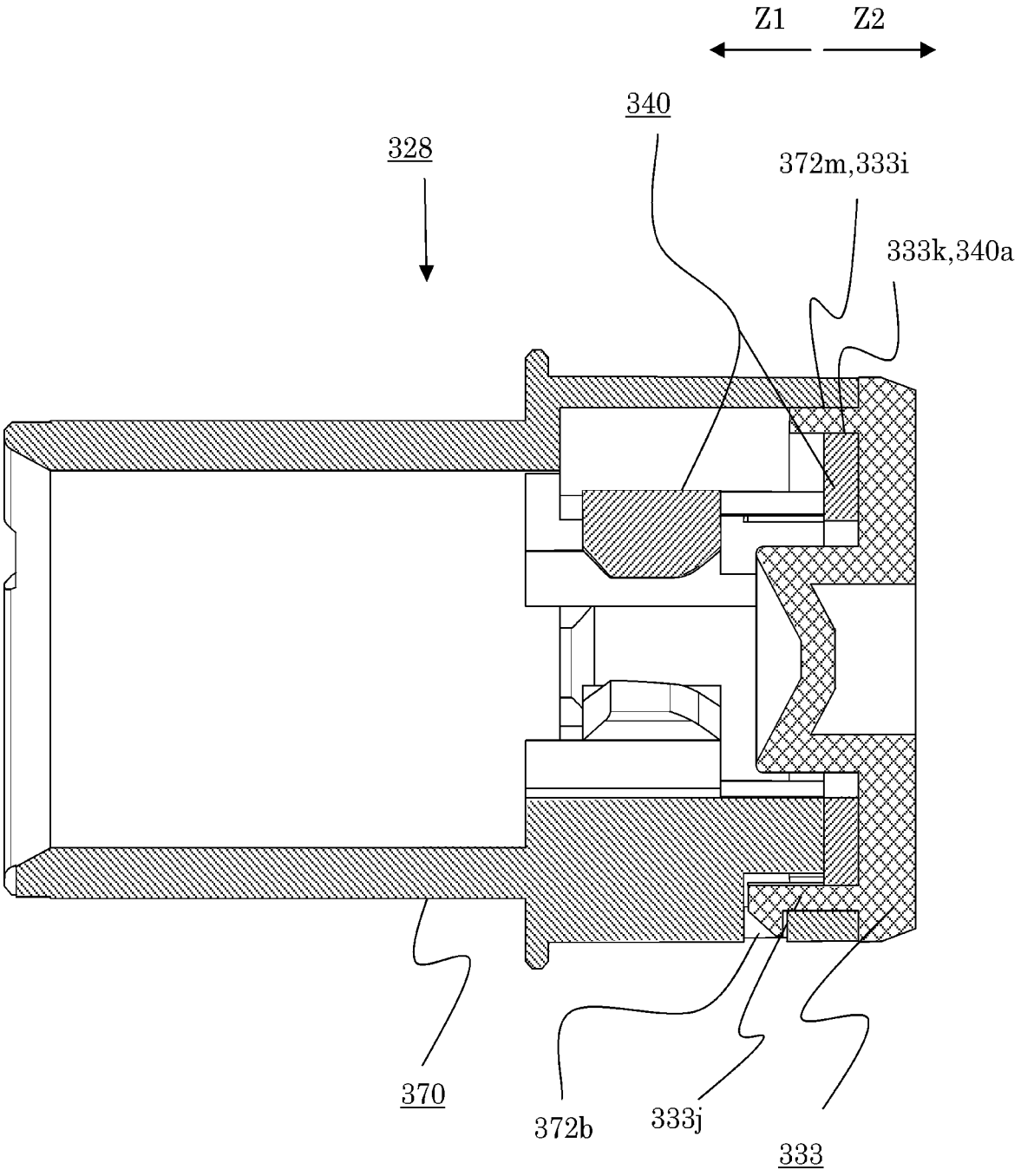

FIG. 35 is a cross-sectional view of the coupling member 328 according to Embodiment 4 taken along the rotation axis (center of rotation axis).

Figure 36:
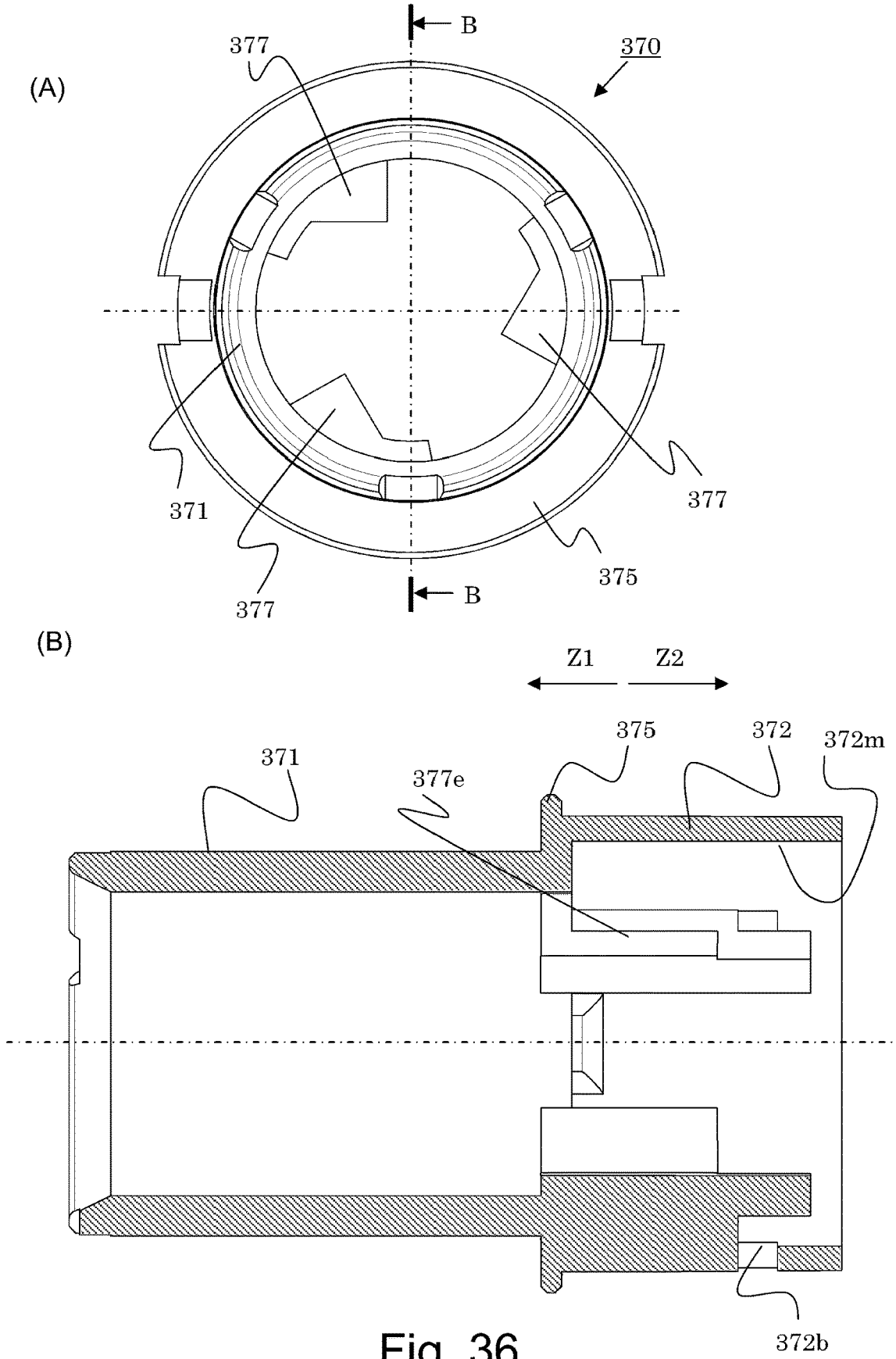

Parts (A) and (B) of FIG. 36 are a view and a cross sectional view of a flange member 370 according to Example 4 as viewed from the outside in the Z direction.

Figure 37:
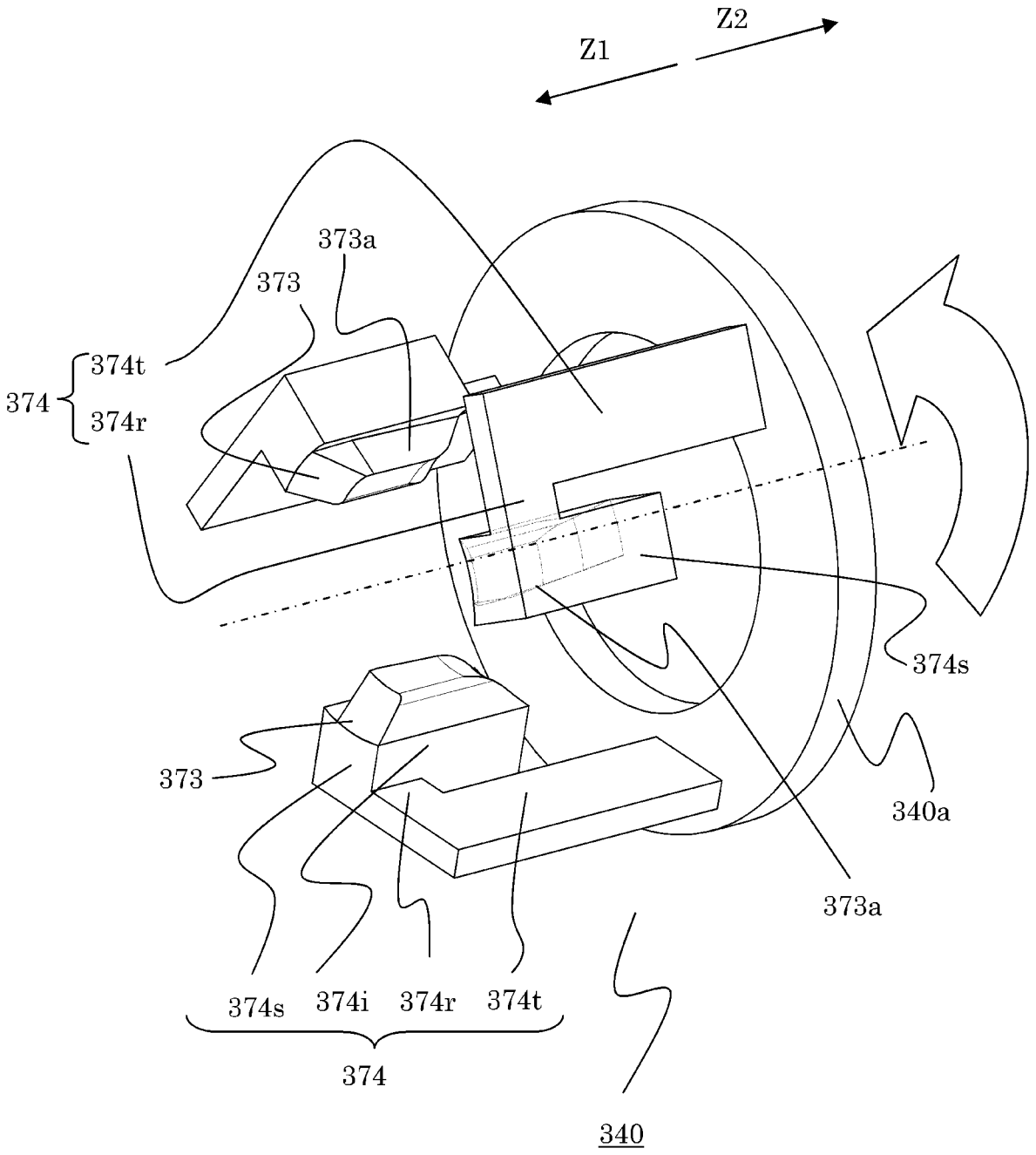

FIG. 37 is a perspective view of an inner cylindrical member 340 according to Embodiment 4.

Figure 38:
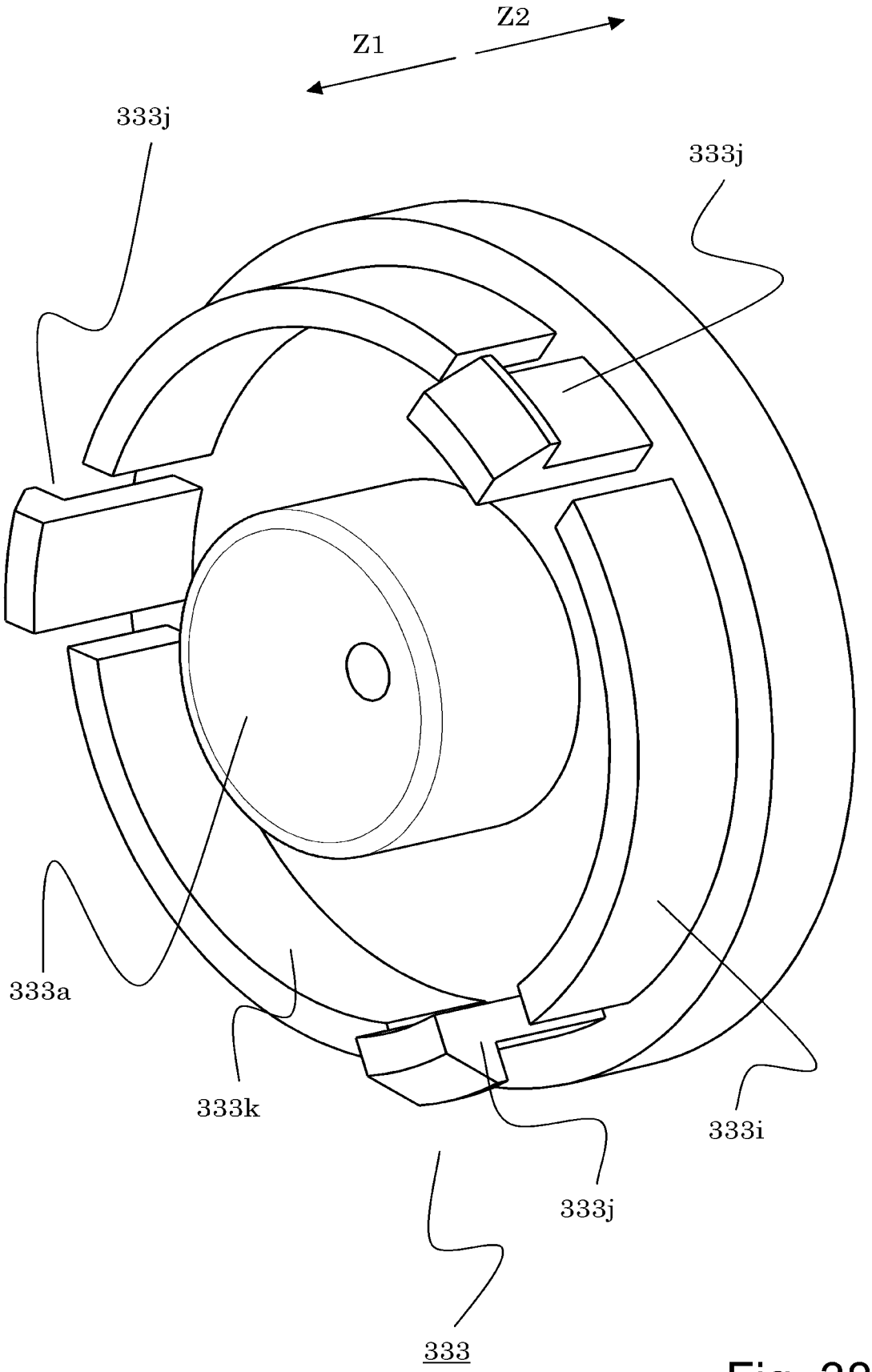

FIG. 38 is a perspective view of an aligning member 333 according to Embodiment 4.

Figure 39:
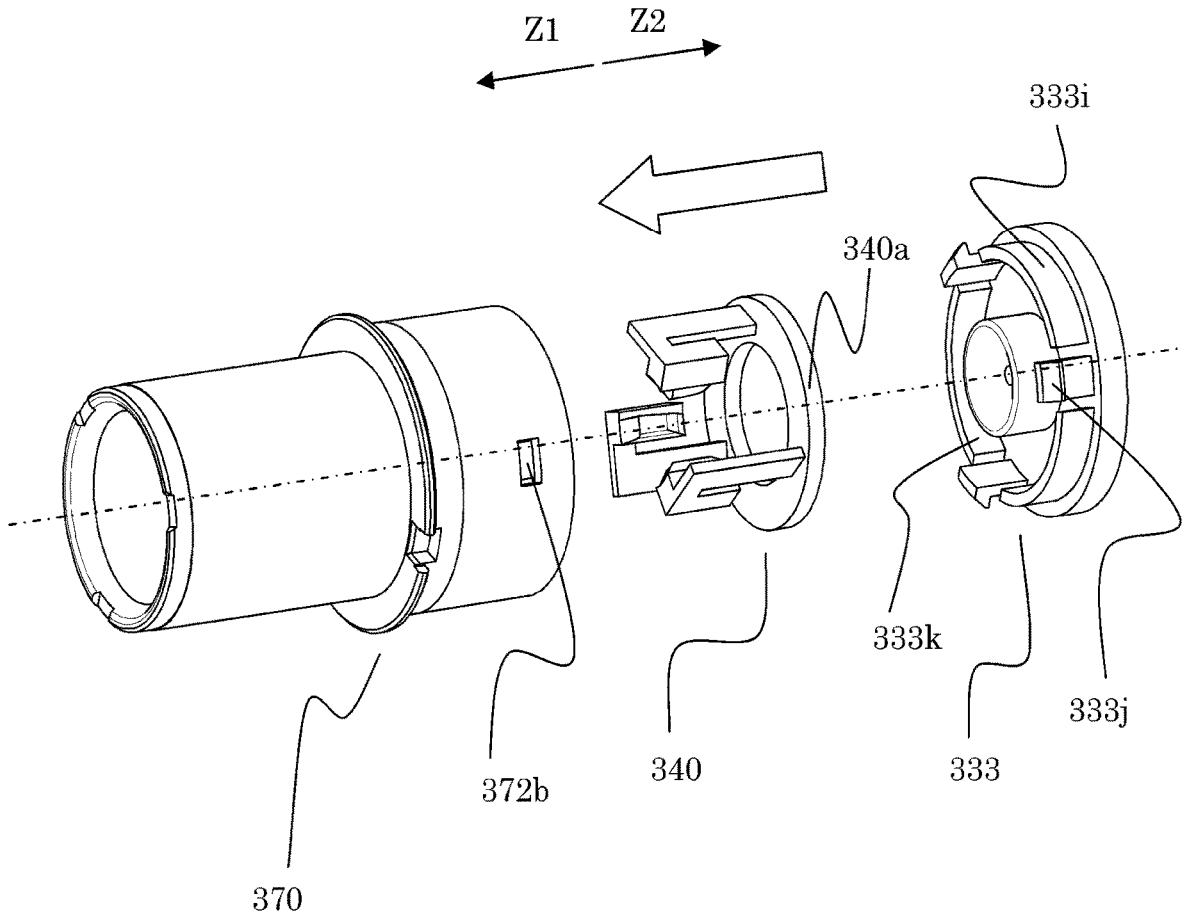

FIG. 39 is an illustration of the assembling of the coupling member 328 according to Embodiment 4.

Figure 40:
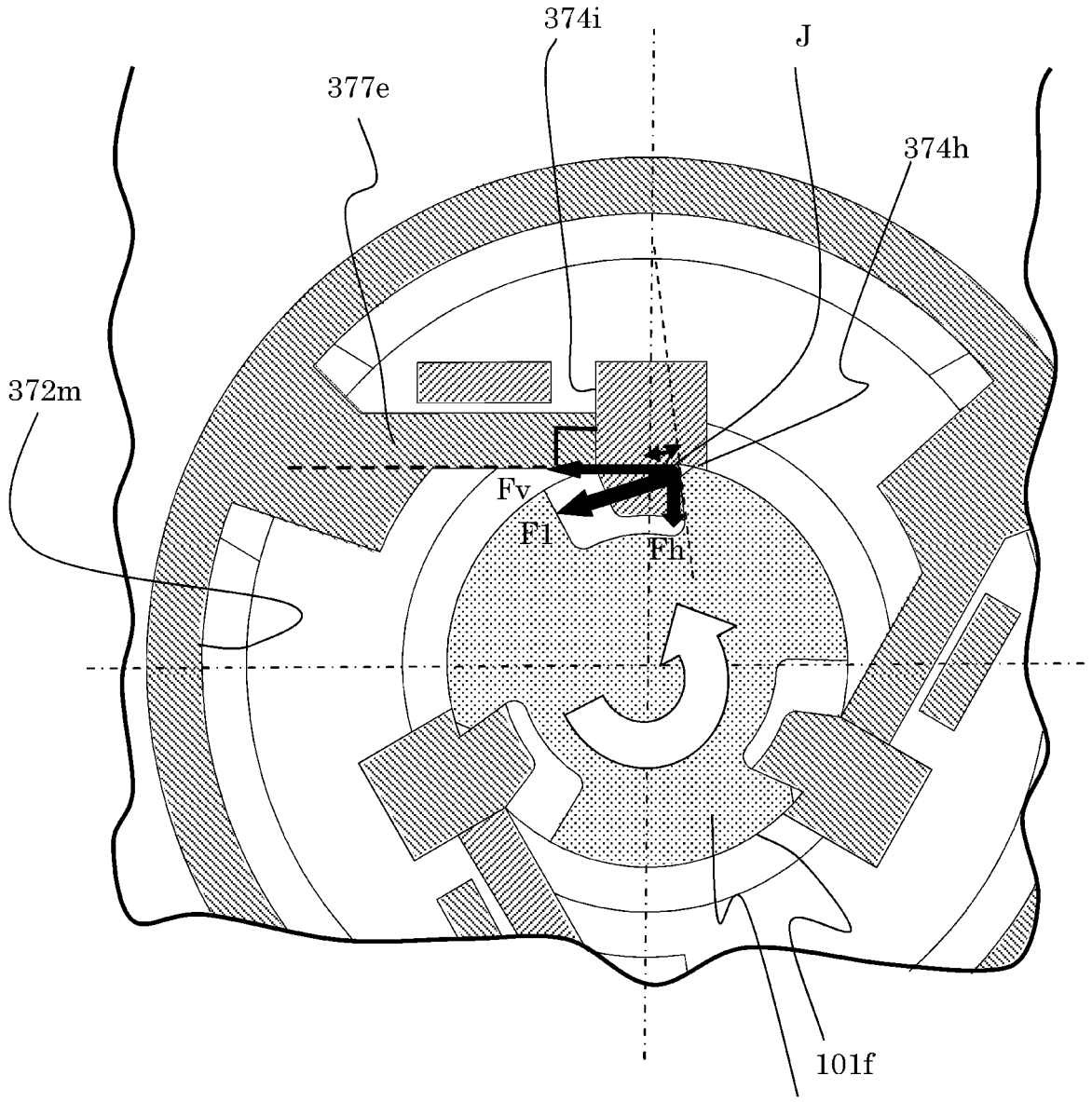

FIG. 40 is a cross-sectional view of the coupling member 328 and the main assembly driving shaft 101 according to Embodiment 4 taken along a plane perpendicular to the rotation axis at a position passing through the driving force receiving surface 373*a*.

Figure 41:
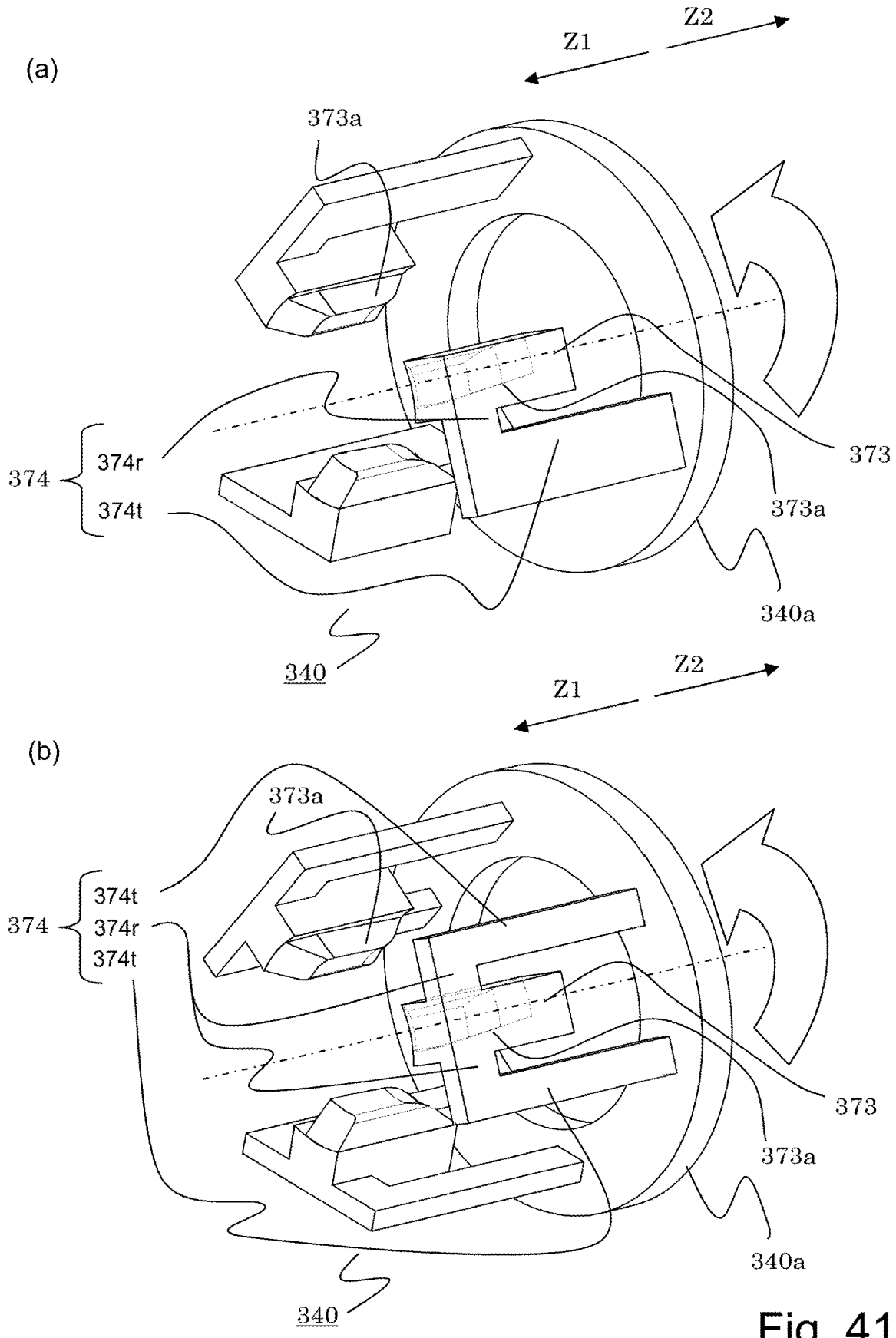

Parts (a) and (b) of FIG. 41 are views illustrating another example of the inner cylindrical member 340 according to Embodiment 4.

Figure 42:
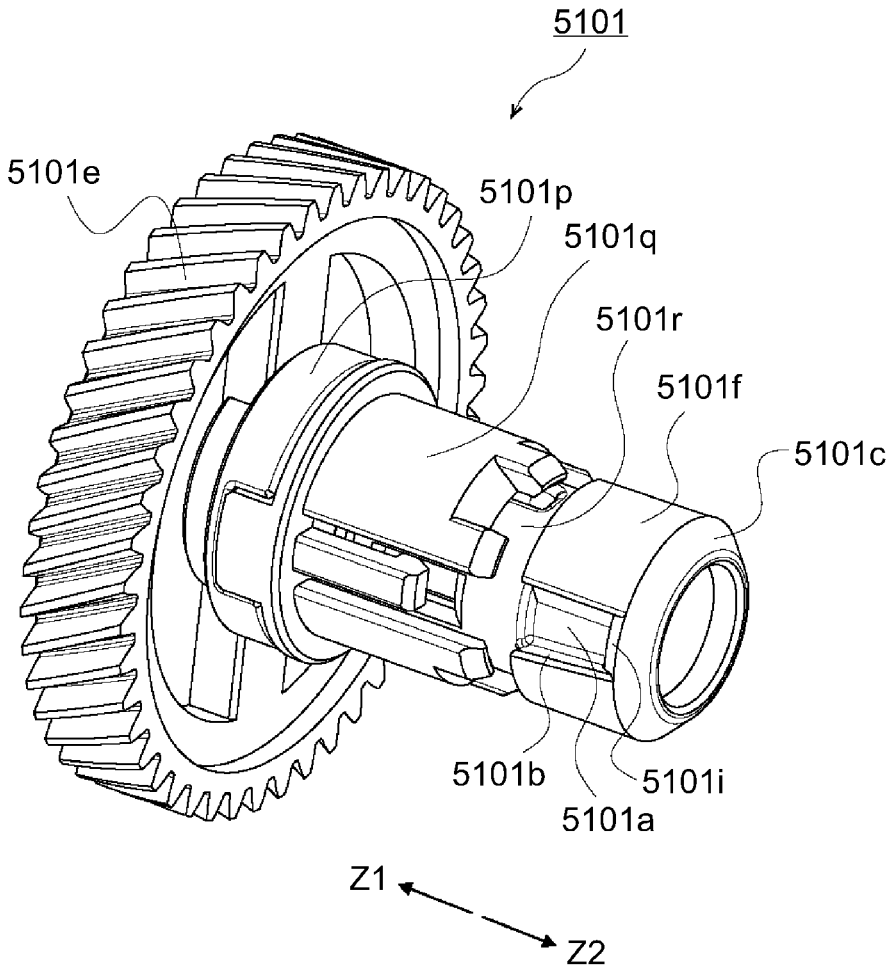

FIG. 42 is an external view of the main assembly driving shaft 5101 according to Embodiment 5.

Figure 43:
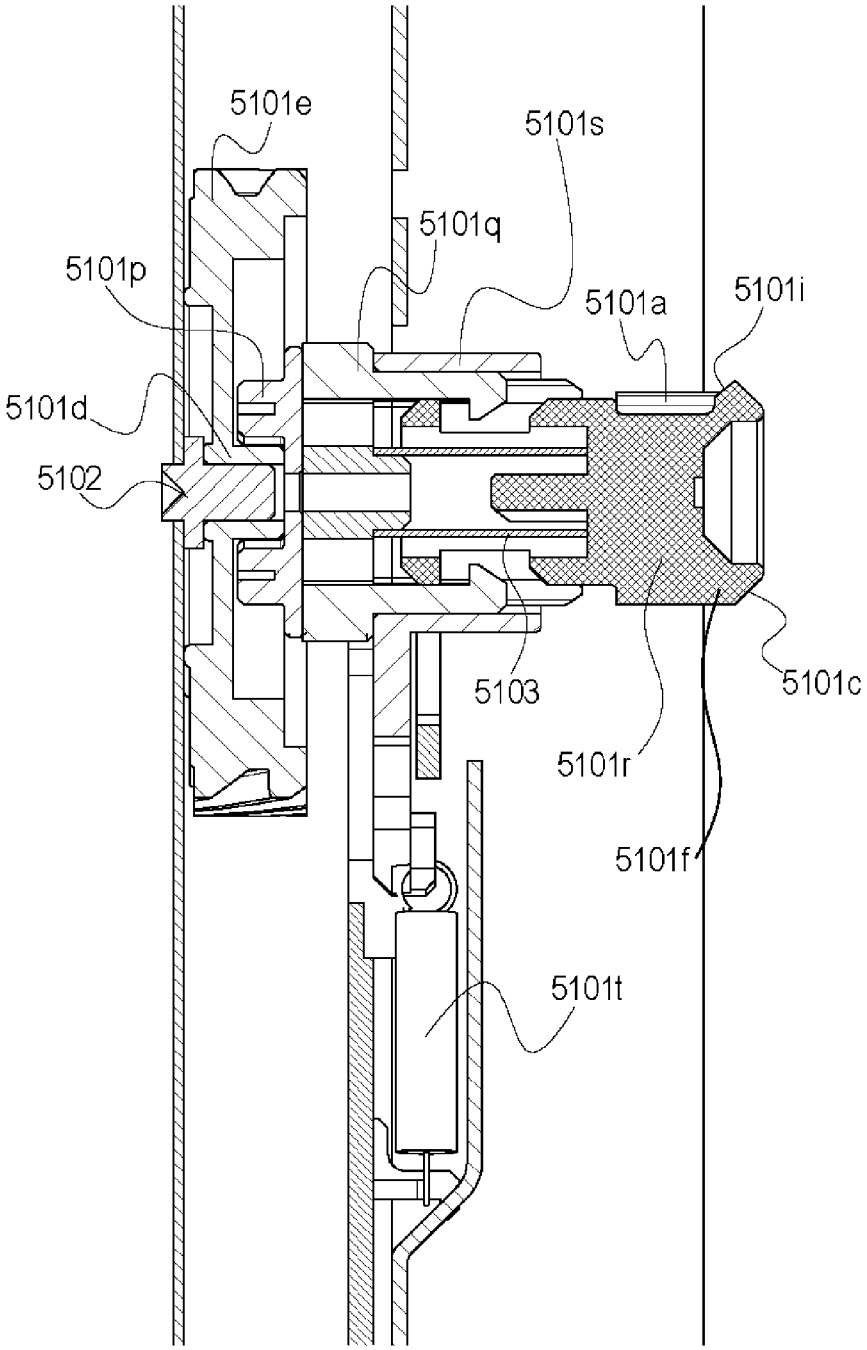

FIG. 43 is a cross-sectional view taken along the rotation axis (rotation axis) of the main assembly driving shaft 5101 in a state in which the main assembly driving shaft 5101 according to Embodiment 5 is mounted to the image forming apparatus main assembly.

Figure 44:
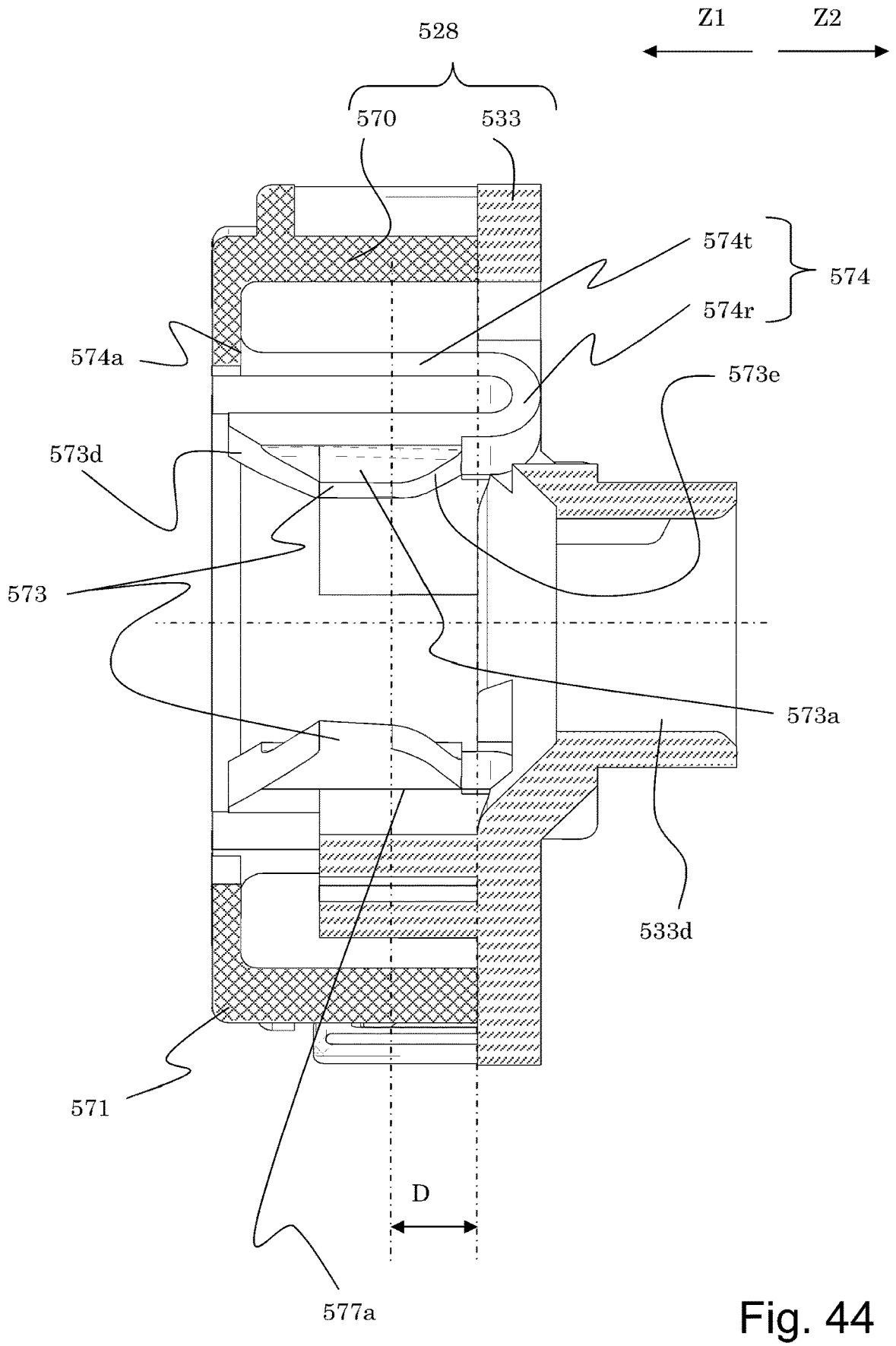

FIG. 44 is a cross-sectional view of a coupling member 528 according to Embodiment 5 taken along the rotation axis.

Figure 45:
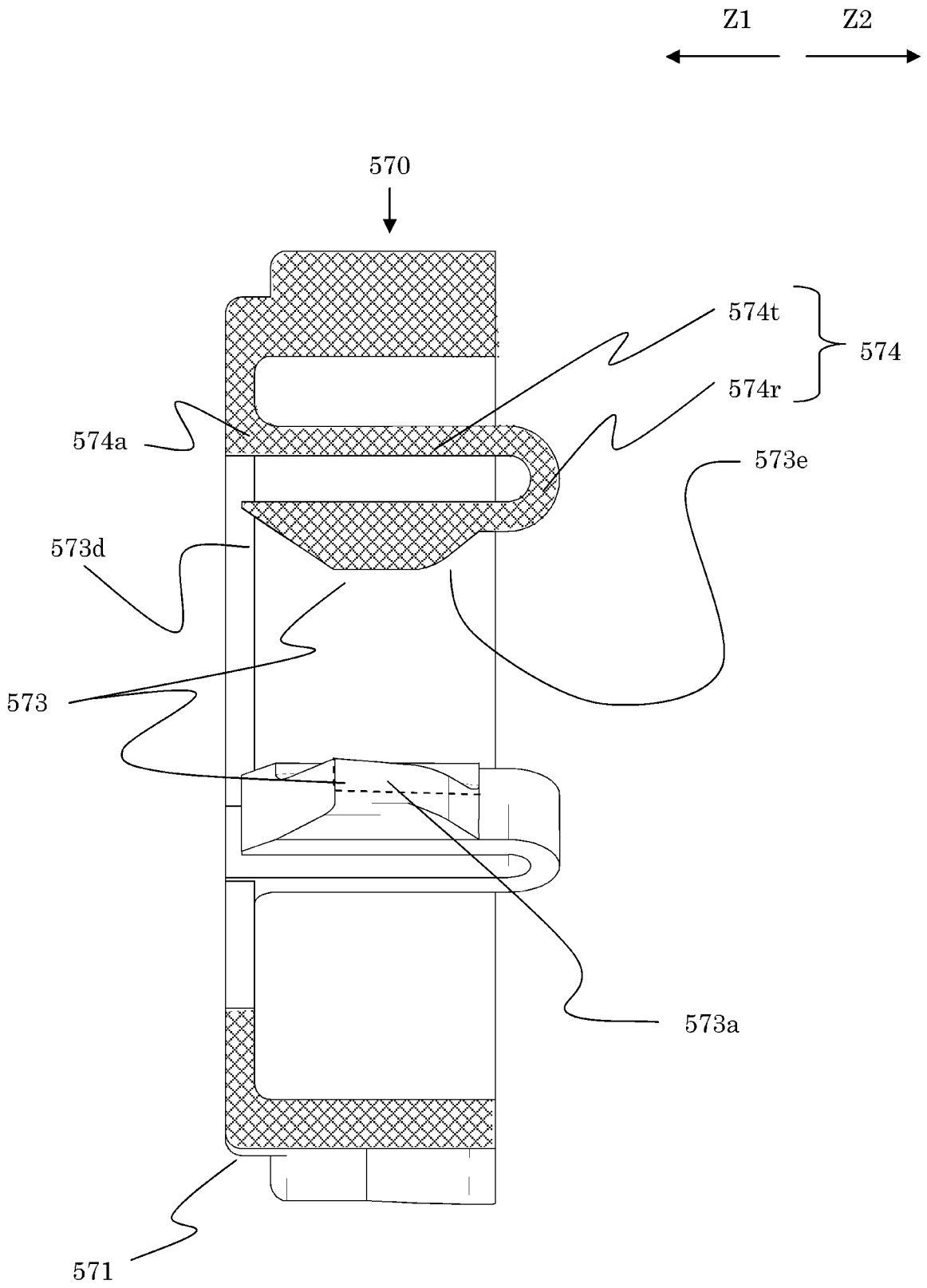

FIG. 45 is a cross-sectional view of a cylindrical member 570 according to Embodiment 5 taken along the rotation axis.

Figure 46:
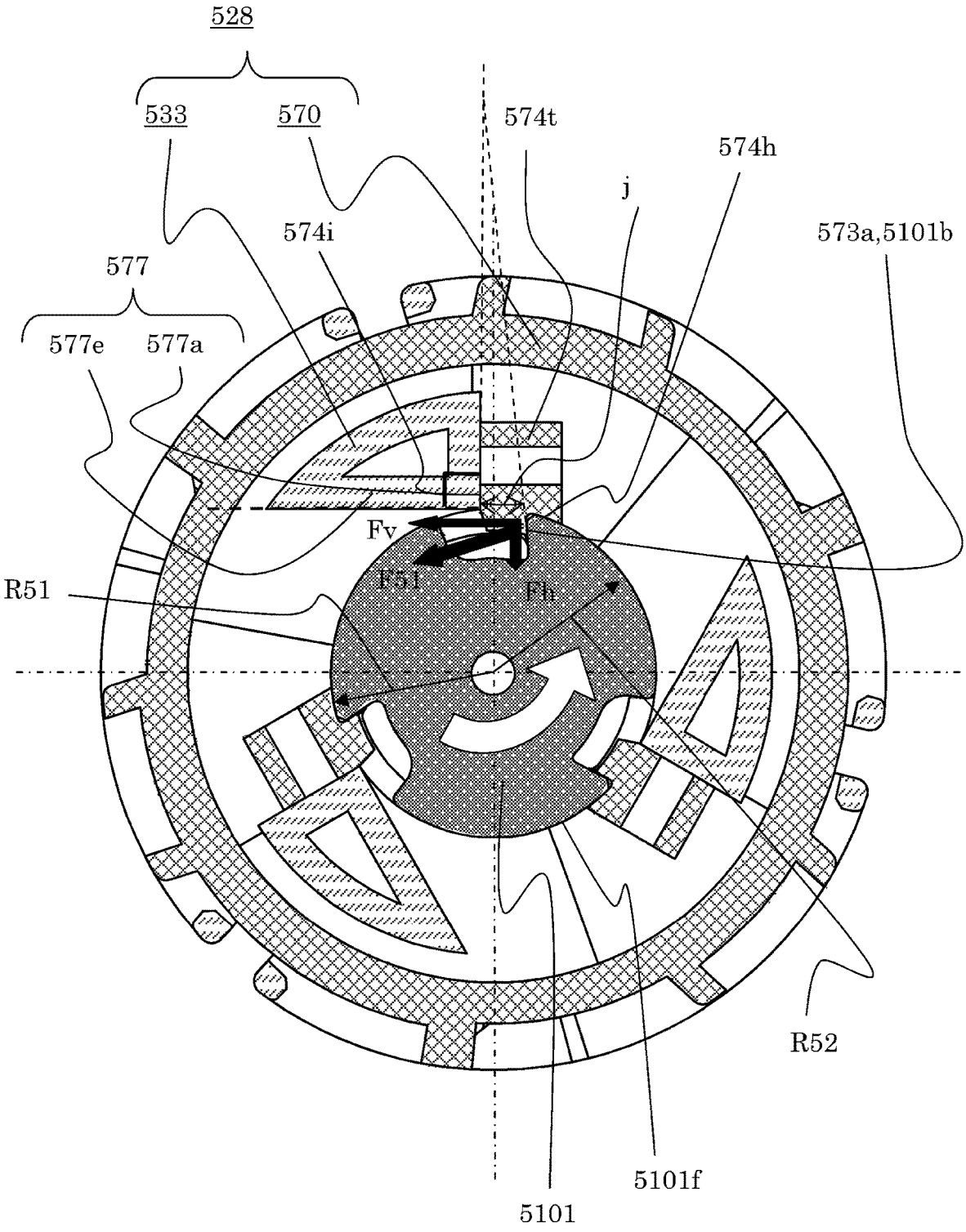

FIG. 46 is a cross-sectional view of the coupling member 528 according to Embodiment 5 and the main assembly driving shaft 5101, taken along a plane perpendicular to the rotation axis of the coupling member 528 and passing through the drive receiving surface 573*a*.

Figure 47:
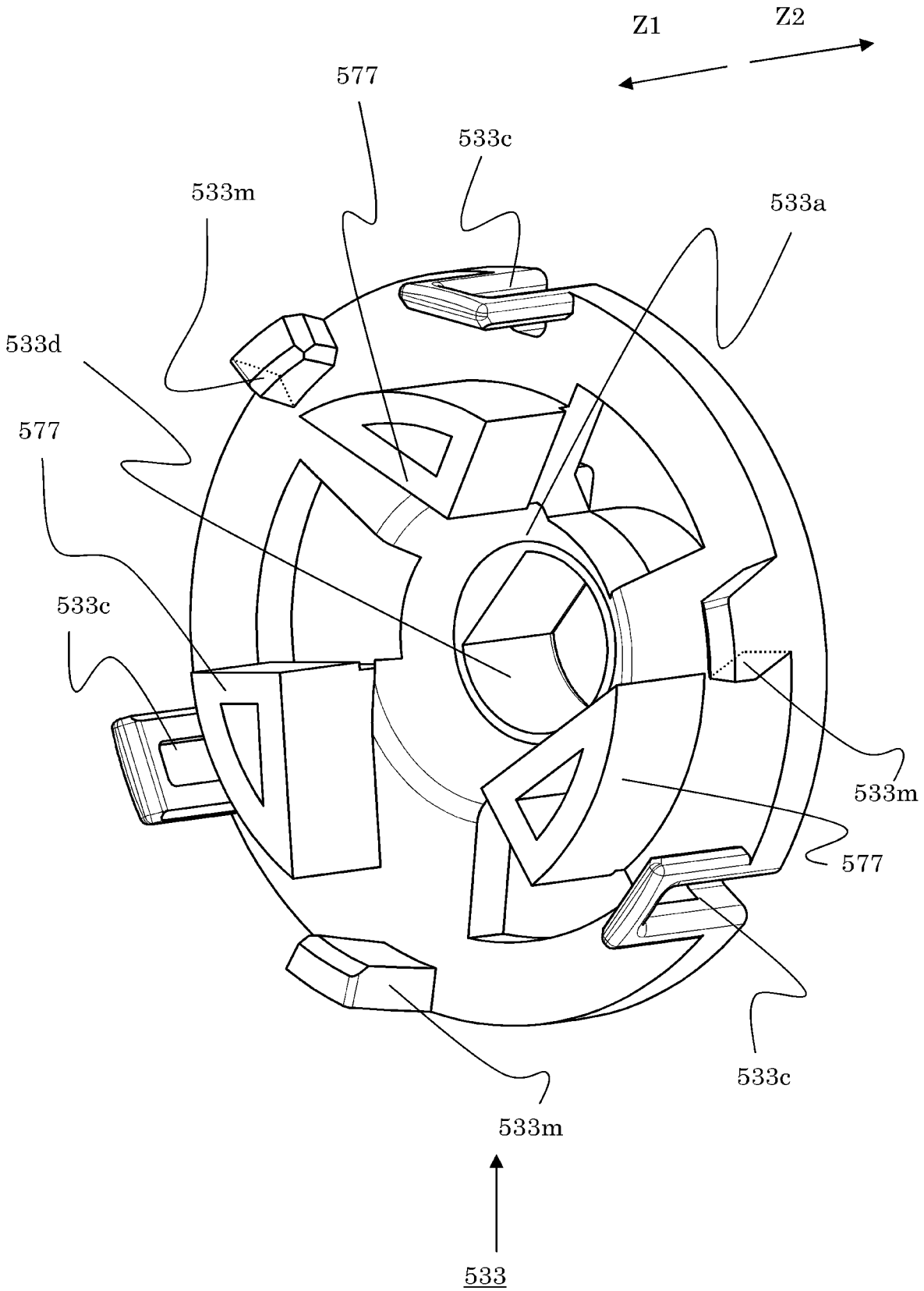

FIG. 47 is a perspective view of an aligning member 533 according to Embodiment 5.

Figure 48:
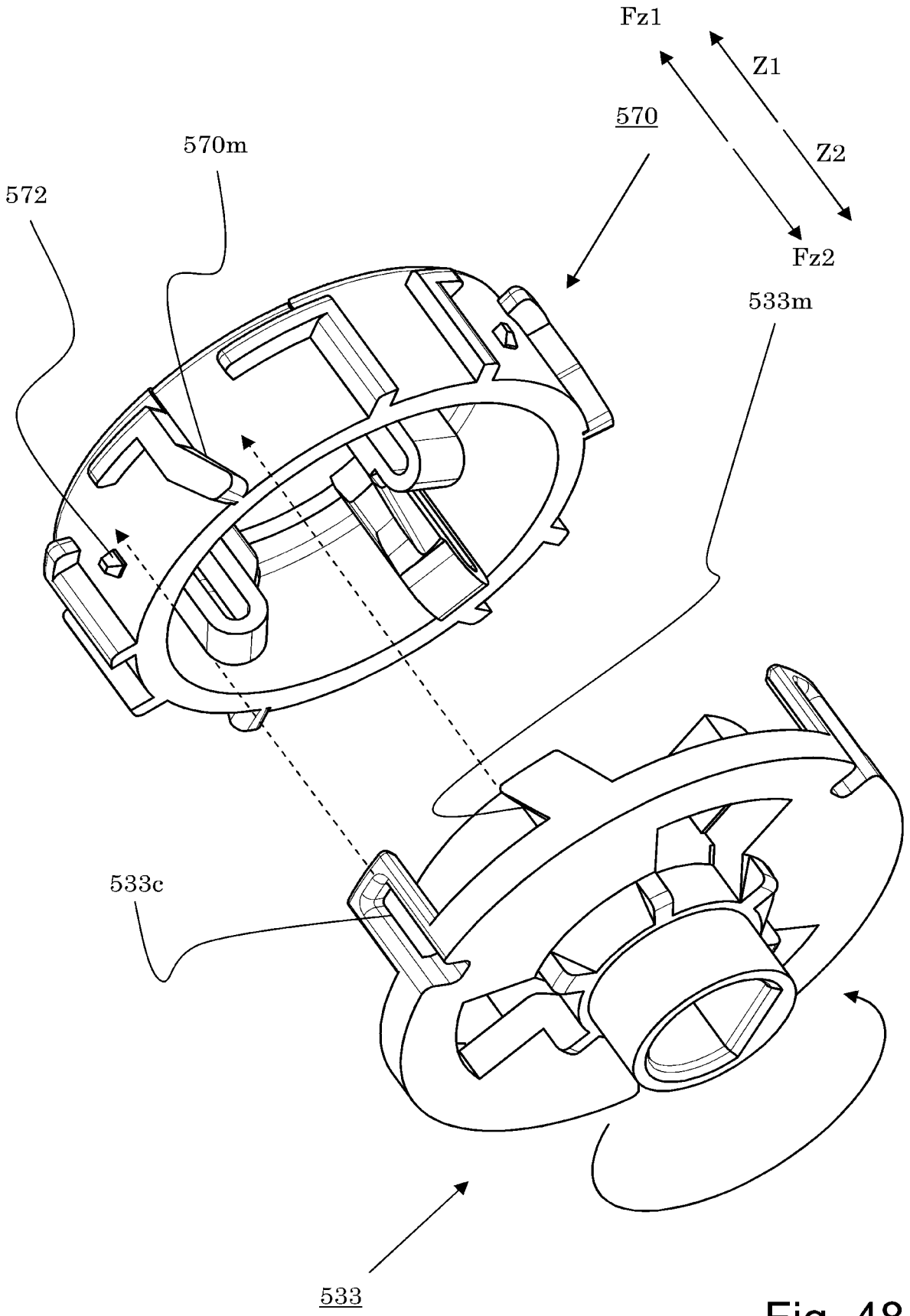

FIG. 48 is a view illustrating the assembling of the coupling member 528 according to Embodiment 5.

Figure 49:
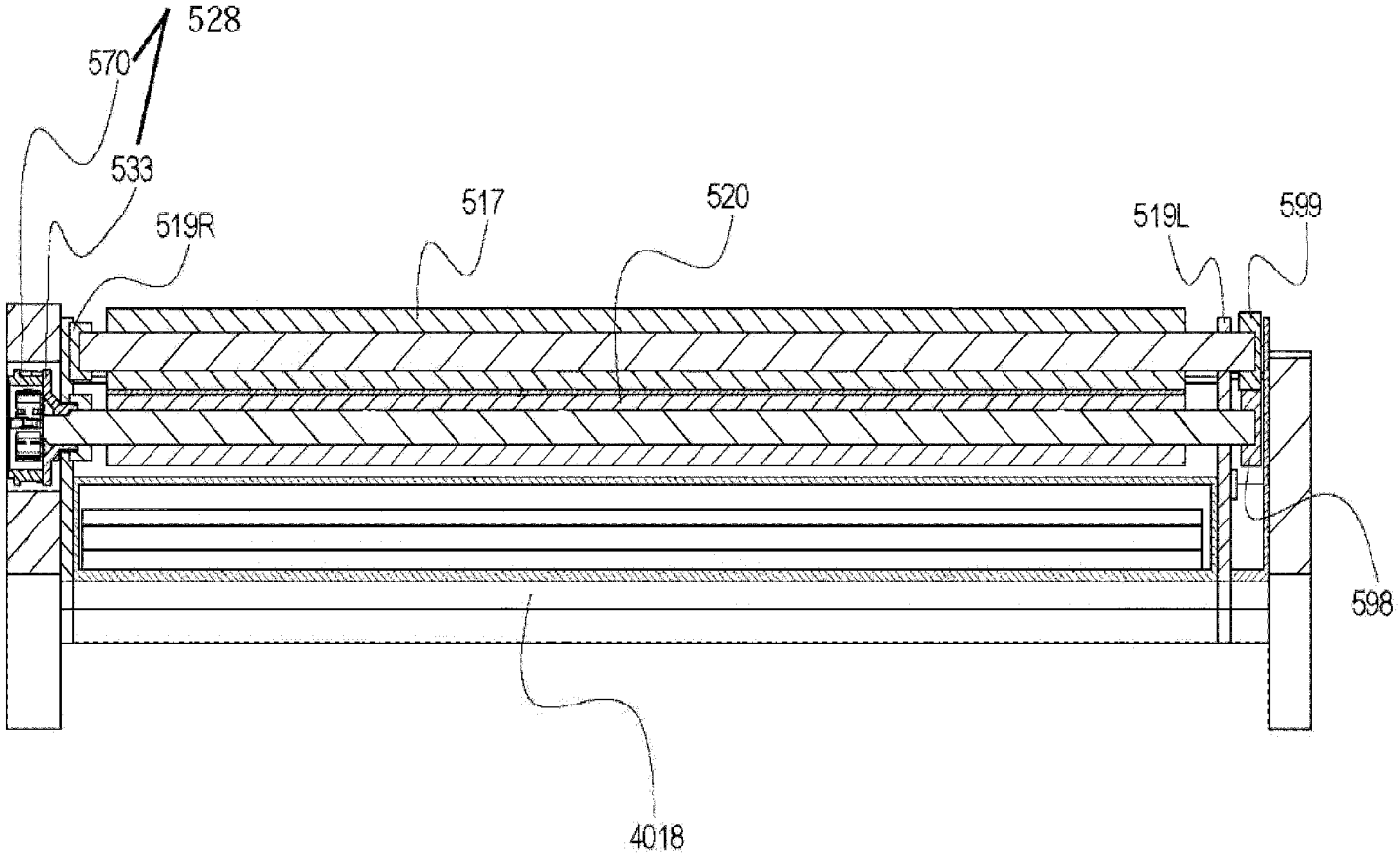

FIG. 49 is a cross-sectional view of a developing cartridge 4 according to Embodiment 5 taken along the axis line of the toner supply roller 20 and the developing roller 17.

Figure 50:
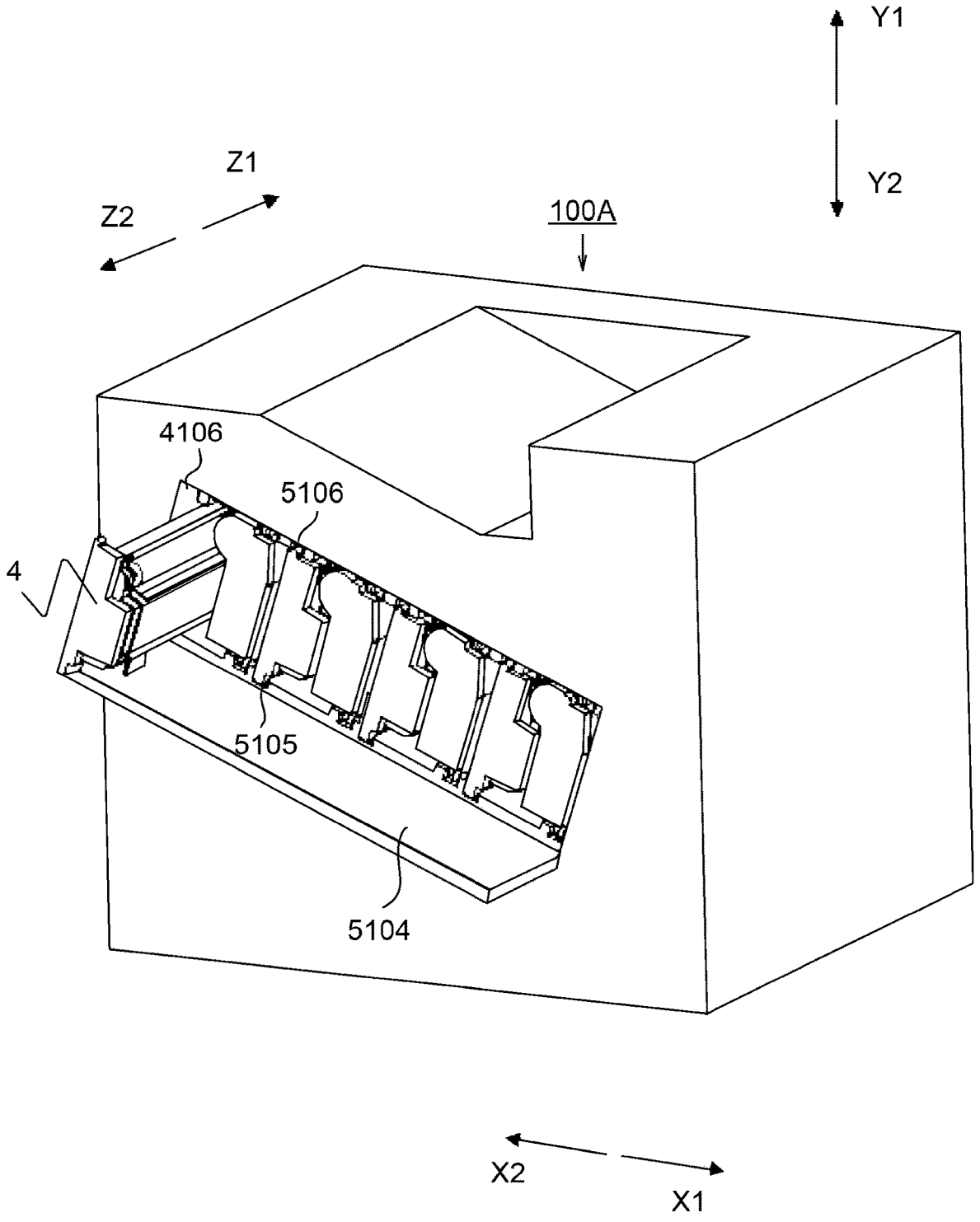

FIG. 50 is a perspective view illustrating mounting of the developing cartridge 4 according to Embodiment 5 to the image forming apparatus main assembly 100A.

Figure 51:
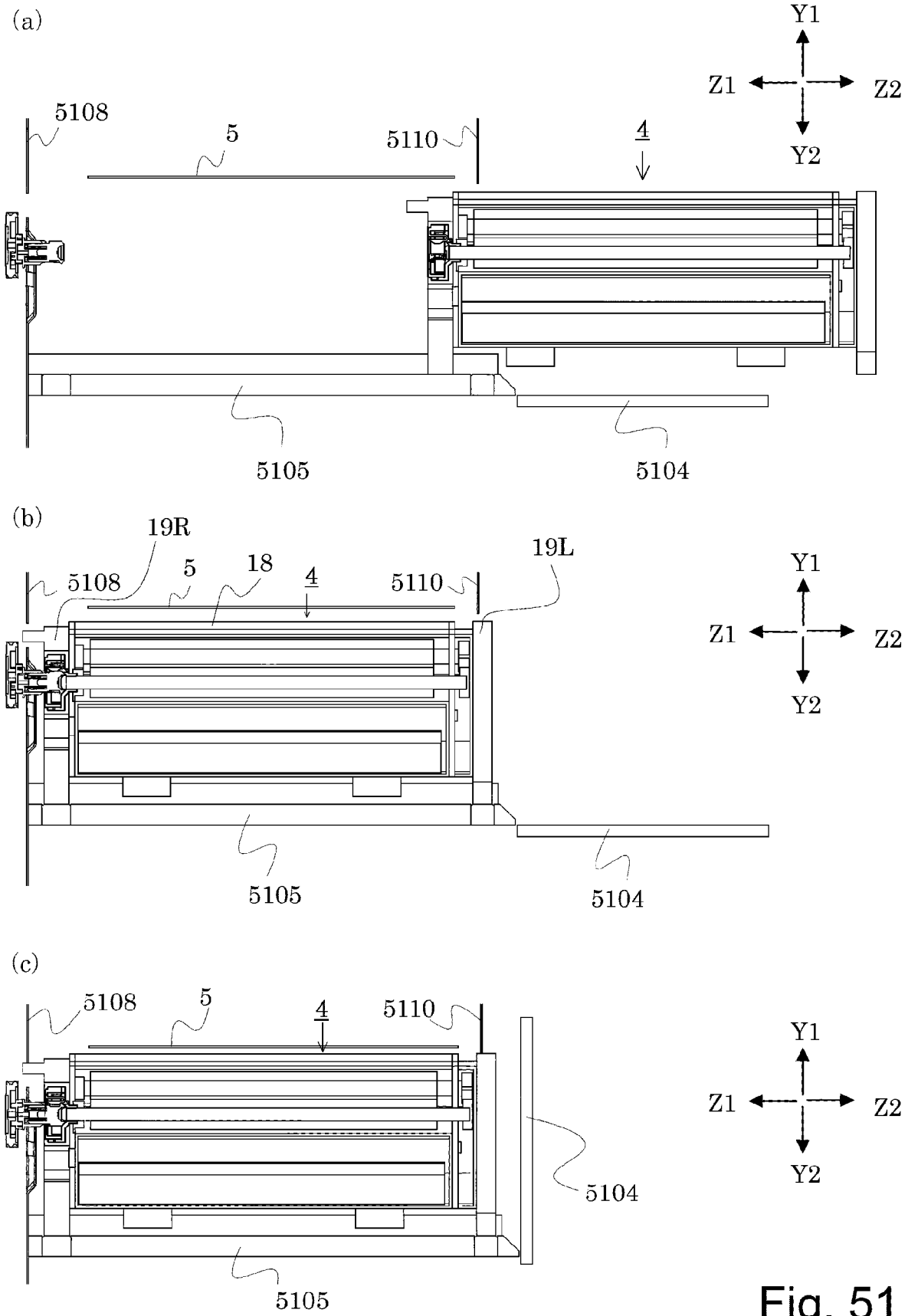

Parts (a), (b) and (c) of FIG. 51 are cross-sectional views illustrating the mounting operation of the developing cartridge 4 according to Embodiment 5 to the image forming apparatus main assembly 100A.

Figure 52:
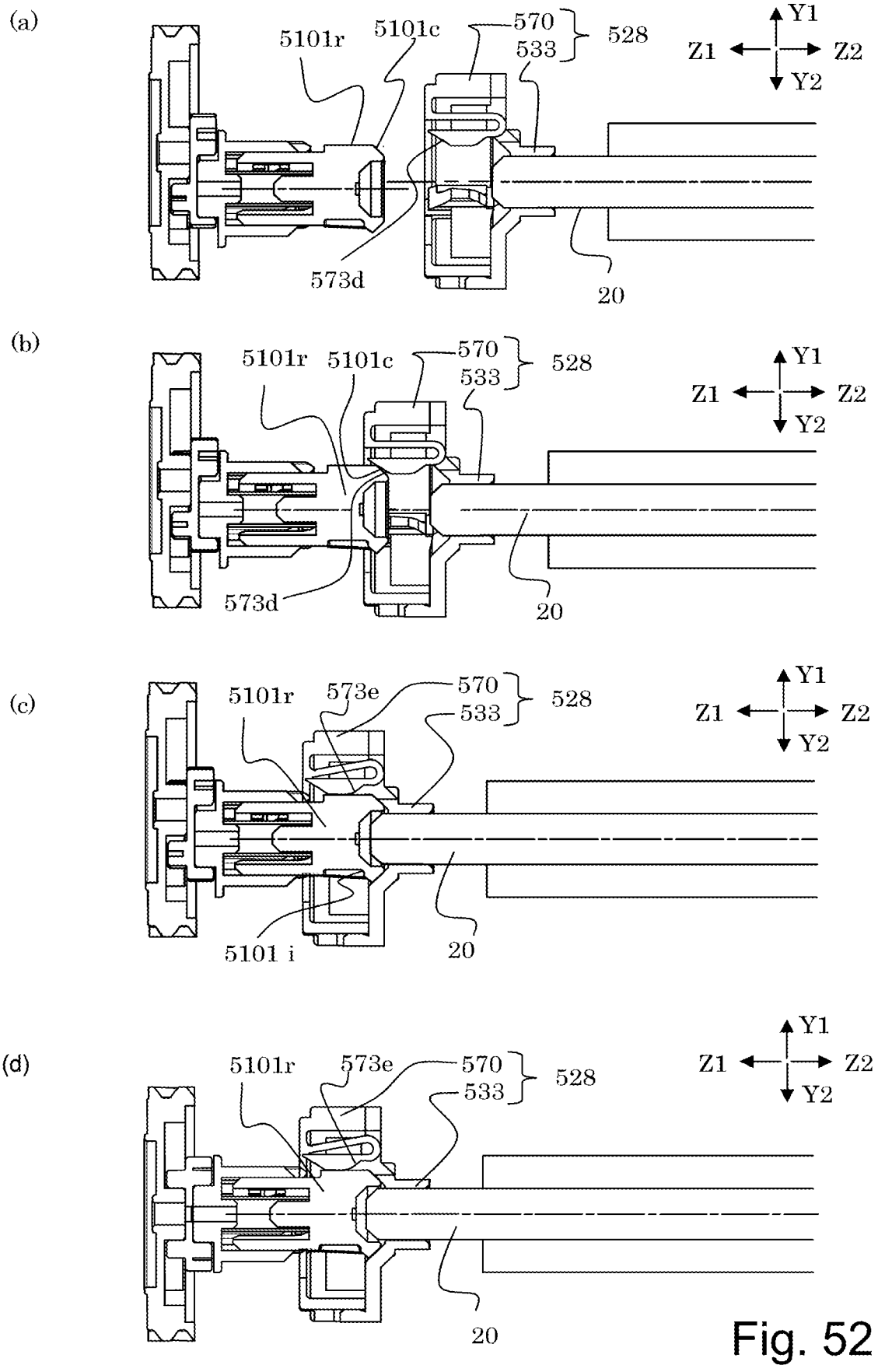

Parts (a), (b), (c), and (d) of FIG. 52 are cross-sectional views illustrating the operation of mounting the coupling member 528 to the main driving shaft 5101 according to Embodiment 5.

Figure 53:
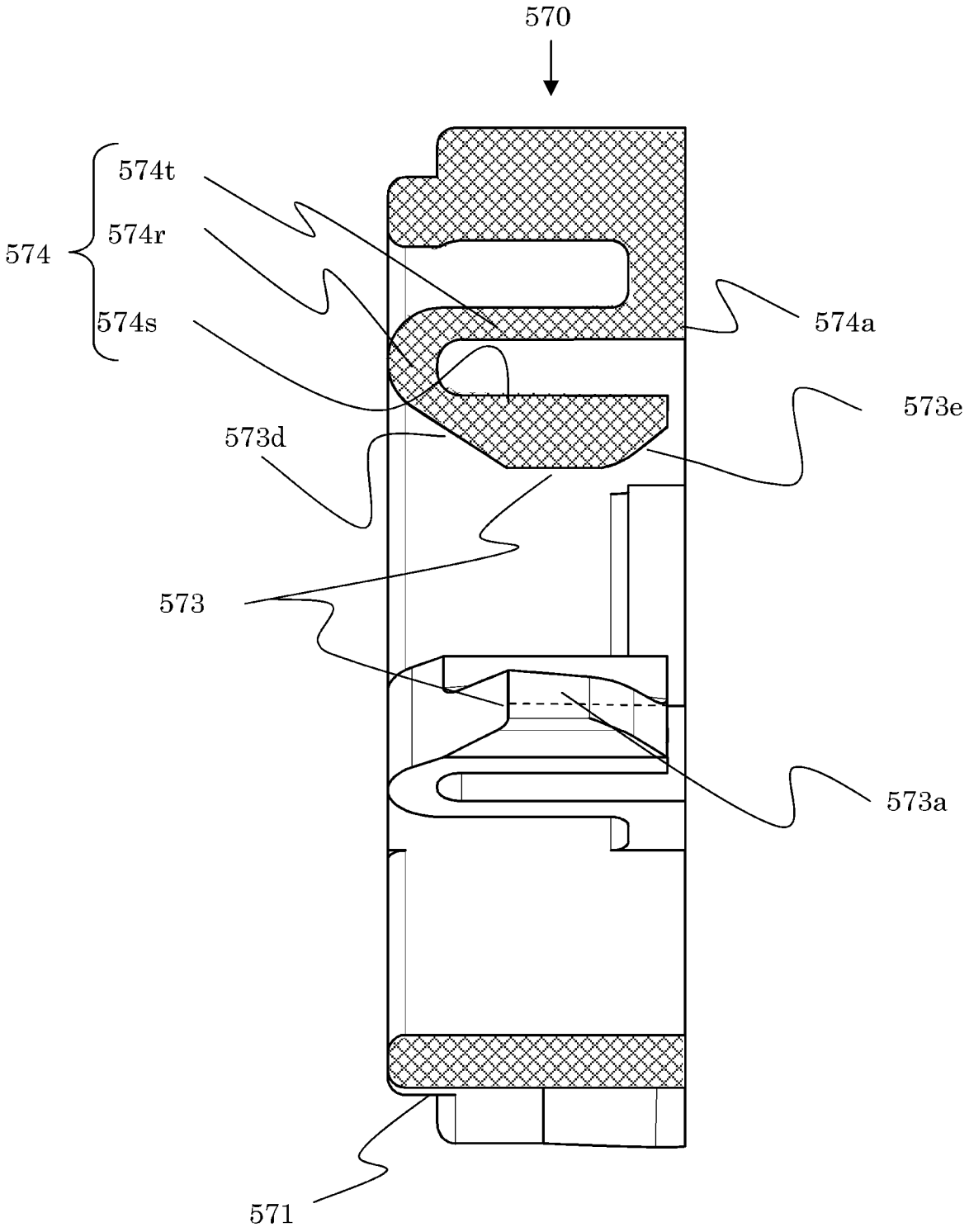

FIG. 53 is a view illustrating another embodiment of the cylindrical member 570 according to Embodiment 5.

Figure 54:
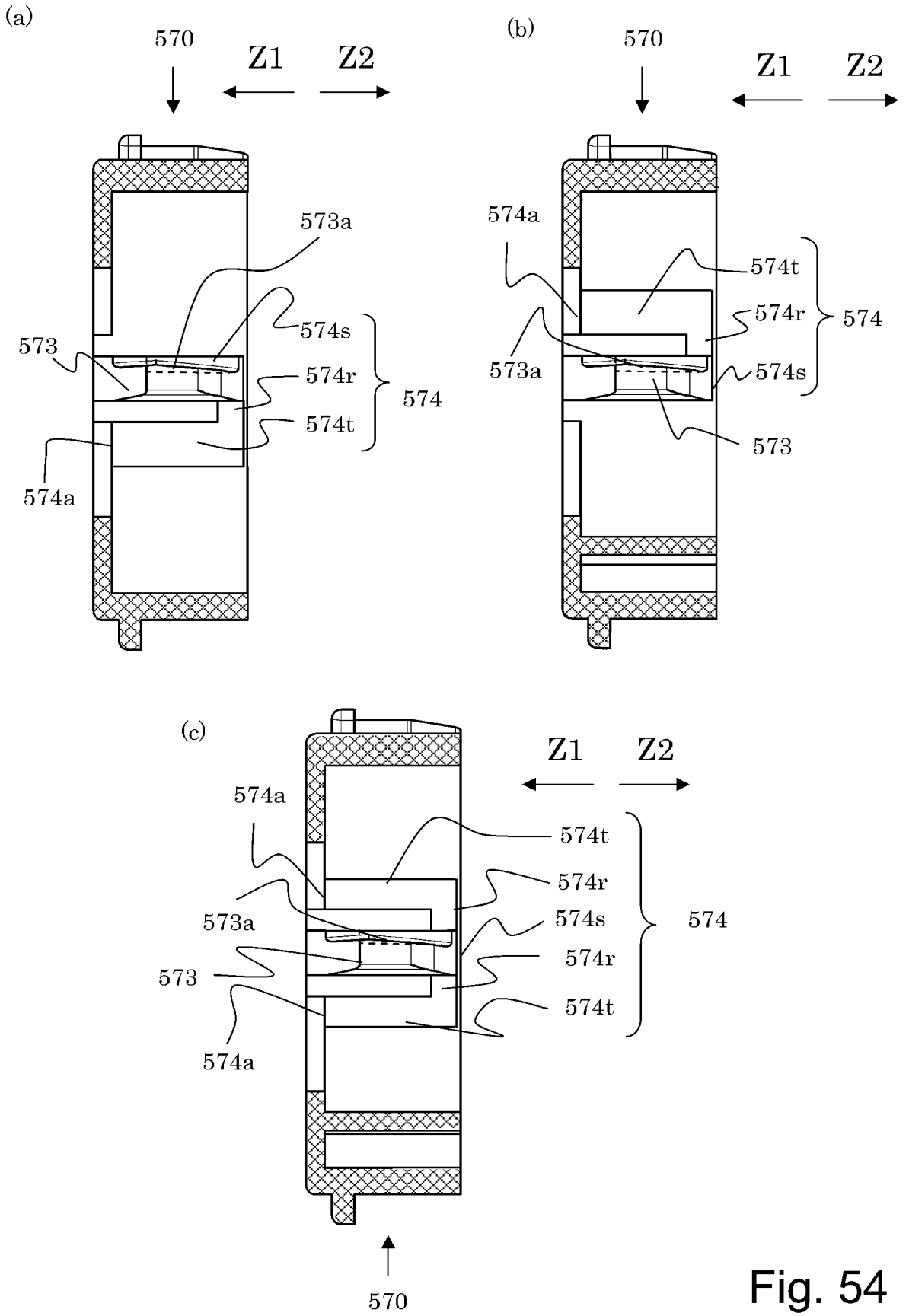

Parts (a), (b) and (c) of FIG. 54 are views illustrating the cylindrical member 570 according to Embodiment 5.

Figure 55:
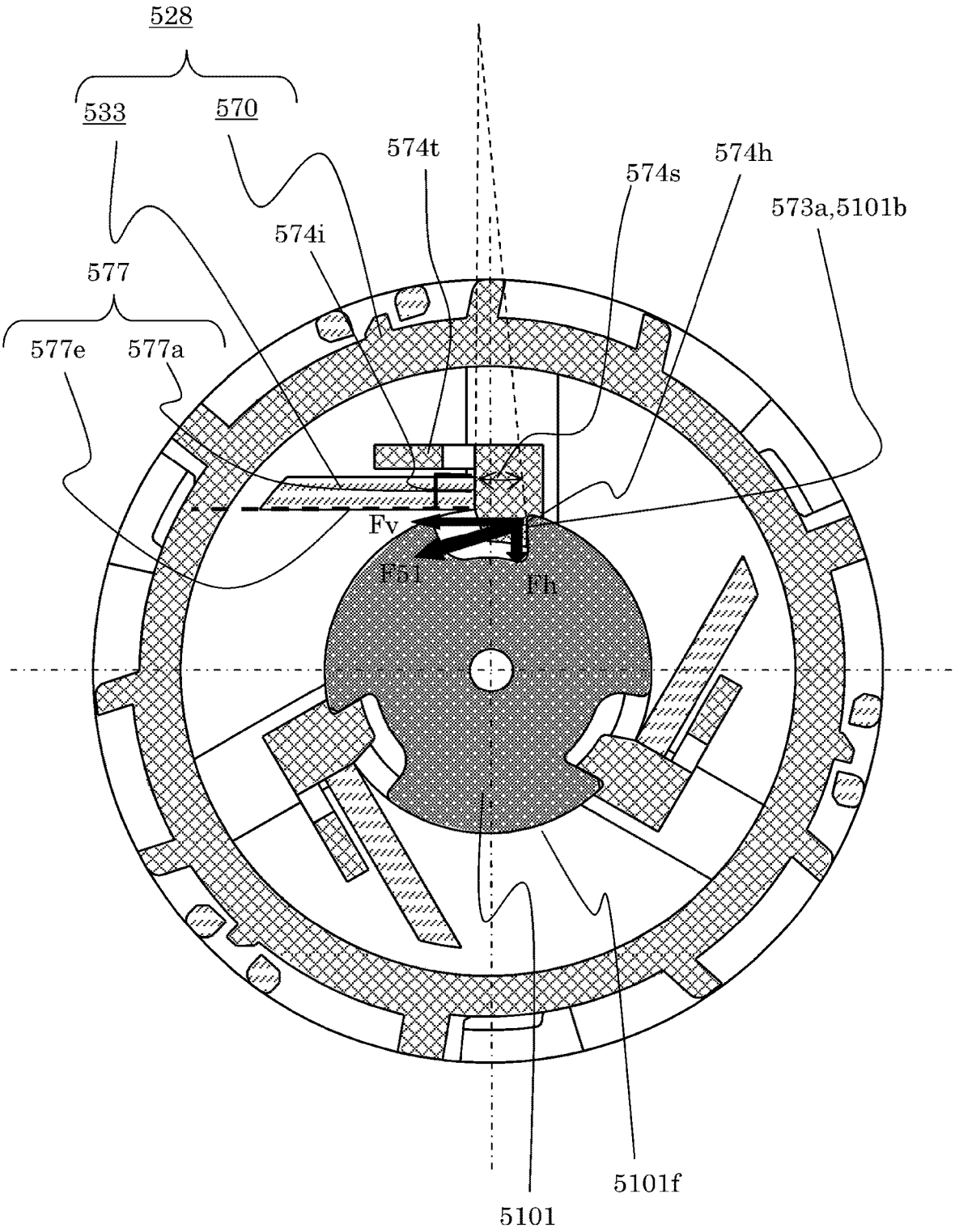

FIG. 55 is a view illustrating another example of the coupling member 528 according to Embodiment 5.

Figure 56:
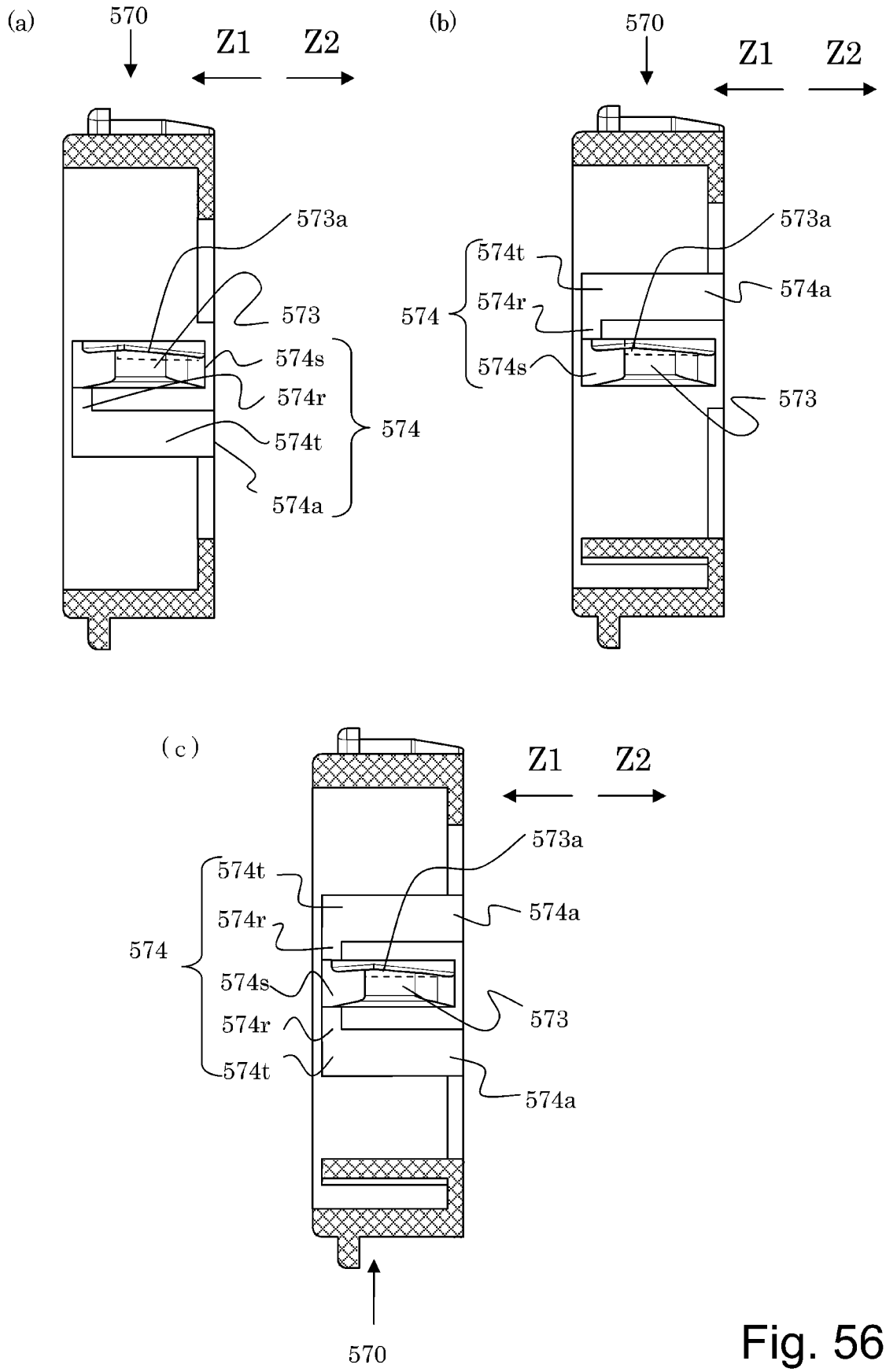

Parts (a), (b) and (c) of FIG. 56 are views illustrating another example of the cylindrical member 570 according to Embodiment 5.

Figure 57:
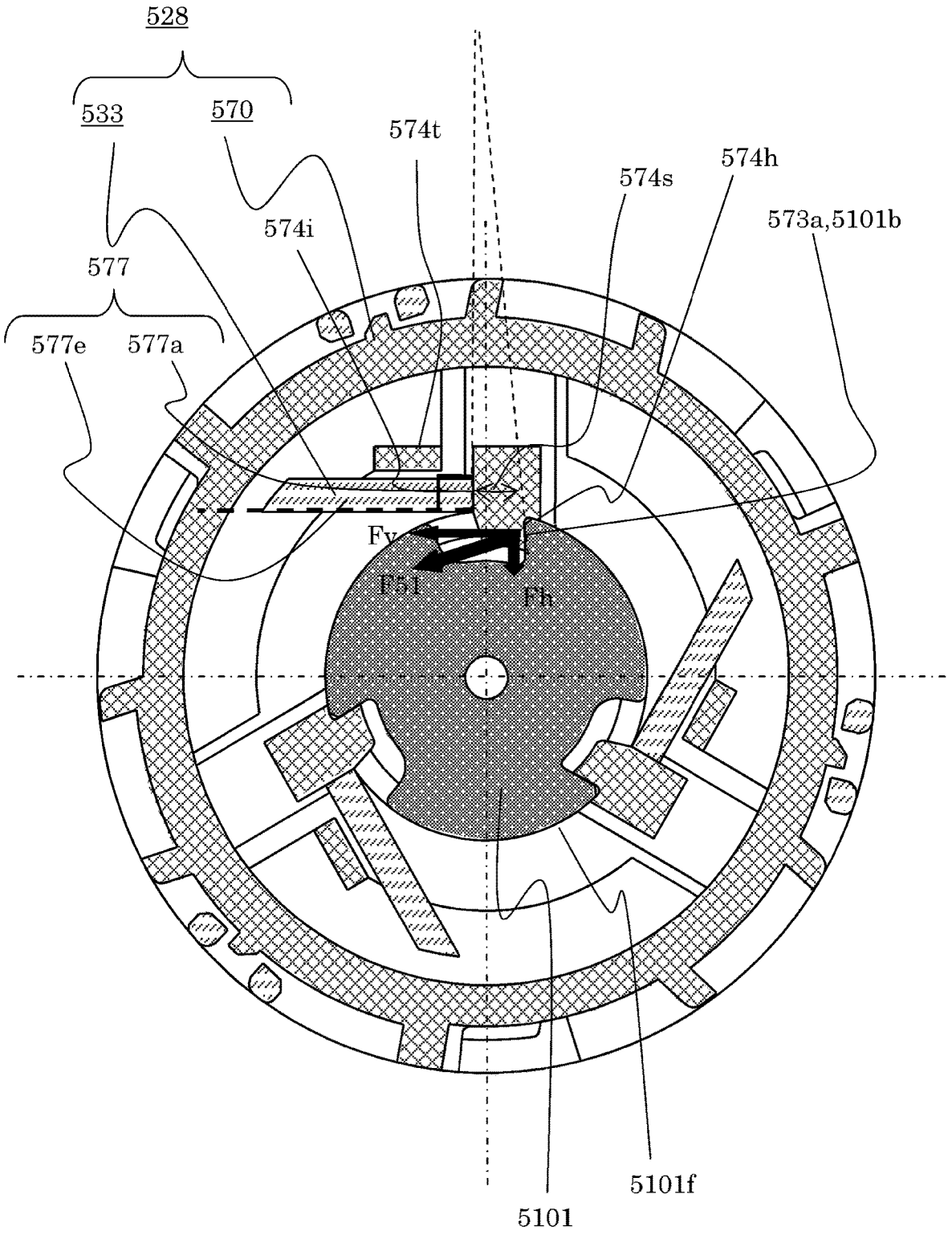

FIG. 57 is a view illustrating another example of the coupling member 528 according to Embodiment 5.

Figure 58:
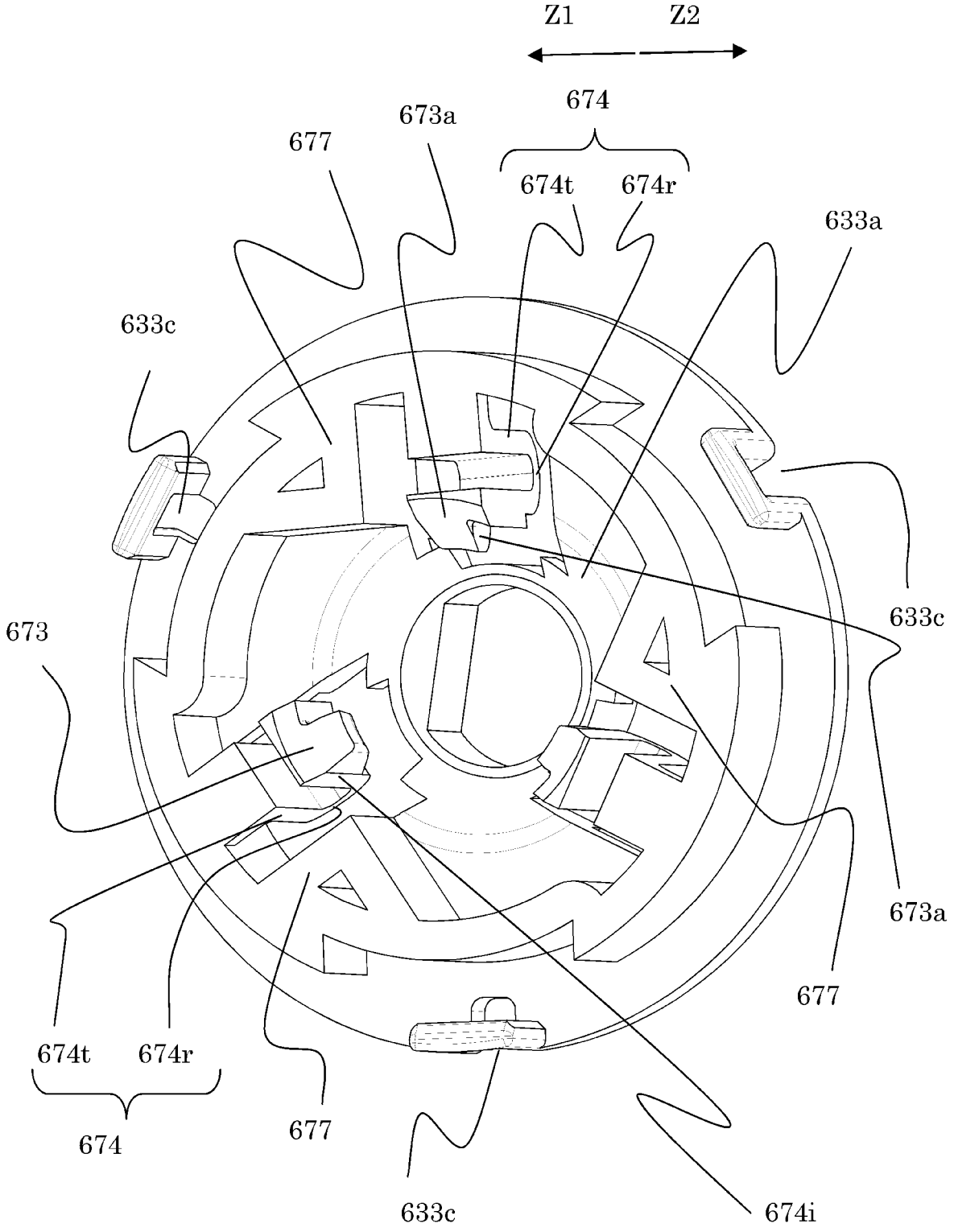

FIG. 58 is a perspective view of an aligning member 633 according to Embodiment 6.

Figure 59:
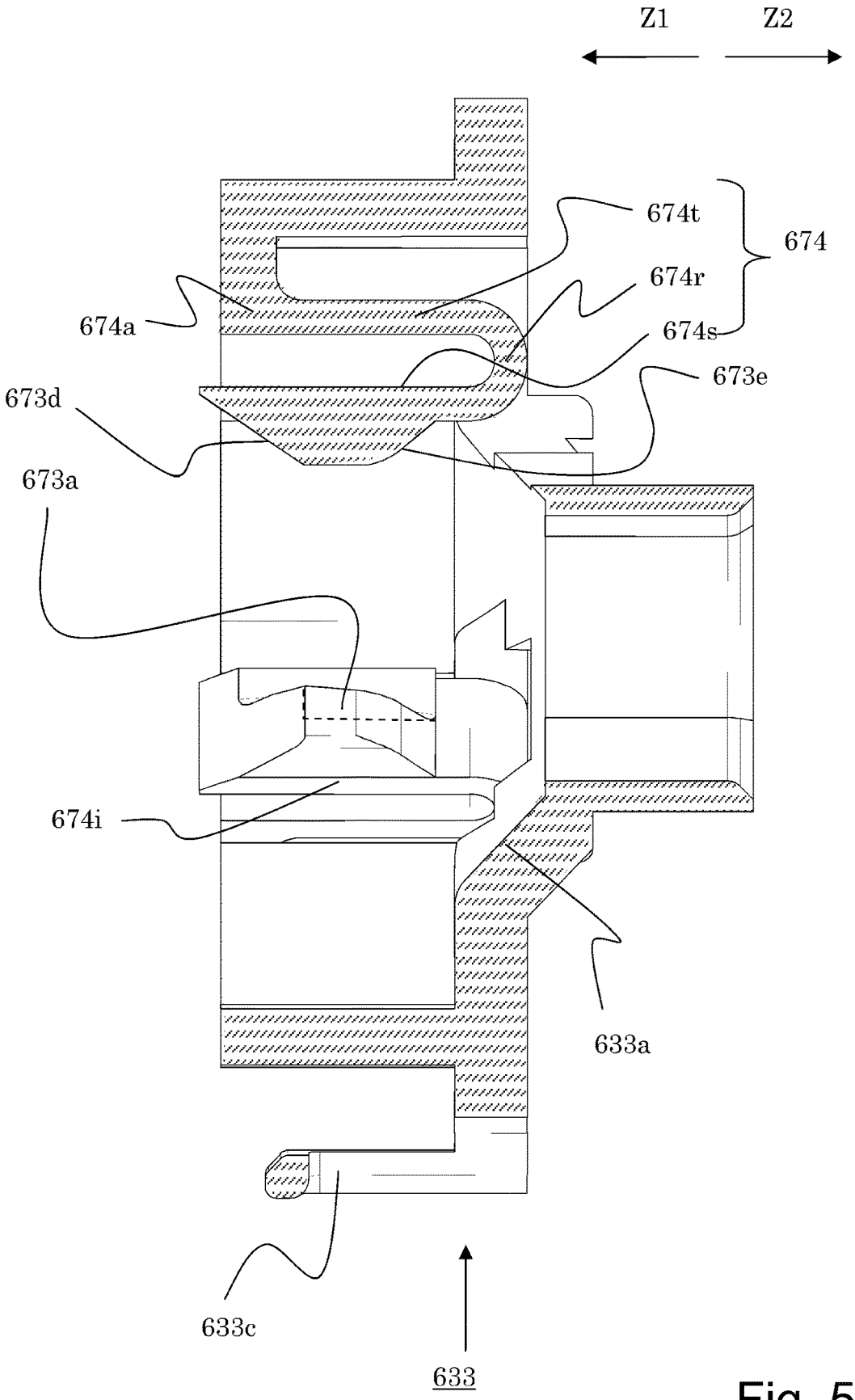

FIG. 59 is a cross-sectional view of the aligning member 633 according to Embodiment 6 taken along the rotation axis.

Figure 60:
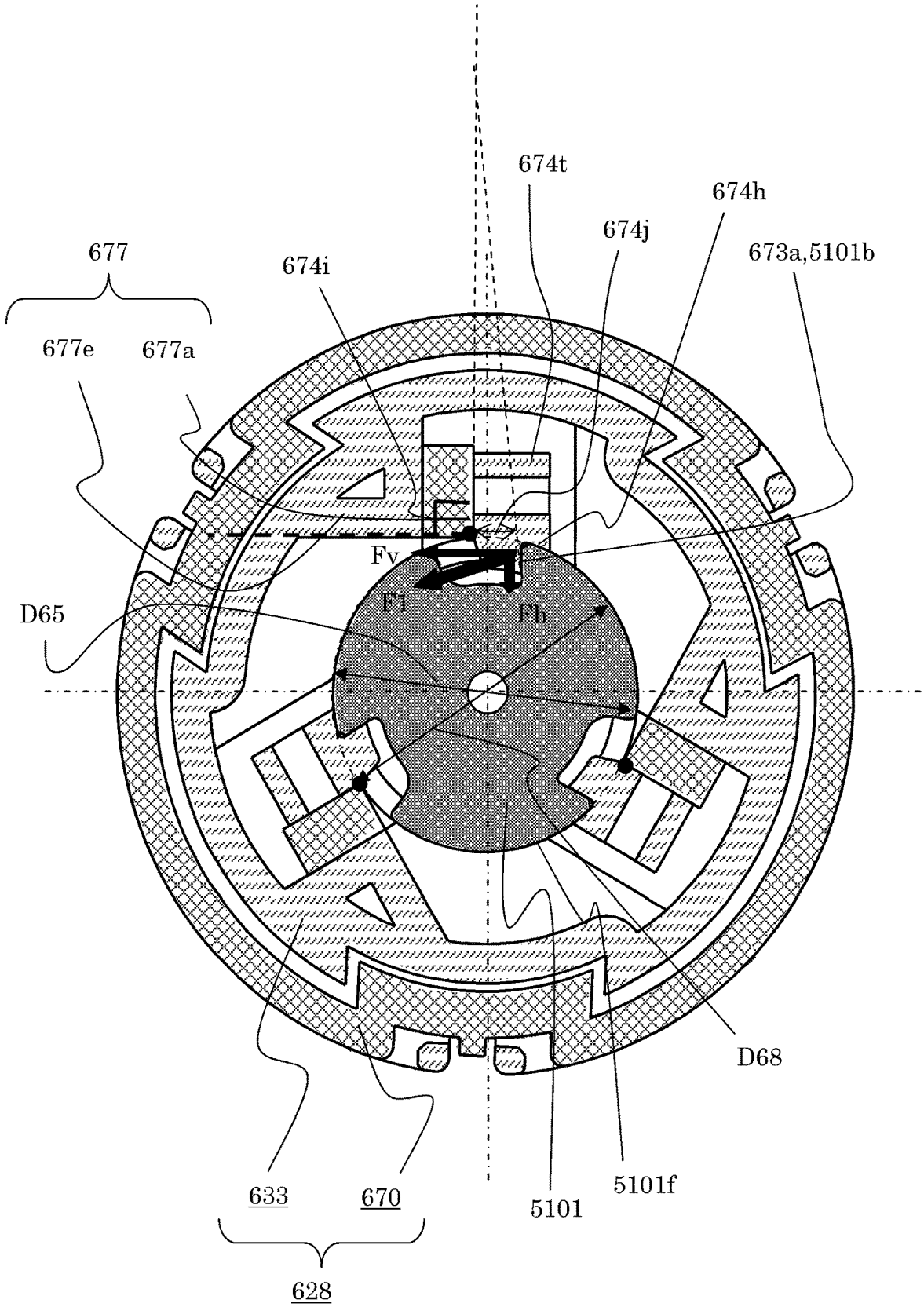

FIG. 60 is a cross-sectional view of a coupling member 628 according to Embodiment 6 taken along a plane perpendicular to the rotation axis and passing through the drive receiving surface 673*a*.

Figure 61:
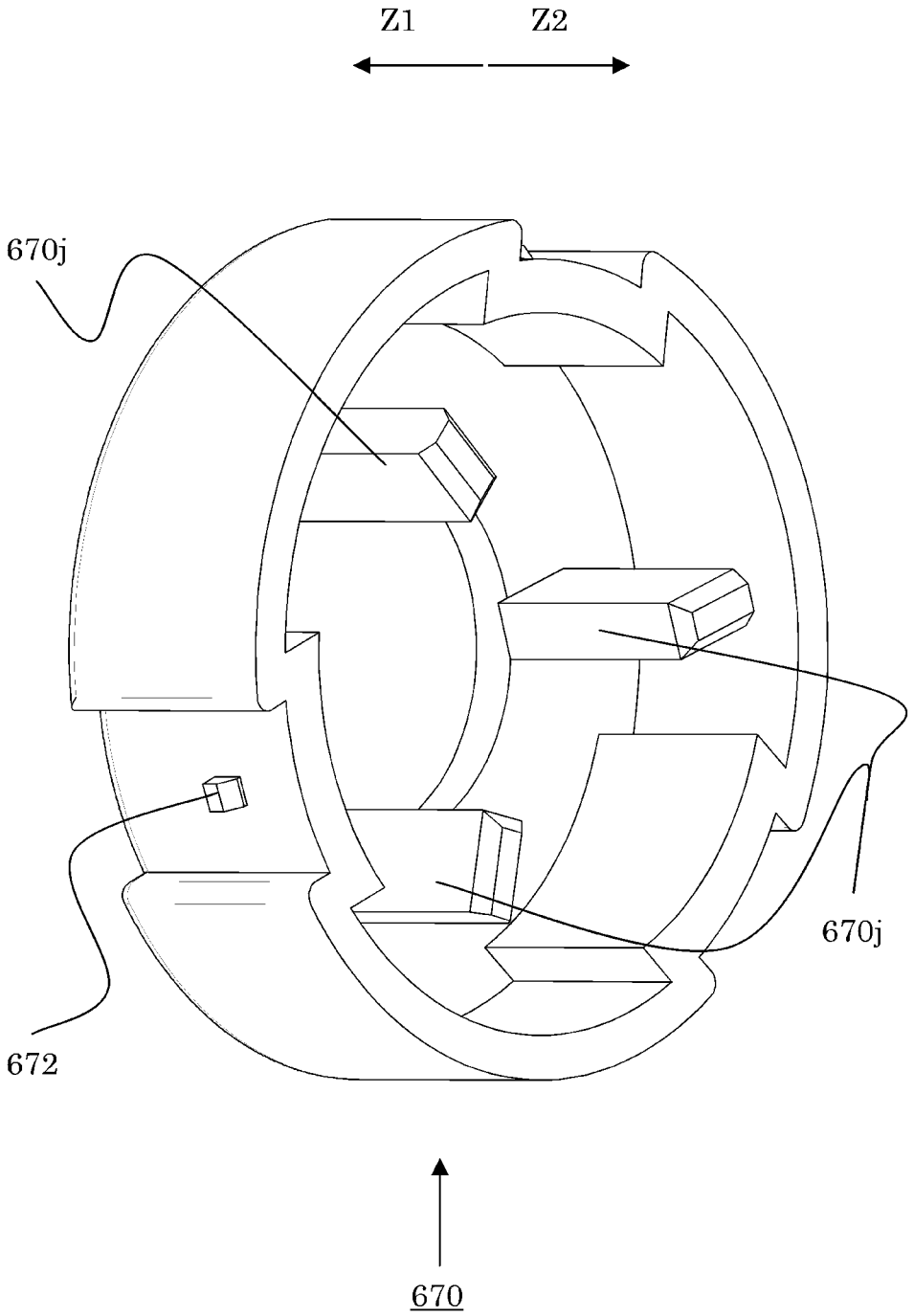

FIG. 61 is a perspective view of a cylindrical member 670 according to Embodiment 6.

Figure 62:
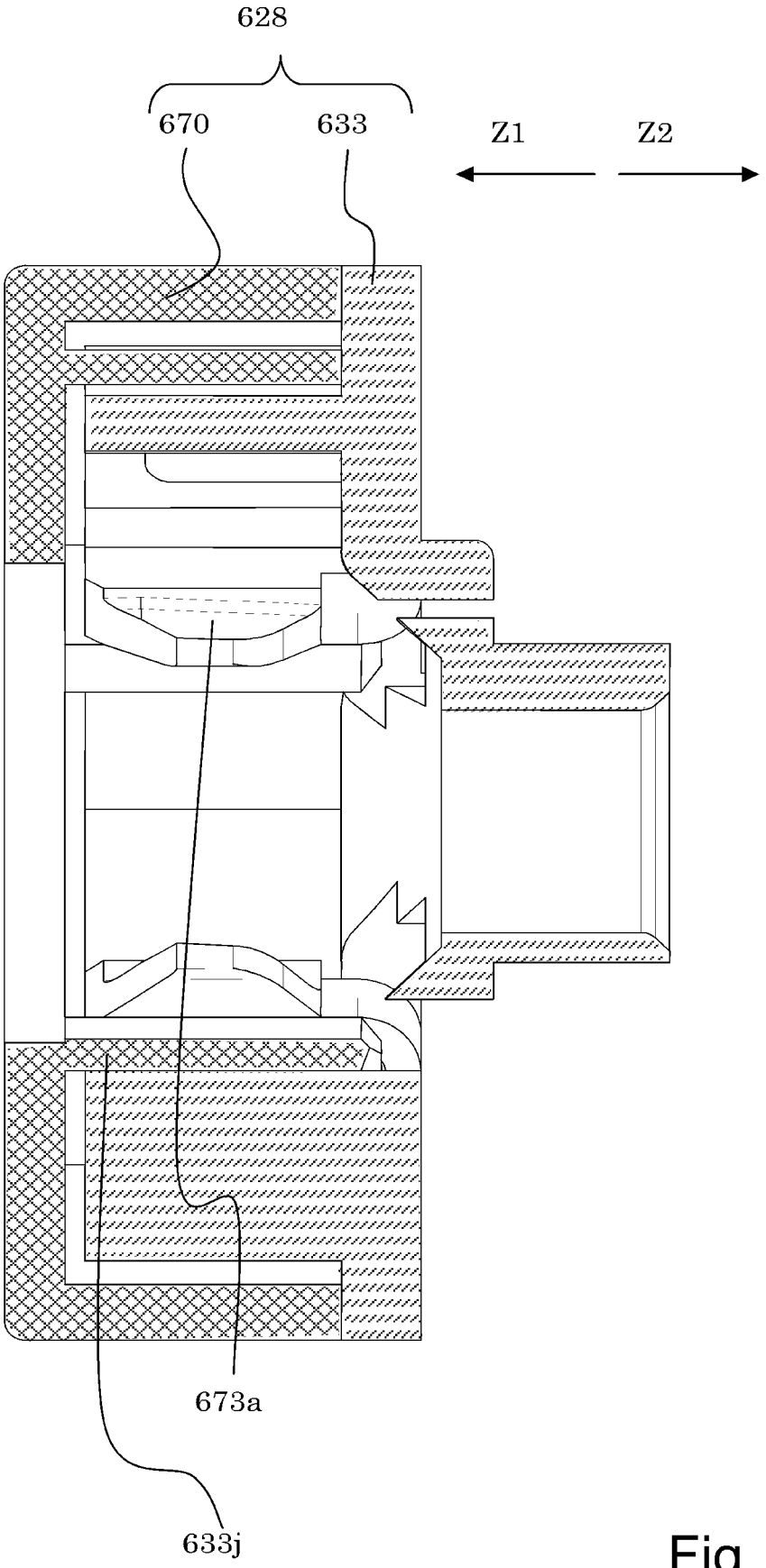

FIG. 62 is a cross-sectional view of the coupling member 628 according to Embodiment 6 taken along the rotation axis.

Figure 63:
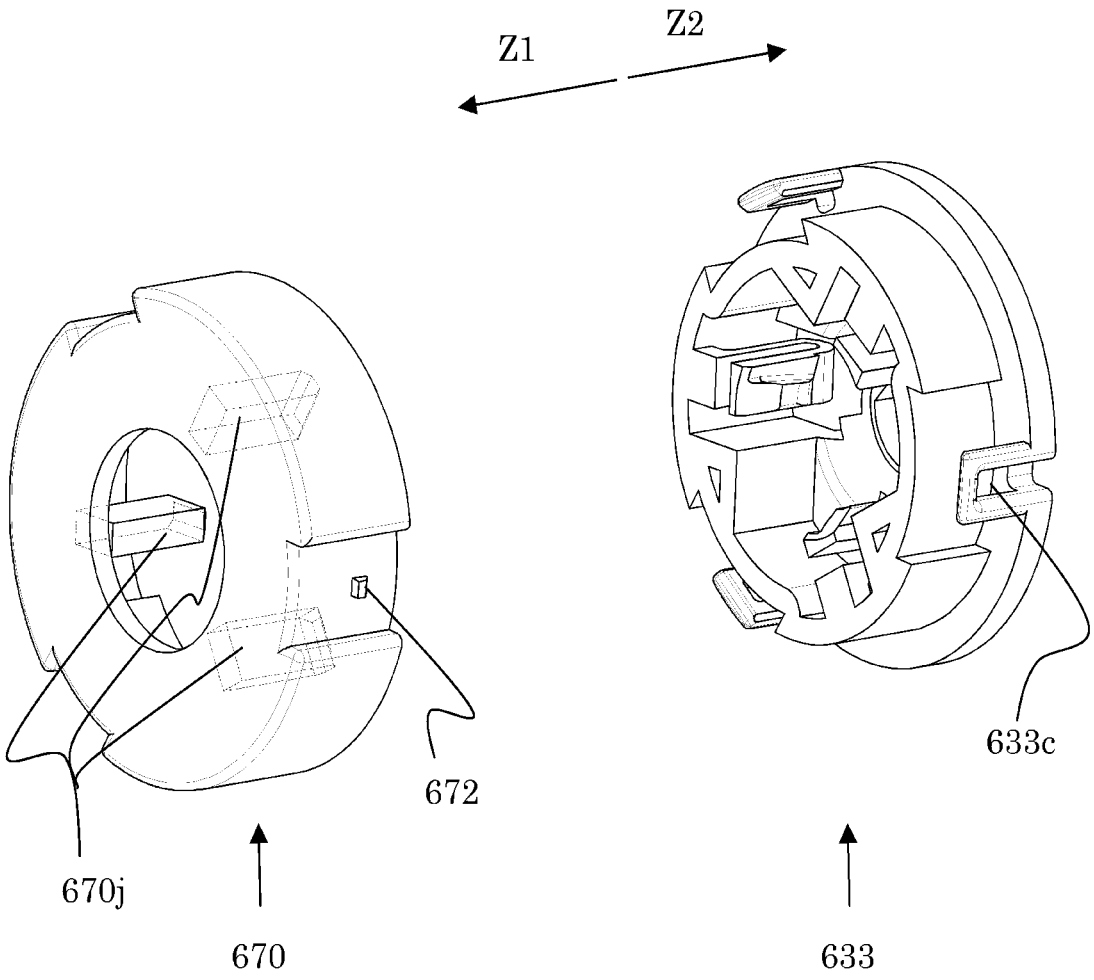

FIG. 63 is a view illustrating the assembling of the coupling member 628 according to Embodiment 6.

Figure 64:
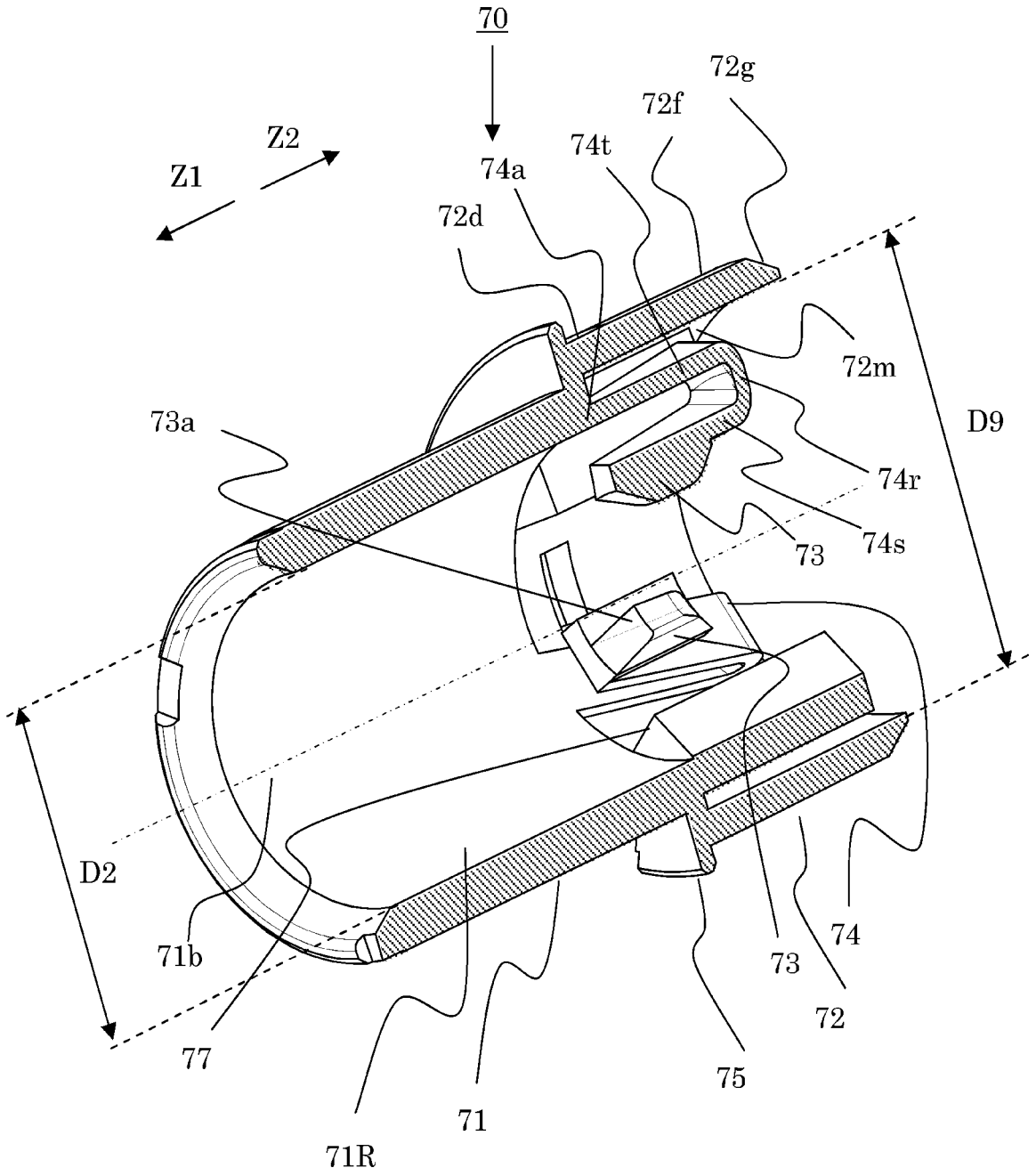

FIG. 64 is an illustration showing a modified example of Embodiment 1.

Figure 65:
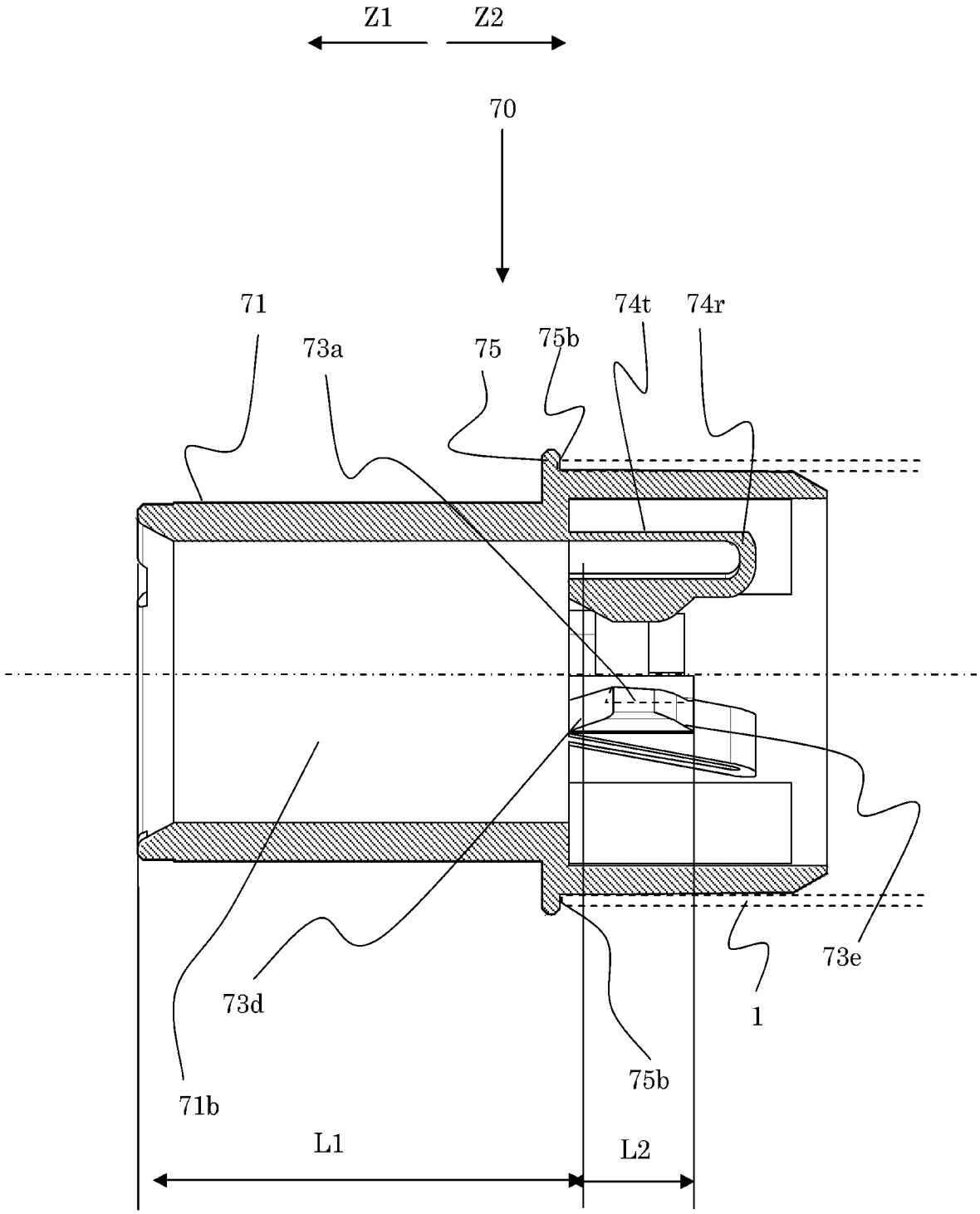

FIG. 65 is an illustration showing a modified example of Embodiment 1.

DESCRIPTION OF THE EMBODIMENTS

In the following, an image forming apparatus, a drum cartridge, and a developing cartridge according to and embodiment of the present invention will be described with reference to the accompanying drawings. Here, the image forming apparatus forms an image on a recording material by using an electrophotographic image forming process, for example. It includes electrophotographic copying machines, electrophotographic printers (for example, LED printers, laser beam printers and so on), electrophotographic facsimile machines, for example. The cartridge is mountable to and dismountable from the main assembly of the image forming apparatus (main assembly of the apparatus, main assembly of the image forming apparatus, main assembly of the electrophotographic image forming apparatus). In particular, a drum cartridge is a cartridge including a photosensitive drum. A developing cartridge is a cartridge including developing means and the like for developing a latent image formed on the photosensitive member. In this embodiment, each of the drum cartridge and the developing cartridge can be mounted to and dismounted from the image forming apparatus main assembly. In addition, a unit formed by integrating a photosensitive drum and a coupling member is called a drum unit. The drum unit is used for drum cartridges.

Here, in the following example, a full-color image forming apparatus in which four drum cartridges and four developing cartridges can be mounted and dismounted is taken. However, the numbers of drum cartridges and developing cartridges to be mounted in the image forming apparatus is not limited to this example. In addition, in the embodiment, a structure using two types of cartridges called a drum cartridge and a developing cartridge is exemplified, but the present invention is not limited to such an example. For example, the present invention is applicable to a process cartridge having integrated functions of drum cartridge and the developing cartridge. Similarly, the constituent elements disclosed in the embodiments are not intended to limit the disclosed material, arrangement, dimensions, other numerical values, and so on, unless otherwise specified. In addition, unless otherwise stated, "above" is based on the upward in the direction of gravity when the image forming apparatus is installed.

Embodiment 1

[Outline of Electrophotographic Image Forming Apparatus]

First, referring to FIG. 1, an overall structure of an embodiment of an electrophotographic image forming apparatus (image forming apparatus) according to this embodiment will be described.

Figure 1:
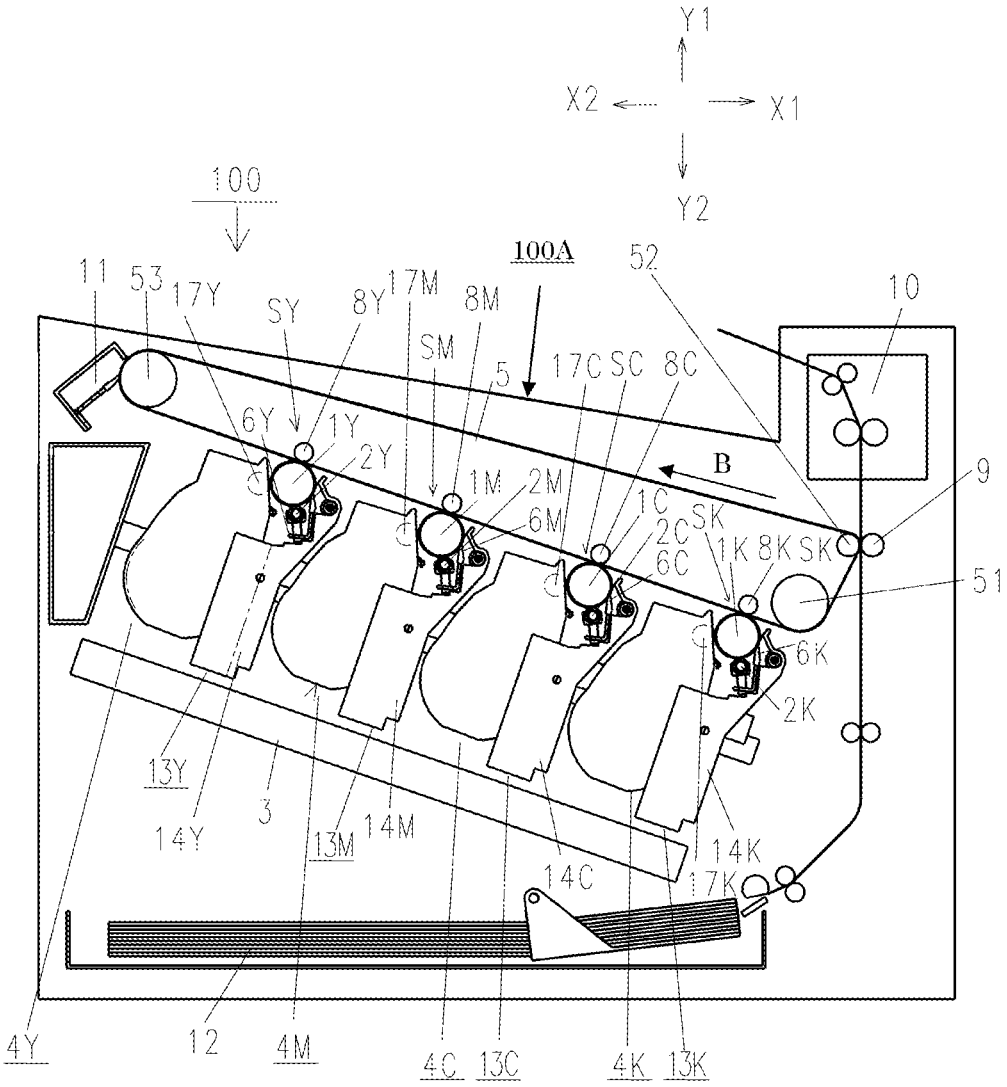
FIG. 1 is a schematic sectional view of an image forming apparatus 100.

FIG. 1 is a schematic sectional view of an image forming apparatus 100 according to this embodiment.

As shown in FIG. 1, the image forming apparatus 100 comprises, as image forming portions, first, second, third, and fourth image forming portions SY, SM, SC, and SK for forming images of colors of yellow (Y), magenta (M), cyan (C), and black (K), respectively. In this embodiment, the first to fourth image forming portions SY, SM, SC, SK are arranged on a line in a substantially horizontal direction.

Here, in this embodiment, the structures and operations of the drum cartridges 13 (13Y, 13M, 13C, 13K) are substantially the same, and the structures and operations of the developing cartridges 4 (4Y, 4M, 4C, 4K) are substantially the same, except that the colors of the images to be formed are different. Therefore, in the following, Y, M, C, K will be omitted and will be explained as are common for them, unless specific distinction is required.

In this embodiment, the image forming apparatus 100 has, as image bearing members, four cylinders (hereinafter referred to as photosensitive drums) 1 each including a photosensitive layer, and they are arranged side by side in a direction inclined slightly relative to the vertical direction. A scanner unit (exposure device) 3 is disposed below the drum cartridge 13 in the direction of gravity. In addition, around the photosensitive drum 1, a charging roller 2, and the like as process means (process device, process member) acting on the photosensitive layer are arranged.

The charging roller 2 is charging means (charging device, charging member) for uniformly charging the surface of the photosensitive drum 1. And, the scanner unit (exposure device) 3 is an exposure means (exposure device, exposure member) for forming an electrostatic image (electrostatic latent image) on the photosensitive drum 1 by irradiating a laser beam in accordance with image information. Around the photosensitive drum 1, a developing cartridge 4 and a cleaning blade 6 as cleaning means (cleaning device, cleaning member) is provided.

An intermediary transfer belt 5 as an intermediary transfer member for transferring the toner image from the photosensitive drum 1 to a recording material (sheet, recording material) 12 is provided facing the four photosensitive drums 1.

The developing cartridge 4 of this embodiment uses a contact developing system in which a non-magnetic one-component developer (hereinafter referred to as a toner) is used as a developer and a developing roller 17 as a developer carrying member is in contact with the photosensitive drum 1.

Figure 7:
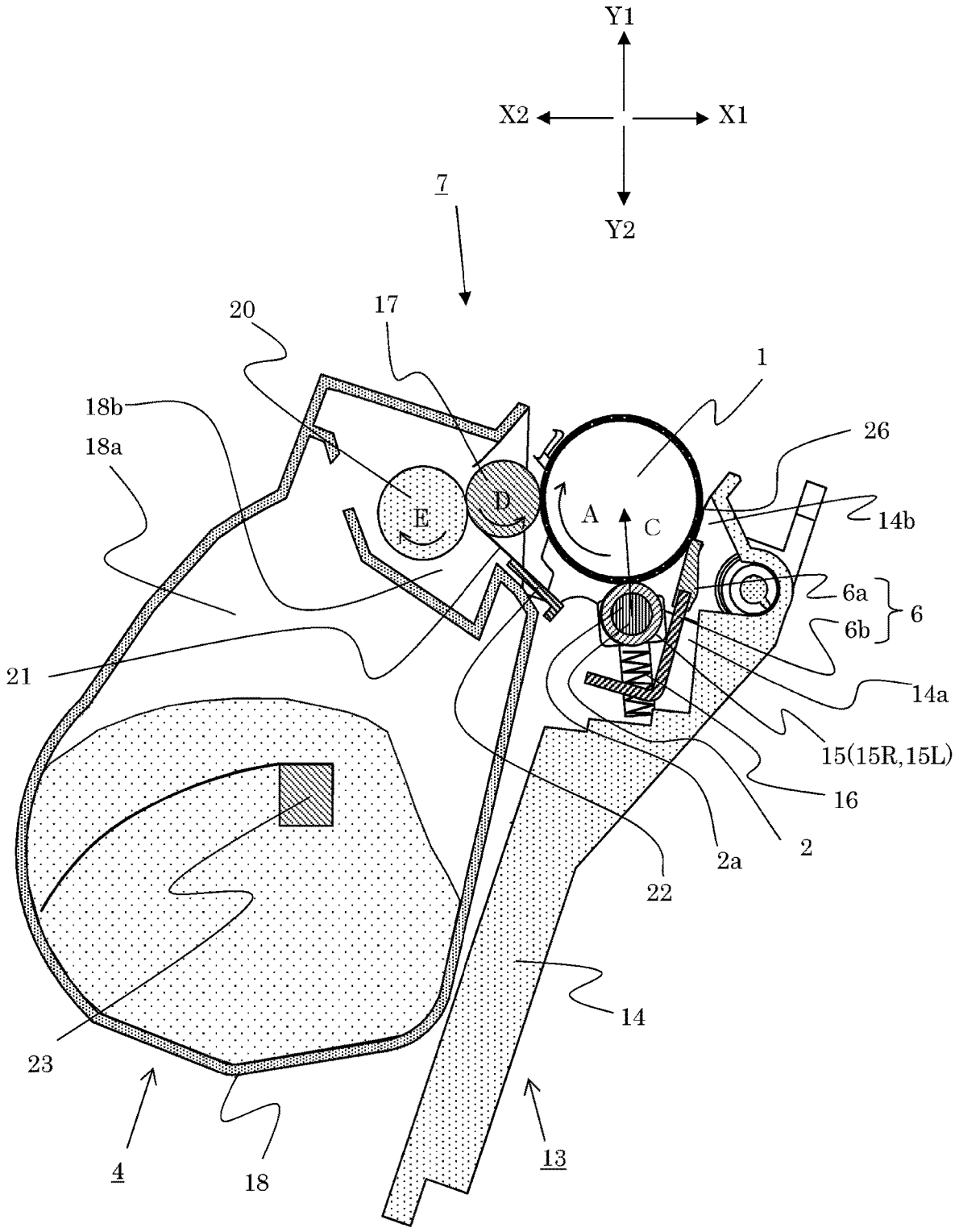
FIG. 7 is a sectional view of a drum cartridge 13 and the developing cartridge 4.

In the above-described structure, the toner image formed on the photosensitive drum 1 is transferred onto the sheet (paper) 12, and the toner image transferred onto the sheet is fixed. In addition, the drum cartridge 13 is provided with the charging roller 2 for charging the photosensitive drum 1 and the cleaning blade 6 for removing the toner remaining not transferred onto the photosensitive drum 1, as a process means acting on the photosensitive drum 1. The untransferred residual toner remaining on the photosensitive drum 1 not transferred onto the sheet 12 is collected by the cleaning blade 6. In addition, the untransferred residual toner collected by the cleaning blade 6 is accommodated into the removed developer accommodating portion (hereinafter referred to as a waste toner accommodating portion) 14*a* through the opening 14*b* (FIG. 7). The waste toner container 14*a* (FIG. 7) and the cleaning blade 6 are integrated into a cleaning unit (photosensitive unit, image bearing member unit) 13.

In addition, the image forming apparatus 100A includes a guide (positioning means) such as a mounting guide and a positioning member (not shown) in the main assembly frame. The developing cartridge 4 and the drum cartridge 13 are guided by these guides and can be mounted to and dismounted from the image forming apparatus main assembly 100A.

The toners of yellow (Y), magenta (M), cyan (C), and black (K) are accommodated in the developing cartridges 4 for the respective colors.

The intermediary transfer belt 5 rotates (moves) in the direction of arrow B in FIG. 1 in contact with photoconductive drum 1 included in each process cartridge. The intermediary transfer belt 5 is extended around supporting members (driving roller 51, secondary transfer opposing roller 52, driven roller 53). In the inner peripheral side of the intermediary transfer belt 5, four primary transfer rollers 8 as primary transfer means are juxtaposed opposed to the photosensitive drum 1, respectively. In addition, at the position facing the secondary transfer opposed roller 52 on the outer peripheral surface side of the intermediary transfer belt 5, a secondary transfer roller 9 as secondary transfer means is provided.

During image forming operation, first, the surface of the photosensitive drum 1 is uniformly charged by the charging roller 2. Then, the charged surface of the photosensitive drum 1 is scanned by and exposed to a laser beam corresponding to the image information emitted from a scanner unit 3. By this, an electrostatic latent image corresponding to the image information is formed on the photosensitive drum 1. The electrostatic latent image formed on the photosensitive drum 1 is developed into a toner image (developer image) by the developing roller 17 (FIG. 3) of the developing cartridge 4. The toner image formed on the photosensitive drum 1 is transferred (primary transfer) onto the intermediary transfer belt 5 by the function of the primary transfer roller 8.

For example, in the case of forming full-color images, the above-described process is sequentially performed in the four drum cartridges 13 (13Y, 13M, 13C, 13K) and the developing cartridges 4 (4Y, 4M, 4C, 4K). And, the toner images of the respective colors formed on the photosensitive drums 1 of the drum cartridges 13 are sequentially primarily transferred onto the intermediary transfer belt 5. Thereafter, in synchronization with the movement of the intermediary transfer belt 5, the recording material 12 is fed to the secondary transfer portion. And, the four-color toner images on the intermediary transfer belt 5 are transferred all together onto the recording material 12 fed to the secondary transfer portion, by the intermediary transfer belt 5 and the secondary transfer roller 9.

The recording material 12 onto which the toner image has been transferred is fed to a fixing device 10 as fixing means. In the fixing device 10, by applying heat and pressure to the recording material 12, the toner image is fixed on the recording material 12. In addition, the primary untransferred residual toner remaining on the photosensitive drum 1 after the primary transferring process is removed by the cleaning blade 6 and collected as waste toner. In addition, the secondary untransferred residual toner remaining on the intermediary transfer belt 5 after the secondary transfer step is removed by the intermediary transfer belt cleaning device 11.

Here, the image forming apparatus 100 can also form monochromatic or multicolor images using desired single or some (not all) of image forming units.

[Outline of Process Means]

Referring to FIGS. 2, 3, 4, and 7, the outline of the drum cartridge 13 and the developing cartridge 4 mountable to the image forming apparatus main assembly 100A of this embodiment will be described.

Here, the drum cartridge 13Y, the drum cartridge 13M, the drum cartridge 13C and the drum cartridge 13K have the same structures. In addition, the developing cartridge 4Y containing the yellow toner, the developing cartridge 4M containing the magenta toner, the developing cartridge 4C containing the cyan toner and the developing cartridge 4K containing the black toner have the same structures. Therefore, in the explanation below, the drum cartridges 13Y, 13M, 13C, 13K are commonly referred to as a drum cartridge 13, and the developing cartridges 4Y, 4M, 4C, 4K will be commonly referred to as the developing cartridge 4. The components of each cartridge are also generically referred to in the same way.

Figure 2:
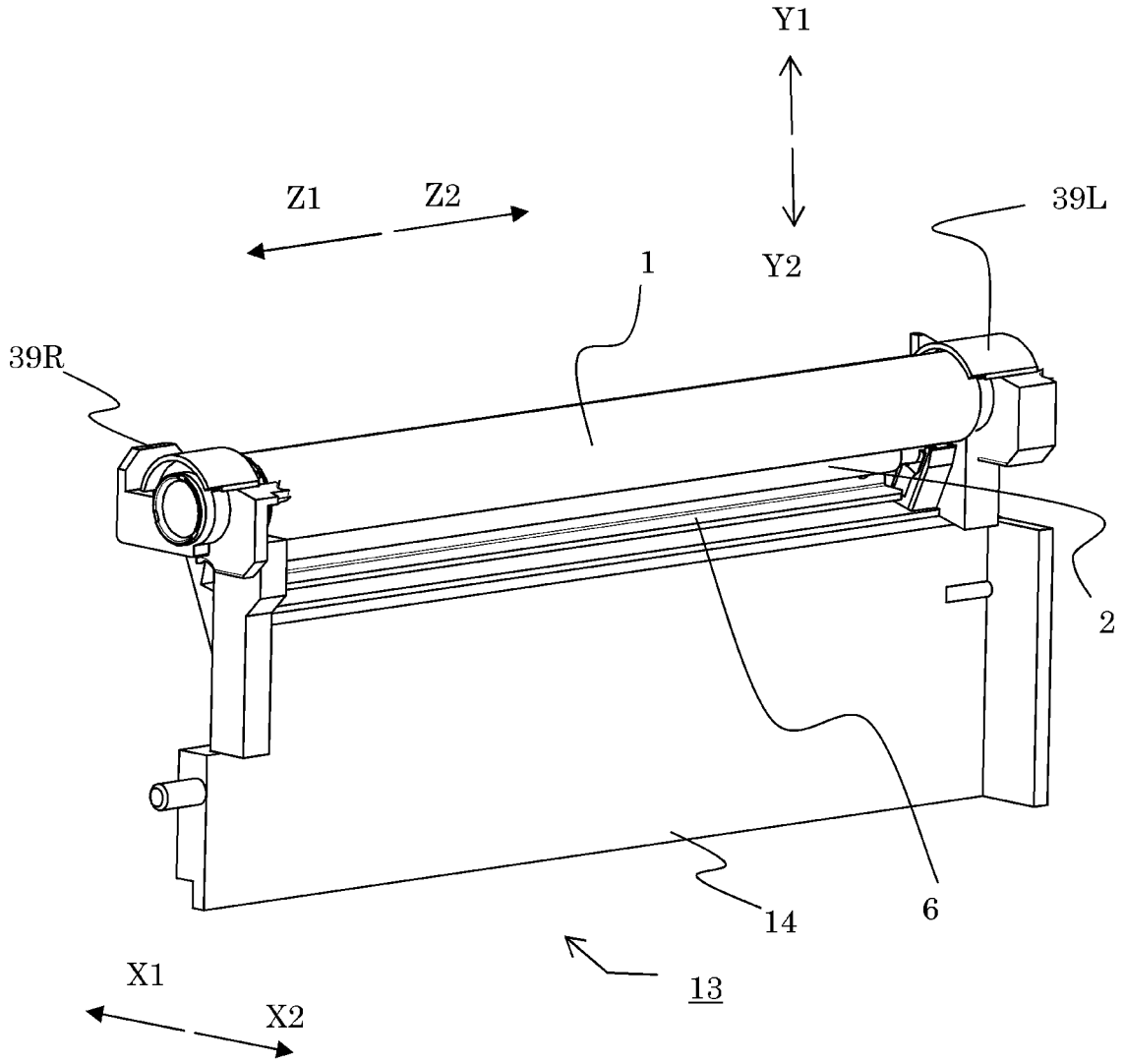
FIG. 2 is an external perspective view of a drum cartridge 13.

FIG. 2 is an external perspective view of the drum cartridge 13. Here, as shown in FIG. 2, the direction of the rotation axis of the photosensitive drum 1 is Z direction (arrow Z1, arrow Z2), the horizontal direction in FIG. 1 is X direction (arrow X1, arrow X2), the vertical direction is Y direction (arrow Y1, arrow Y2).

The drum cartridge 13 has a cleaning frame 14 as a frame for supporting various elements in the drum cartridge 13. The photosensitive drum 1 is rotatably supported by the cleaning frame 14.

Here, the photosensitive drum 1 is a rotatable member (image bearing member) constituted to carry an image (toner image, developer image) formed with toner (developer) on its surface.

Figure 4:
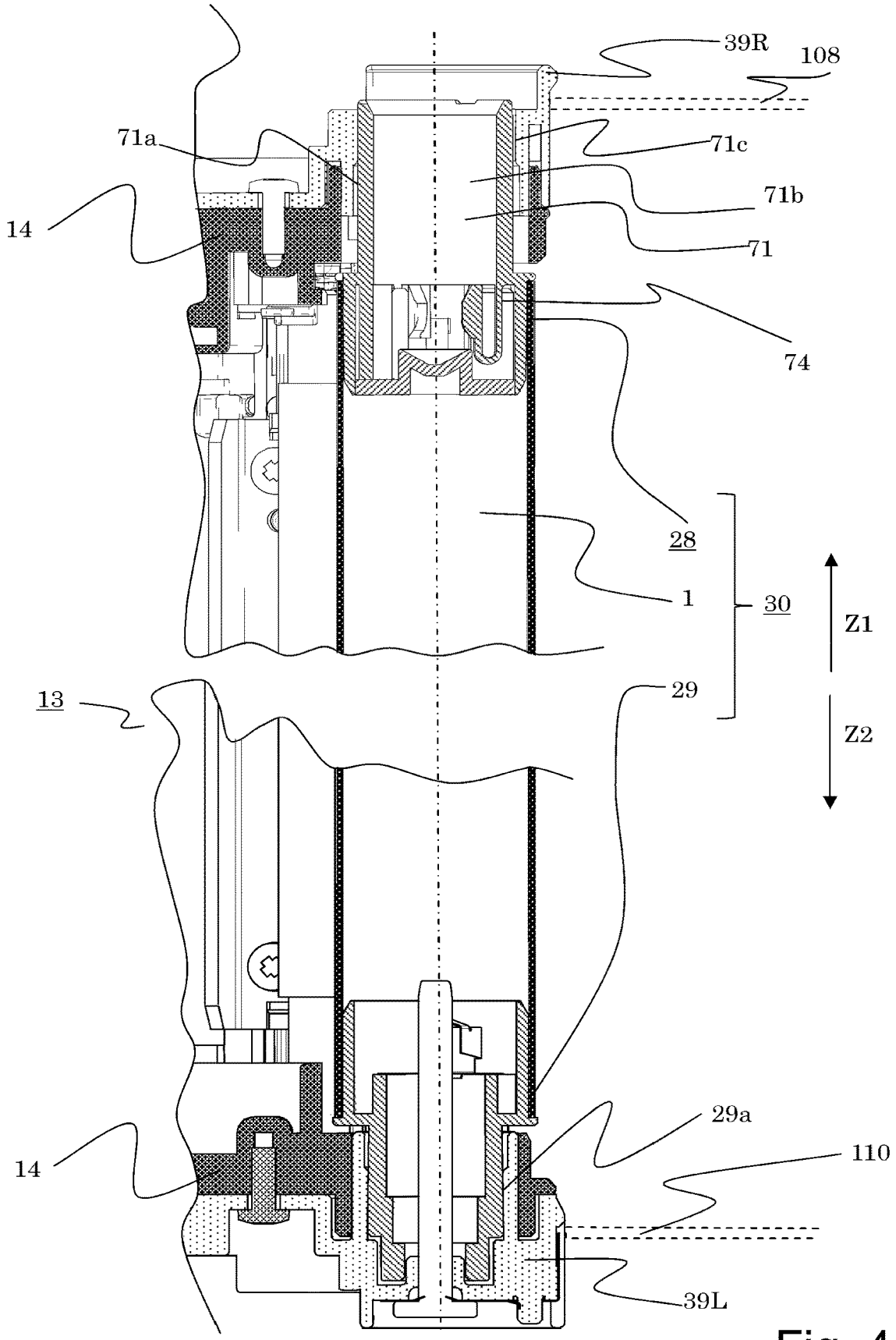
FIG. 4 is a cross-sectional view taken along an imaginary plane including a rotation center of a photosensitive drum 1 of the drum cartridge 13.

FIG. 4 is a cross-sectional view of the drum cartridge 13 taken along a plane including the rotation center of the photosensitive drum 1. Here, the side (downstream side in a Z1 direction) at which a coupling member 28 receives the driving force from the image forming apparatus main assembly with respect to the axial direction of the photosensitive drum 1 is called a driving side (rear side) of the drum cartridge 13. On the side opposite the drive side in the axial direction (downstream side in Z2 direction) is referred to as the non-driving side (front side) of the drum cartridge 13.

When the drum cartridge 13 is mounted in the apparatus main assembly, the driving side of the drum cartridge 13 is on the downstream side in the cartridge mounting direction, and the non-driving side is on the upstream side in the mounting direction. In other words, in a state in which the drum cartridge 13 is disposed inside the apparatus main assembly, the driving side of the drum cartridge 13 is on the rear side of the printer, and the non-driving side of the drum cartridge 13 is in the front side of the printer.

Here, the axial direction of the photosensitive drum 1 is a direction parallel to the axis (rotation axis) of the photosensitive drum 1. The axis of the photosensitive drum 1 is an imaginary straight line extending so as to pass through the rotation center of the photosensitive drum 1, and in FIG. 4, it is a broken line passing through the center of the photosensitive drum 1. At the end opposite to the coupling member 28 (the end on the non-driving side of the process cartridge), an electrode (electrode portion) contacting the inner surface of the photosensitive drum 1 is provided, and this electrode functions as a ground by contacting the image forming apparatus main assembly.

A coupling member 28 is mounted to one end of the photosensitive drum 1 and a non-driving side flange member 29 is mounted to the other end of the photosensitive drum 1, thereby forming a photosensitive drum unit (also simply referred to as a drum unit) 30. The photosensitive drum unit 30 obtains the driving force from the main assembly driving shaft 101 provided in the image forming apparatus main assembly 100A by way of the coupling member 28.

The coupling member 28 is a flange member (driving side flange member) mounted to the driving side end portion of the photosensitive drum 1. The coupling member 28 can be engaged with the main assembly driving shaft 101 as the cartridge 7 is mounted to the apparatus main assembly 100A. The coupling member 28 can be dismounted from the main assembly driving shaft 101 as the cartridge 7 is removed from the apparatus main assembly 100A.

Here, the photosensitive drum 1, the coupling member 28 and the non-driving side flange member 29 provided in the drum unit 30 are coaxially arranged. These axes of rotation (axes) are the same as the axis of rotation of the drum unit 30. Therefore, the axis and the axial direction of the drum unit 30 are the same as the axes and the axial directions of the photosensitive drum 1, the coupling member 28, and the non-driving side flange member 29.

As shown in FIG. 4, the Z1 side of the coupling member 28 has a cylindrical shape (cylindrical portion 71). The portion, on the Z1 side, of the cylindrical portion 71 is the supported portion 71*c*. The supported portion 71*c* is rotatably supported by a drum unit bearing member 39R. That is, the supported portion 71*c* is supported by the bearing portion of the drum unit bearing member 39R, by which the photosensitive drum unit 30 is rotatably supported.

Similarly, the non-driving side flange member 29 provided on the non-driving side of the photosensitive drum unit 30 is rotatably supported by the bearing portion of the drum unit bearing member 39L. The non-driving side flange member 29 has a cylindrical portion (cylindrical portion) projecting from the end portion of the photosensitive drum 1, and an outer peripheral surface 29*a* of the cylindrical portion is rotatably supported by the drum unit bearing member 39L. The outer peripheral surface 29*a* is a non-driven side supported portion.

Here, the drum unit bearing member 39R is disposed on the drive side of the drum cartridge 13, and the drum unit bearing member 39L is disposed on the non-driving side of the drum cartridge 13.

When the drum cartridge 13 is mounted to the apparatus main assembly 100A, the drum unit bearing member 39R abuts to a rear side cartridge positioning portion 108 provided in the image forming apparatus main assembly 100A, as shown in FIG. 4. In addition, the drum unit bearing member 39L abuts against the front side cartridge positioning portion 110 of the image forming apparatus main assembly 100A. By this, the cartridge 7 is positioned in the image forming apparatus 100A.

In the Z direction of this example, the position where the drum unit bearing member 39R supports the supported portion 71*c* is placed at a position close to the position where the drum unit bearing member 39R is positioned at the rear side cartridge positioning portion 108. By doing so, it is possible to suppress inclination of the coupling member 28 when the drum cartridge 13 is mounted in the apparatus main assembly 100A.

A bearing receiving portion 71*c* is disposed so that the position where the bearing member 39R supports the supported portion 71*c* and the position where the bearing member 39R is positioned at the rear side cartridge positioning portion 108 can be brought close to each other. That is, the bearings 71*c* are arranged on the free end side (the Z1 direction side) of the outer peripheral surface 71*a* of the cylindrical portion 71 provided on the coupling member 28.

Similarly, in the Z direction, the position at which the drum unit bearing member 39L rotatably supports the non-driving side flange member 29 is made close to the position at which the drum unit bearing member 39L is positioned at the front side cartridge positioning portion 110. By this, the tilting of the non-driving side flange member 29 is suppressed.

Drum unit bearing members 39R and 39L are mounted at both sides of the cleaning frame 14, respectively to support the photosensitive drum unit 30. By this, the photosensitive drum unit 30 is rotatably supported by the cleaning frame 14.

In addition, a charging roller 2 and a cleaning blade 6 are mounted in the cleaning frame 14, and they are arranged so as to be in contact with the surface of the photosensitive drum 1. In addition, the charging roller bearing 15 (15R, 15L) (FIG. 7) is mounted in the cleaning frame 14. The charging roller bearing 15 is a bearing for supporting a shaft of the charging roller 2.

FIG. 7 is a sectional view of the drum cartridge 13 and the developing cartridge 4.

Here, the charging roller bearing 15 (15R, 15L) is mounted so as to be movable in the direction of the arrow C in FIG. 7. The rotating shaft 2*a* of the charging roller 2 is rotatably mounted to the charging roller bearing 15 (15R, 15L). And, the charging roller bearing 15 is urged toward the photosensitive drum 1 by the pressing spring 16 as urging means. By this, the charging roller 2 contacts the photosensitive drum 1 and is rotationally driven by the photosensitive drum 1.

The cleaning frame 14 is provided with a cleaning blade 6 as a cleaning means for removing the toner remaining on the surface of the photosensitive drum 1. The cleaning blade 6 integrally includes a blade-like rubber (elastic member) 6*a* which contacts the photosensitive drum 1 to remove toner on the photosensitive drum 1 and a supporting metal plate 6*b* which supports the blade-like rubber (elastic member) 6*a*. In this example, the supporting sheet metal 6*b* is fixed to the cleaning frame 14 with screws.

As described in the foregoing, the cleaning frame 14 is provided with an opening 14*b* for collecting the untransferred residual toner recovered by the cleaning blade 6. In the opening 14*b*, a blowout prevention sheet 26 which is in contact with the photosensitive drum 1 and seals between the photosensitive drum 1 and the opening 14*b* is provided, thereby preventing leakage of toner upward of the opening 14*b*.

Figure 3:
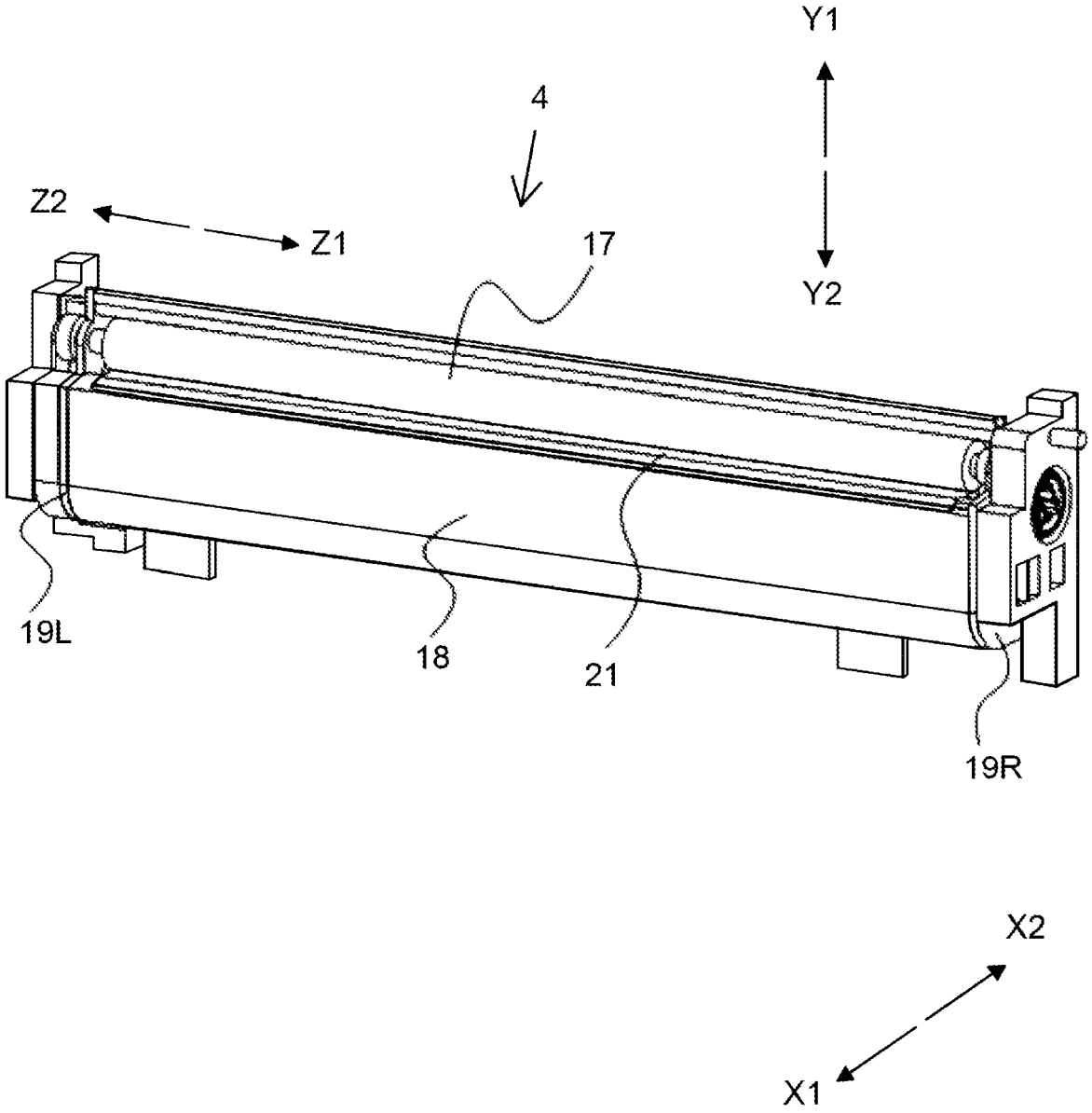
FIG. 3 is an external perspective view of a developing cartridge 4.

FIG. 3 is an external perspective view of the developing cartridge 4.

The developing cartridge 4 includes a developing frame 18 for supporting various elements. The developing cartridge 4 is provided with a developing roller 17 as a developer carrying member which contacts the photosensitive drum 1 and rotates in the direction of the arrow D (counterclockwise direction) shown in FIG. 7. The developing roller 17 is a rotating member (developing member) for carrying the developer to be supplied to the photosensitive drum 1 on the surface thereof. The latent image on the photosensitive drum 1 is developed with the toner supplied from the developing roller 17 to the photosensitive drum 1.

The developing roller 17 is rotatably supported in the developing frame 18 by the development bearings 19 (19R, 19L) at the respective end portions in the longitudinal direction (rotational axis direction) thereof. Here, the development bearing 19 (19R, 19L) is mounted to each side portion of the developing frame 18.

In addition, as shown in FIG. 7, the developing cartridge 4 includes a developer accommodating chamber (hereinafter referred to as a toner accommodating chamber) 18*a* and a developing chamber 18*b* in which the developing roller 17 is provided.

In the developing chamber 18*b*, there are provided a toner supply roller 20 as a developer supply member which contacts the developing roller 17 and rotates in a direction of an arrow E, a developing blade 21 functioning as a developer regulating member for regulating the toner layer of the developing roller 17.

The supply roller (supply member) 20 is also a rotatable member rotating, and on the surface thereof, a developer (toner) is carried, similarly to the developing roller, it is a developer carrying member. The toner carried on the surface of the supply roller 20 is supplied to the developing roller 17.

The developing blade 21 is integrally fixed to the fixing member 22 by welding or the like.

In addition, in the toner accommodating chamber 18*a* of the developing frame 18, there is provided a stirring member 23 for stirring the contained toner and for transporting the toner to the toner supply roller 20.

As described above, by employing a structure in which the elements relating to image formation are integrated in the drum cartridge 13 and the developing cartridge 4 dismountably mountable to the apparatus main assembly maintenance easiness is improved. In other words, maintenance of the apparatus can be easily carried out by the user dismounting the drum cartridge 13 and the developing cartridge 4 from and to the apparatus main assembly 100A. Therefore, it is possible to provide a device that can easily perform maintenance not by a serviceman but by a user.

Here, in this example, the drum cartridge 13 and the developing cartridge 4 are independently mounted to the apparatus main assembly 100A. However, the drum cartridge 13 and the developing cartridge 4 for forming images of the same color may be constituted as one unit. In this case, the unitized cartridge (process cartridge) is mounted and dismounted relative to the main assembly of the apparatus.

[Structure of Main Assembly Driving Shaft]

Referring to FIGS. 5, 6, 8, 9, and 10, the structure of the main assembly driving shaft 101 will be described.

Figure 5:
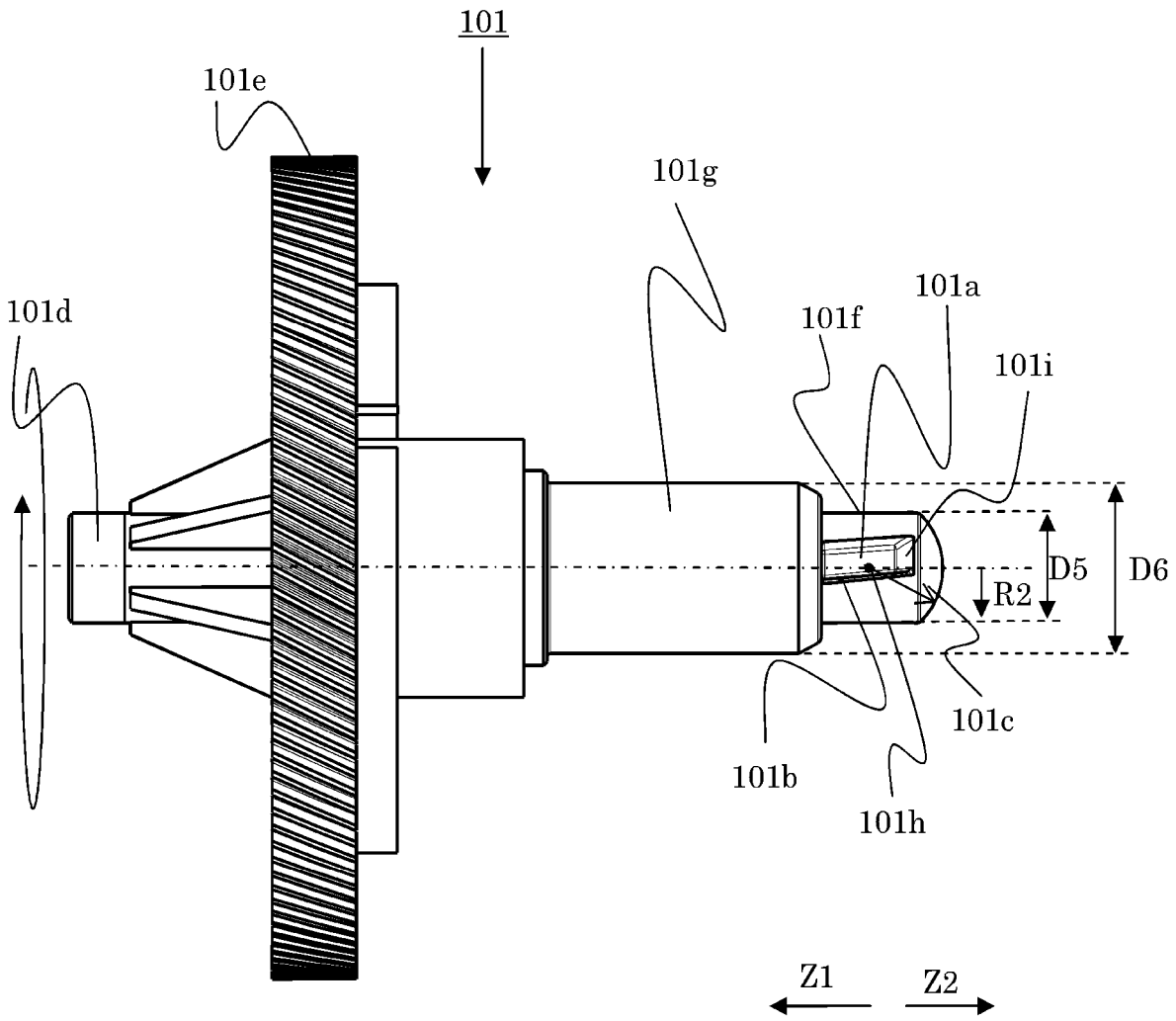
FIG. 5 is an external view of a driving shaft of a main assembly of the apparatus.

FIG. 5 is an external view of the main assembly driving shaft.

Figure 6:
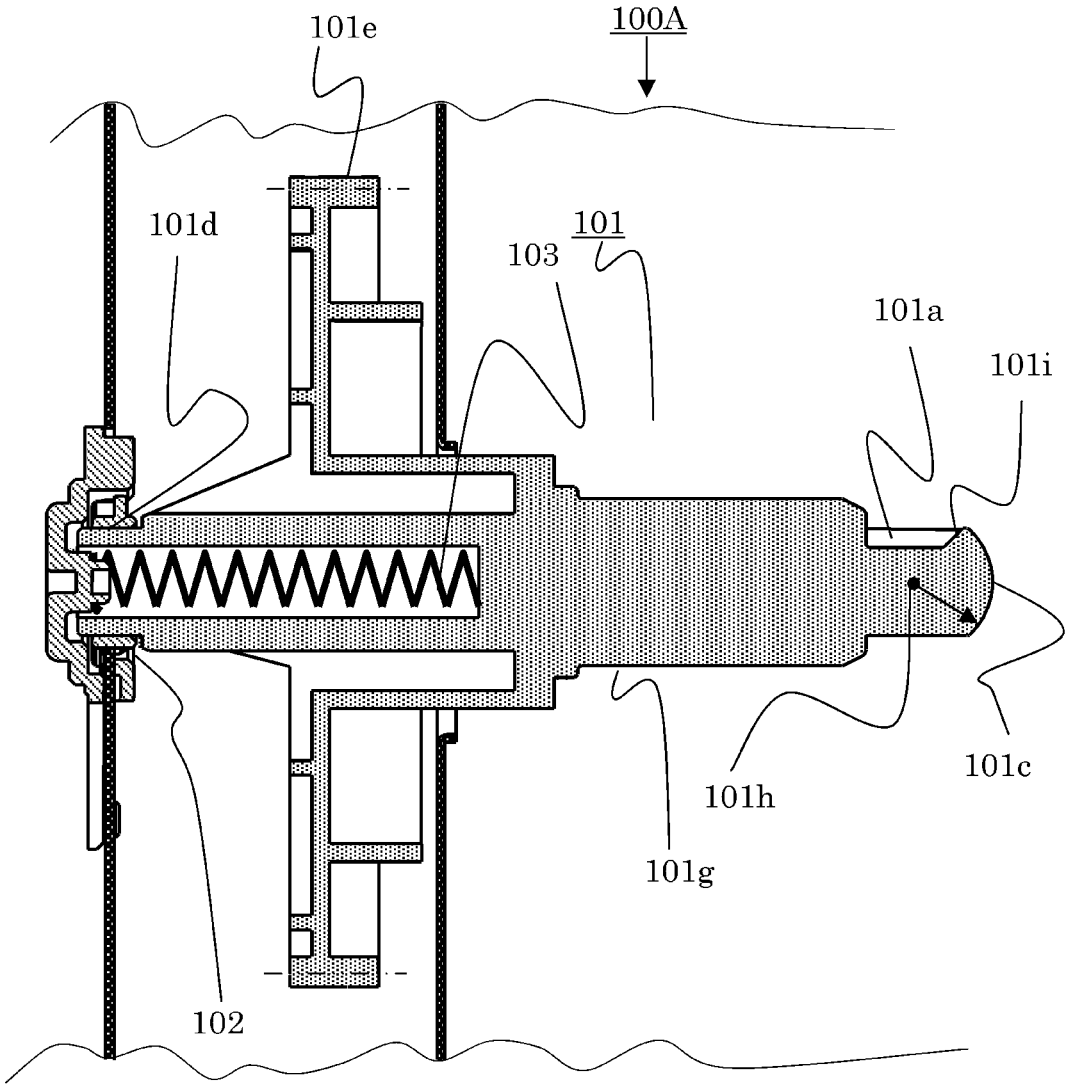
FIG. 6 is a cross-sectional view of a main assembly driving shaft 101 mounted to the image forming apparatus main assembly, taken along a rotational axis center (center of rotation axis).

FIG. 6 is a cross-sectional view taken along the rotation axis (rotation axis) of the main assembly driving shaft 101 mounted to the image forming apparatus main assembly.

Figure 8:
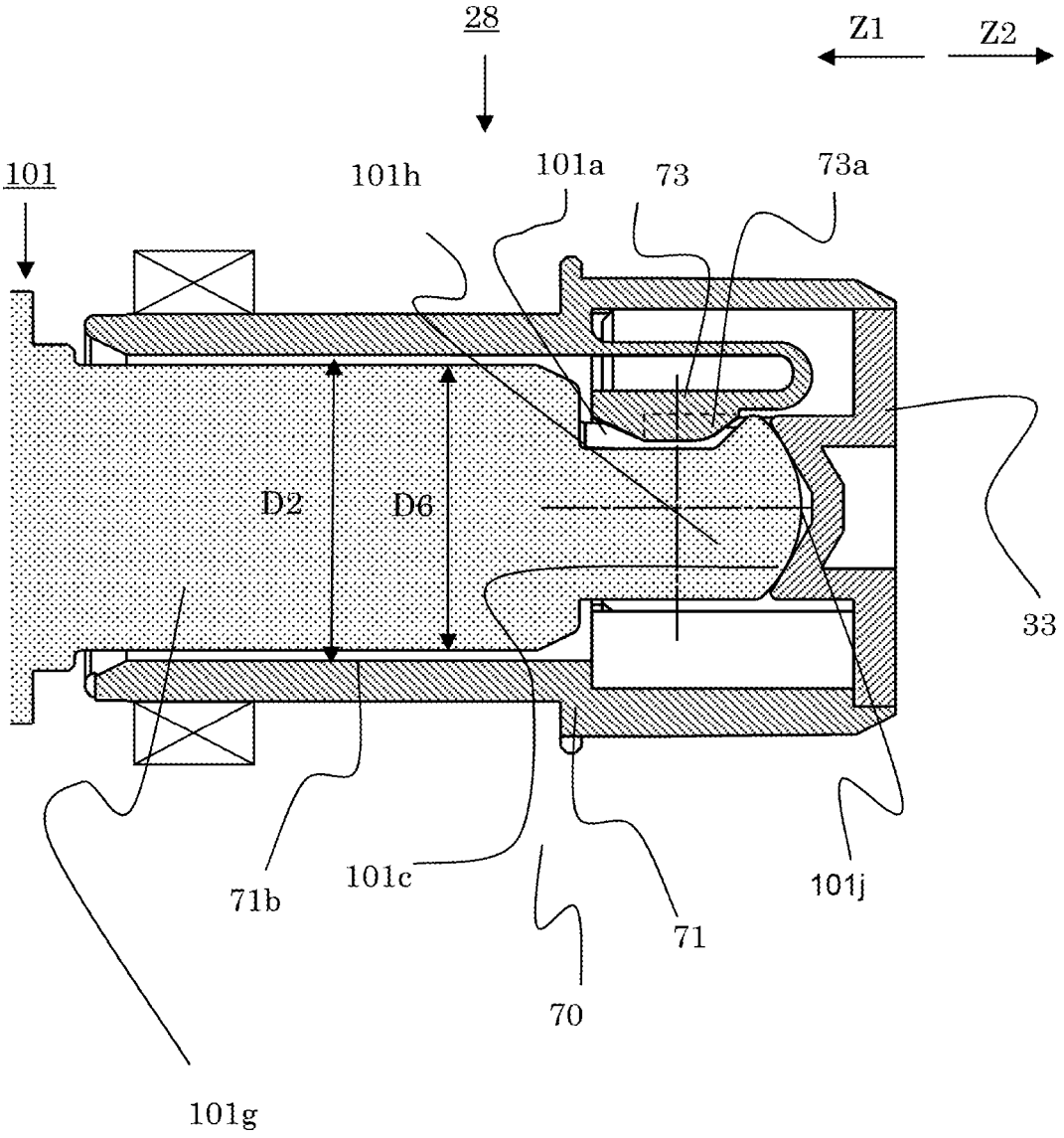
FIG. 8 is a cross-sectional view of a coupling 28 and the main assembly driving shaft 101 taken along the rotation axis (rotation axis).

FIG. 8 is a cross-sectional view of the coupling 28 and the main assembly driving shaft 101 taken along the rotation axis (rotation axis).

Figure 9:
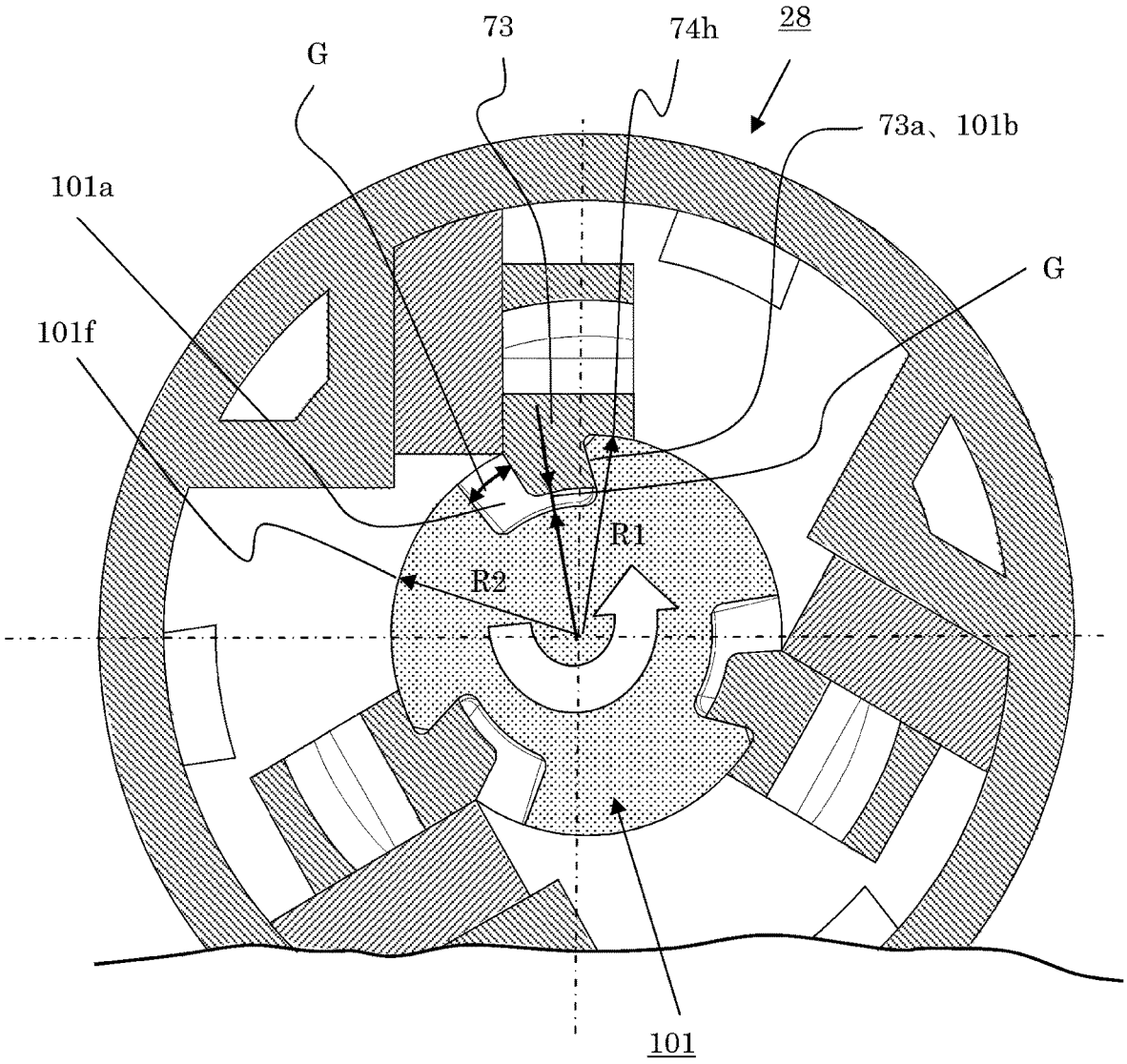
FIG. 9 is a cross-sectional view of the coupling member 28 and the main assembly driving shaft 101 taken along a plane perpendicular to the rotation axis.

FIG. 9 is a cross-sectional view of the coupling member 28 and the main assembly driving shaft 101 taken along a plane perpendicular to the rotation axis.

Figure 10:
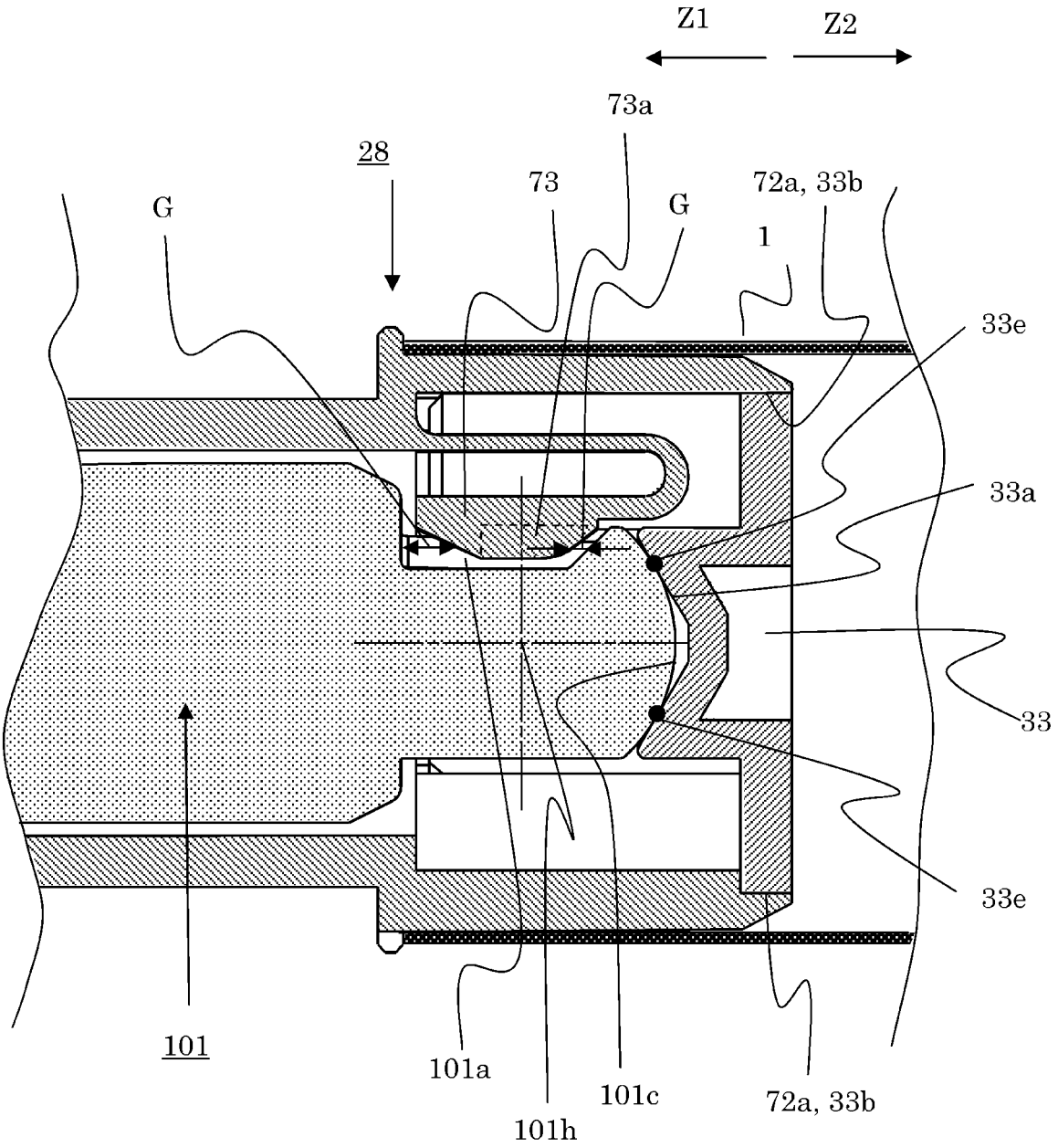
FIG. 10 is a cross-sectional view of the coupling 28 and the main assembly driving shaft 101 taken along the rotation axis.

FIG. 10 is a cross-sectional view of the coupling 28 and the main assembly driving shaft 101 taken along the rotation axis.

As shown in FIG. 5, the main assembly driving shaft 101 has a gear portion 101*e*, a shaft portion 101*f*, a rough guide portion 101*g* and a supported portion 101*d*.

The image forming apparatus main assembly 100A is provided with a motor (not shown) as a drive source. The gear portion 101*e* receives rotation drive from this motor, by which the main assembly driving shaft 101 rotates. In addition, the main assembly driving shaft 101 is provided with a rotatable projecting shaft portion 101*f* projecting toward the cartridge side from the gear portion 101*e* along the rotation axis thereof. And, the rotational driving force received from the motor is transmitted from the coupling member 28 to the photosensitive drum 1 of the drum cartridge 13 by way of the groove-shaped driving transmission groove 101*a* (recess portion, drive passing portion) provided in the shaft portion 101*f*. In addition, the shaft portion 101*f* has a semispherical shape 101*c* with a tip 101*j* at its free end.

The main assembly drive transmission groove 101*a* has a shape such that a portion of an engagement portion 73 which will be described hereinafter can enter. More specifically, it has a main assembly drive transmission surface 101*b* as a surface which can be contacted by the drive receiving surface (drive receiving portion) 73*a* of the coupling member 28 to transmit the driving force.

In addition, as shown in FIG. 5, the main assembly drive transmission surface 101*b* is not a flat surface, but has a shape twisted around the rotation axis of the main assembly driving shaft 101. The torsional direction is the direction that the downstream side of the main assembly driving shaft 101 in a Z1 direction is in the upstream side in the rotational direction of the main assembly driving shaft 101, relative to the downstream side in the Z2 direction. In this embodiment, the amount of twisting is about 1° per 1 mm measured along the rotational axis direction of the cylinder of the engaging portion 73. The reason why the main assembly drive transmission surface 101*b* is formed to have a twisted shape will be described later.

On the surface on the downstream side in the Z2 direction of the main drive transmission groove 101*a*, a main assembly side removing taper 101*i* is provided. The main assembly side removing taper 101*i* is a taper (inclined surface, inclined portion) for helping the engagement portion 73 to be pulled out from the drive transmission groove 101*a* when dismounting the drum cartridge 13 from the apparatus main assembly 100A. Details will be described later.

Here, it is preferable that when the drive is transmitted from the drive transmission groove 101*a* to the engagement portion 73, the main assembly drive transmission surface 101*b* and the drive receiving surface (drive receiving portion) 73*a* assuredly abut to each other. Therefore, the main assembly drive transmission groove 101*a* is spaced by a gap (G) from the engaging portion 73 in the rotational axis direction, the circumferential direction, and the radial direction so that the surface other than the main assembly drive transmission surface 101*b* does not contact with the engaging portion 73 as the driving force receiving portion (FIGS. 9 and 10).

In addition, a main assembly side removing taper 101*i* as an inclined surface (inclined portion) is provided on the free end side in the axial direction of the main assembly drive transmission groove 101*a*. In addition, the center 101*h* of the semispherical shape 101*c* is within the range of the main assembly drive transmission groove 101*a* in the axial direction of the main assembly driving shaft 101 (FIG. 8). In other words, when projecting the center 101*h* and the main assembly drive transmission groove 101*a* on the axis of the main assembly driving shaft 101, the projection region of the center 101*h* is inside the projection region of the main assembly drive transmission groove 101*a* on the axis.

The rough guide portion 101*g* is provided between the shaft portion 101*f* and the gear portion 101*e* (FIG. 6), in the axial direction. The rough guide portion 101*g* has a tapered shape at the free end on the shaft portion 101*f* side, and the outer diameter D6 of the rough guide portion 101*g* is smaller than the inner diameter D2 of the inner peripheral surface 71*b* of the cylindrical portion 71 of the coupling member 28 which will be described hereinafter, as shown in FIG. 8. As shown in FIG. 5, the outer diameter D6 of the rough guide portion 101*g* is larger than the outer diameter D5 of the shaft portion 101*f*. By this when the cartridge 7 is inserted into the image forming apparatus main assembly 100A, the main assembly driving shaft 101 can be guided so as to follow the coupling member 28, thereby reducing misalignment between the rotation center of the cylindrical portion 71 and the rotation center of the shaft portion 101*f*. Therefore, the rough guide portion 101*g* can be referred to as an insertion guide.

Here, the rough guide portion 101*g* is dimensioned so as not to come into contact with the inner peripheral surface 71*b* after the cartridge 7 is mounted in the image forming apparatus main assembly 100A.

As shown in FIG. 6, the supported portion 101*d* is disposed on the opposite side of the rough guide portion 101*g* across the gear portion 101*e*. And, the supported portion 101*d* is rotatably supported (axially supported) by the bearing member 102 provided in the image forming apparatus main assembly 100A.

As shown in FIG. 6, the main assembly driving shaft 101 is urged toward the drum cartridge 13 by the spring member 103 of the image forming apparatus main assembly 100A. However, the movable amount (play) of the main assembly driving shaft 101 in the Z direction is about 1 mm, which is sufficiently smaller than the width measured in the Z direction of the drive receiving surface 73*a* which will be described hereinafter.

As described above, a main assembly drive transmission groove 101*a* is provided in the main assembly driving shaft 101, and an engaging portion 73 is provided on the coupling member 28 so that the drive is transmitted from the apparatus main assembly 100A to the drum cartridge 13 (drum unit 30).

As will be described in detail hereinafter, the engaging portion 73 is provided at the free end of a support portion 74 which can be elastically deformed. Therefore, the engaging portion 73 is constituted to be movable radially outward when the drum cartridge 13 is mounted on the apparatus main assembly 100A. By this, along with inserting the drum cartridge 13 into the main assembly 100A of the apparatus, the engagement portion 73 enters the drive transmission groove 101*a* so that the engagement portion 73 and the main assembly drive transmission groove 101*a* can engage with each other.

[Structure of Coupling Member]

Referring to FIGS. 11 to 19, the structure of a coupling member 28 will be described.

Figure 11:
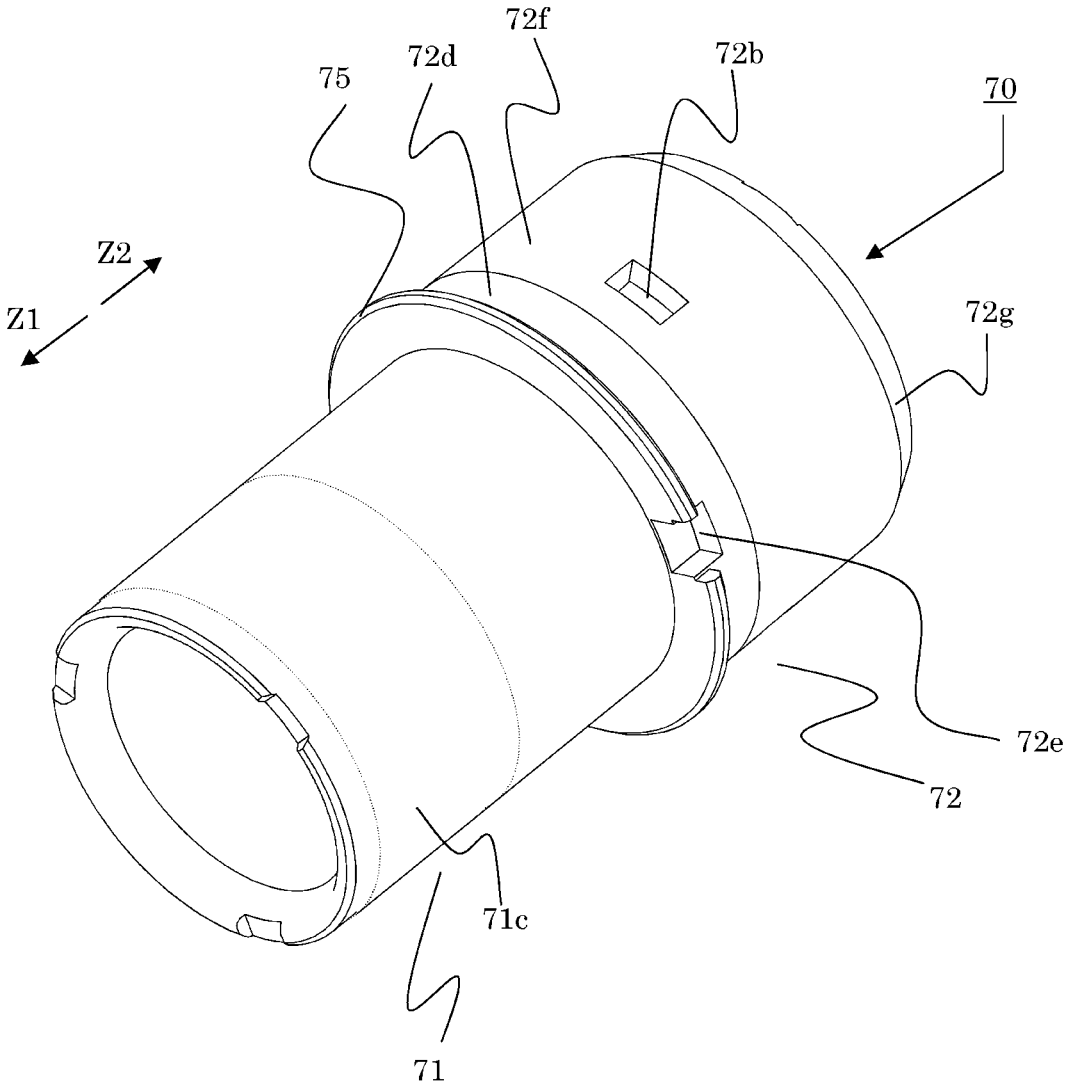
FIG. 11 is a perspective view of a flange member 70.

FIG. 11 is a perspective view of a flange member 70.

Figure 12:
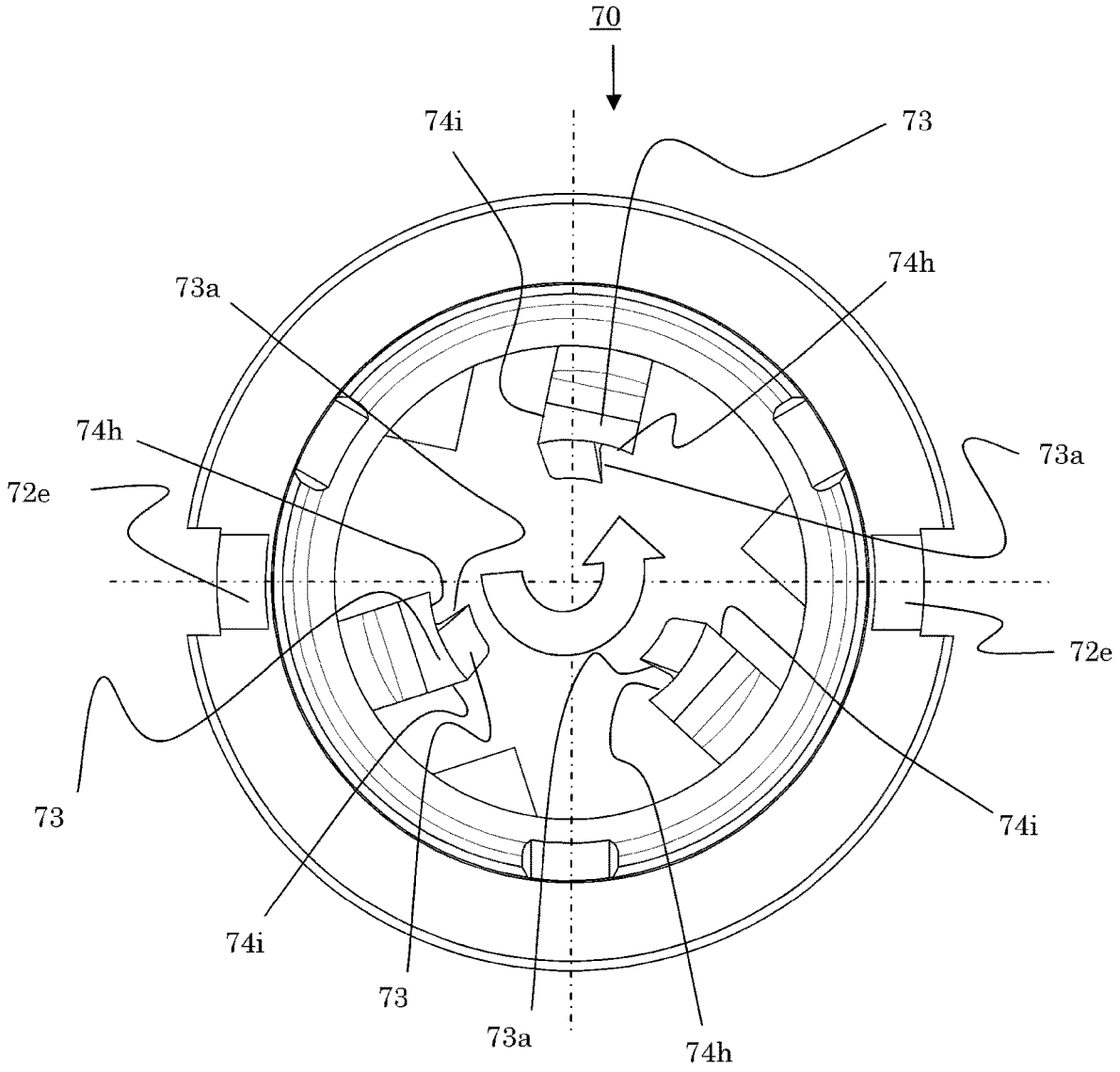
FIG. 12 is a view of the flange member 70 as viewed in a direction from a Z1 side to a Z2 side.

FIG. 12 is a view of the flange member 70 as viewed from a Z1 side toward a Z2 side.

Figure 13:
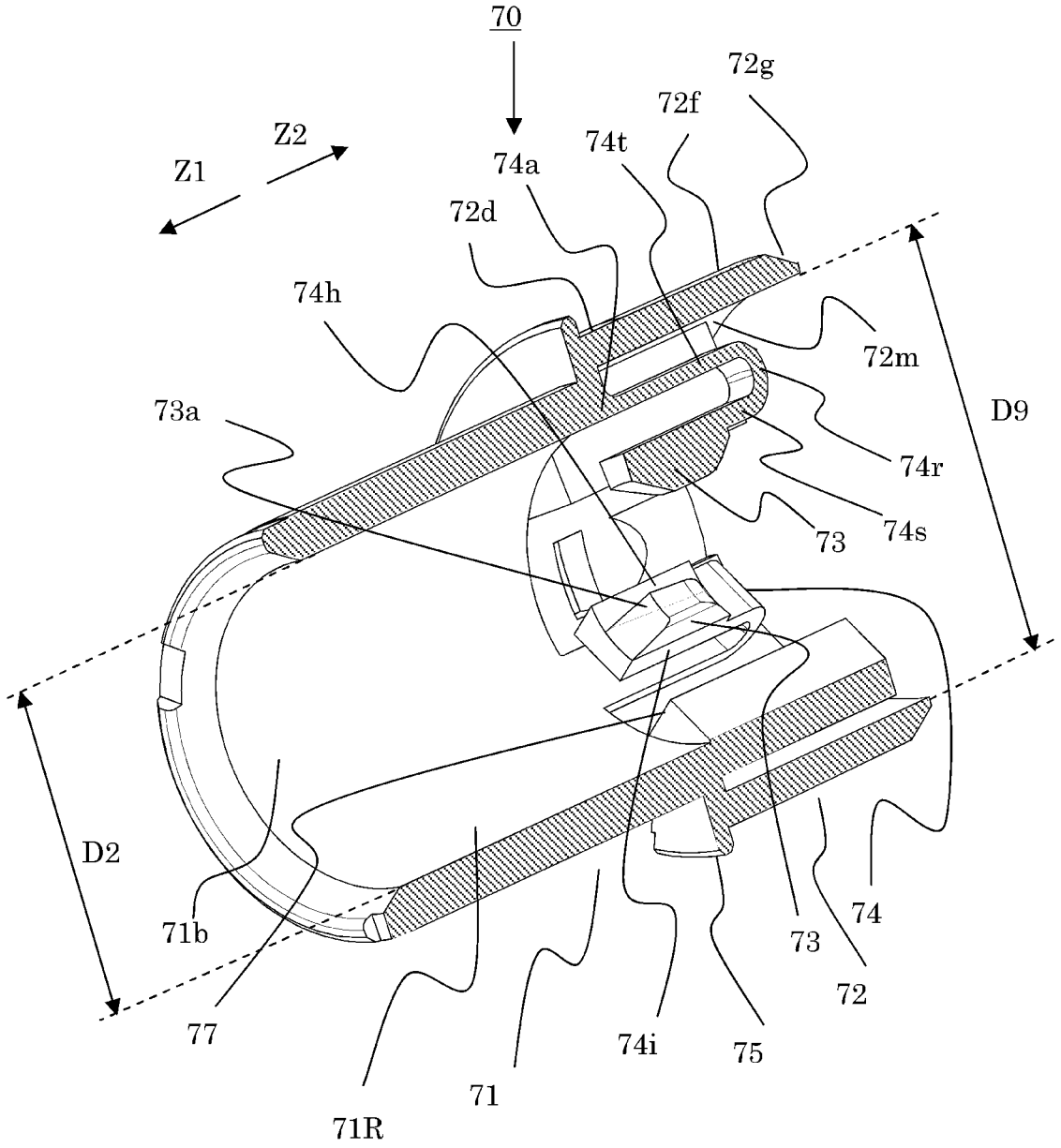
FIG. 13 is a cross-sectional perspective view of the flange member 70.

FIG. 13 is a cross-sectional perspective view of the flange member 70.

Figure 14:
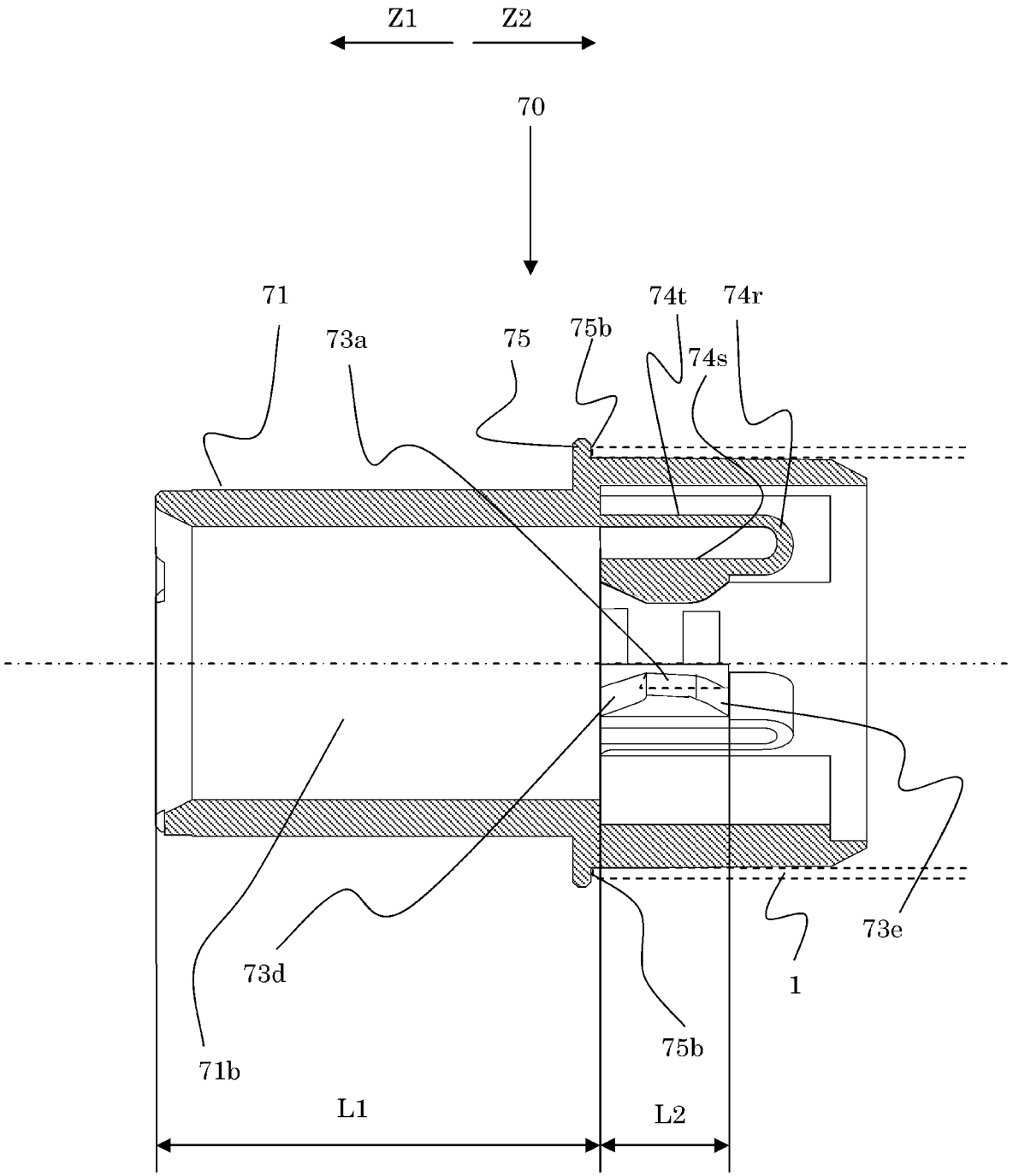
FIG. 14 is a cross-sectional view of the flange member 70 taken along the rotation axis (the center of the rotation axis).

FIG. 14 is a cross-sectional view of the flange member 70 taken along a rotation axis (the center of the rotation axis).

Figure 15:
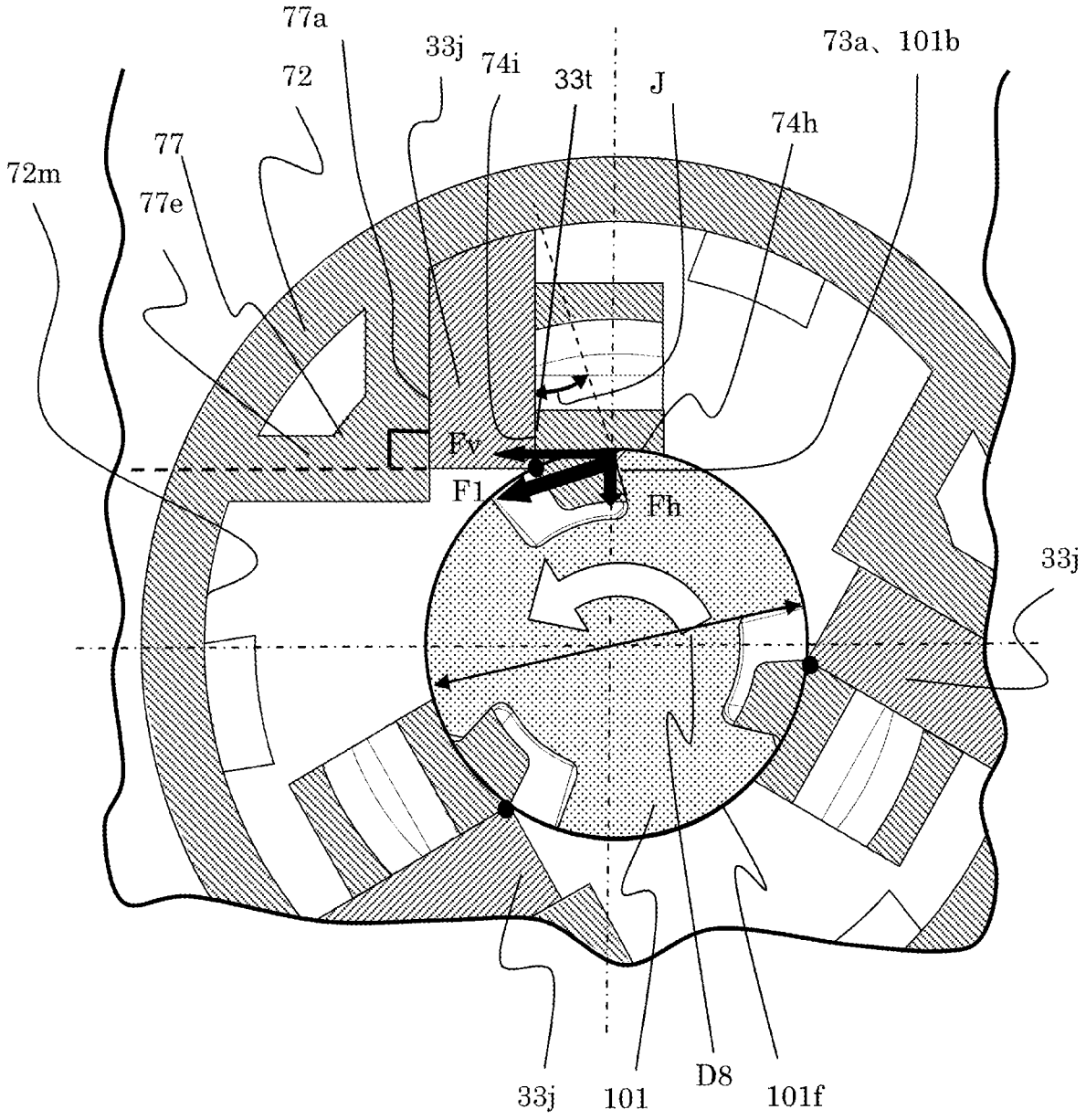
FIG. 15 is a cross-sectional view of the coupling member 28 and the main assembly driving shaft 101 taken along a plane perpendicular to the rotation axis and passing through a drive transmission surface 73*a*.

FIG. 15 is a cross-sectional view of a coupling member 28 and the main assembly driving shaft 101 taken along a plane perpendicular to the rotation axis so as to pass through a drive transmission surface 73*a*.

Figure 16:
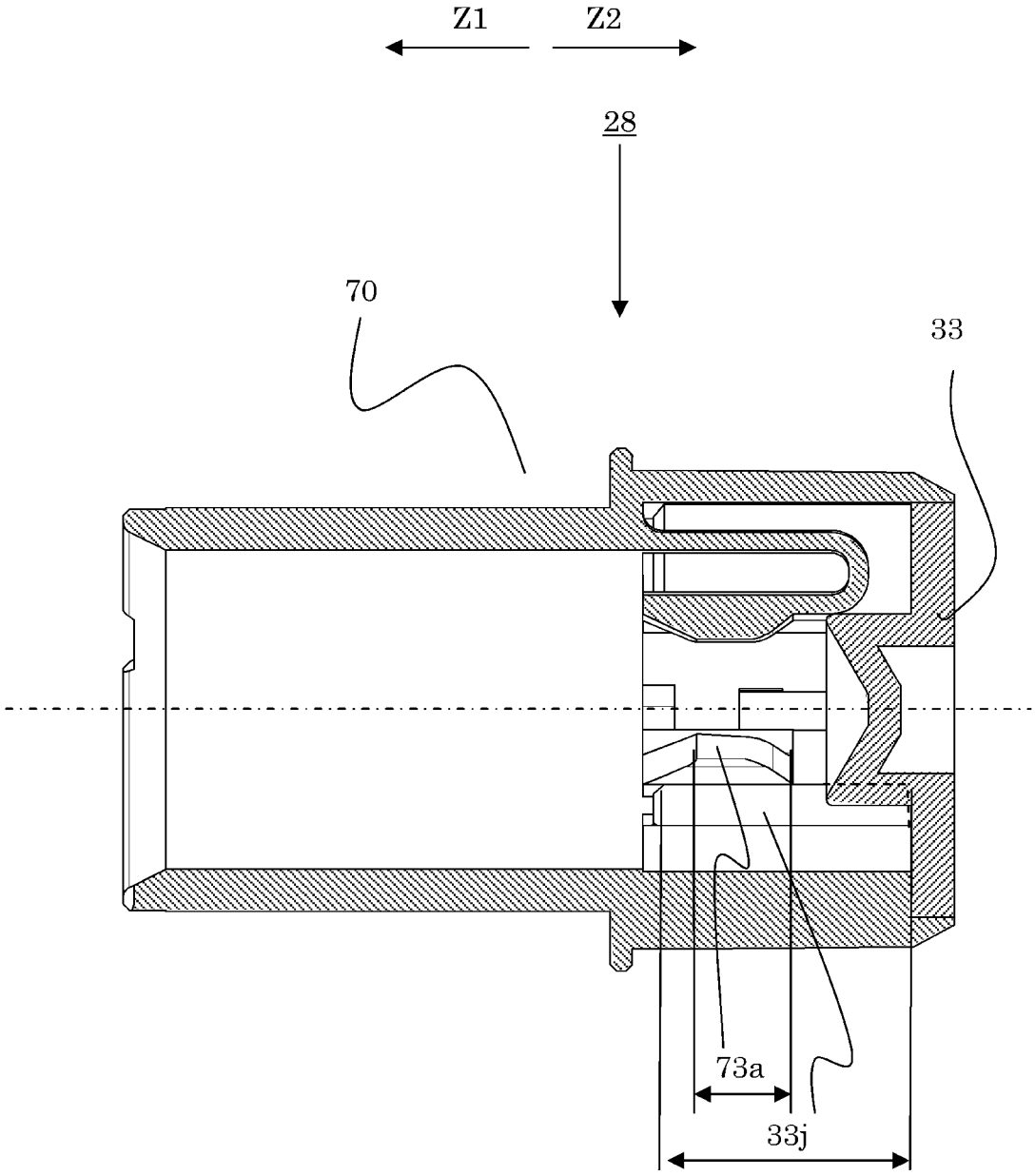
FIG. 16 is a cross-sectional view of the coupling member 28 taken along the rotation axis (center of rotation axis).

FIG. 16 is a cross-sectional view of the coupling member 28 taken along the rotation axis (center of rotation axis).

Figure 17:
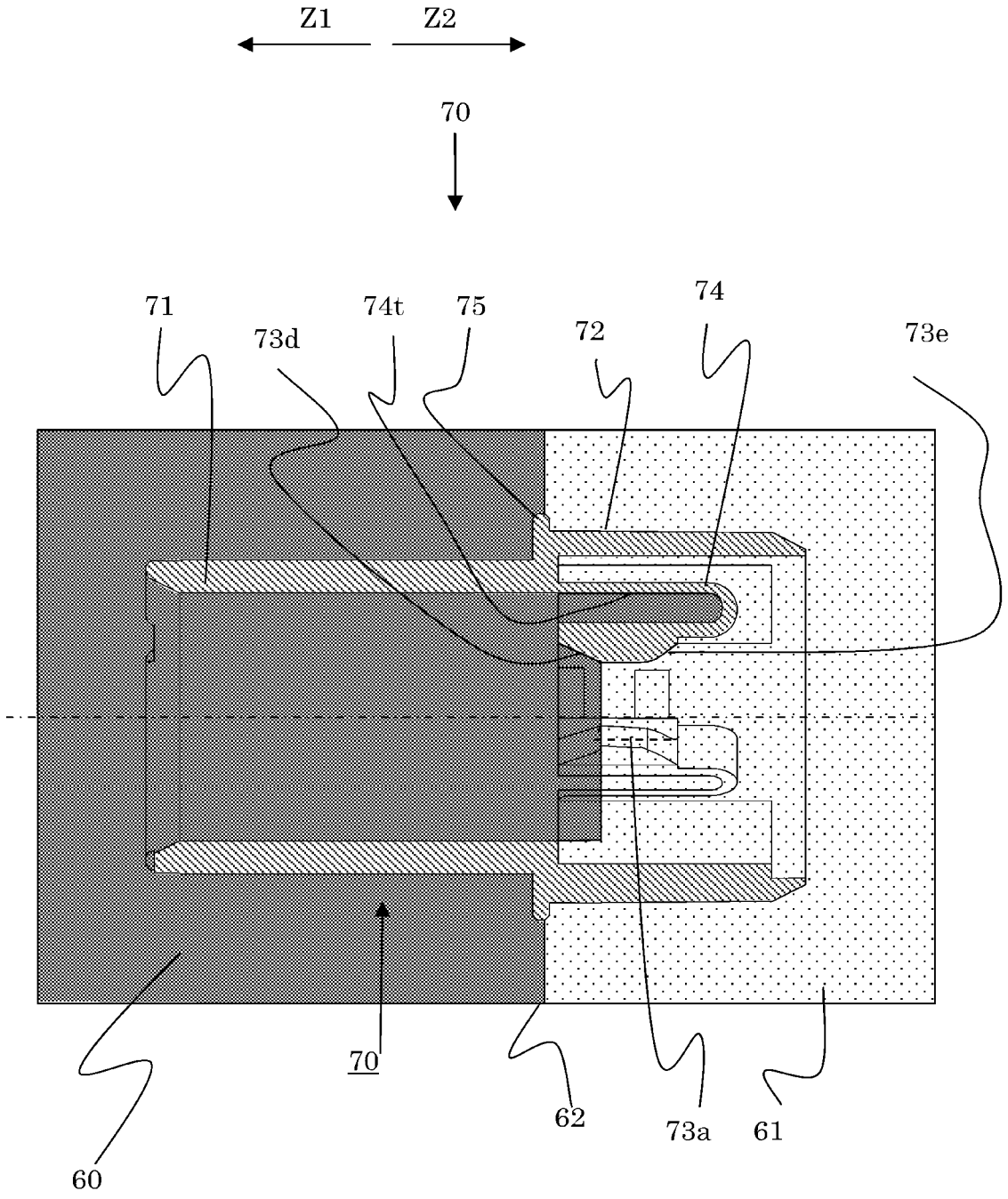
FIG. 17 is a cross-sectional view illustrating a molding die of the flange member 70.

FIG. 17 is a cross-sectional view illustrating a molding die of the flange member 70.

Figure 18:
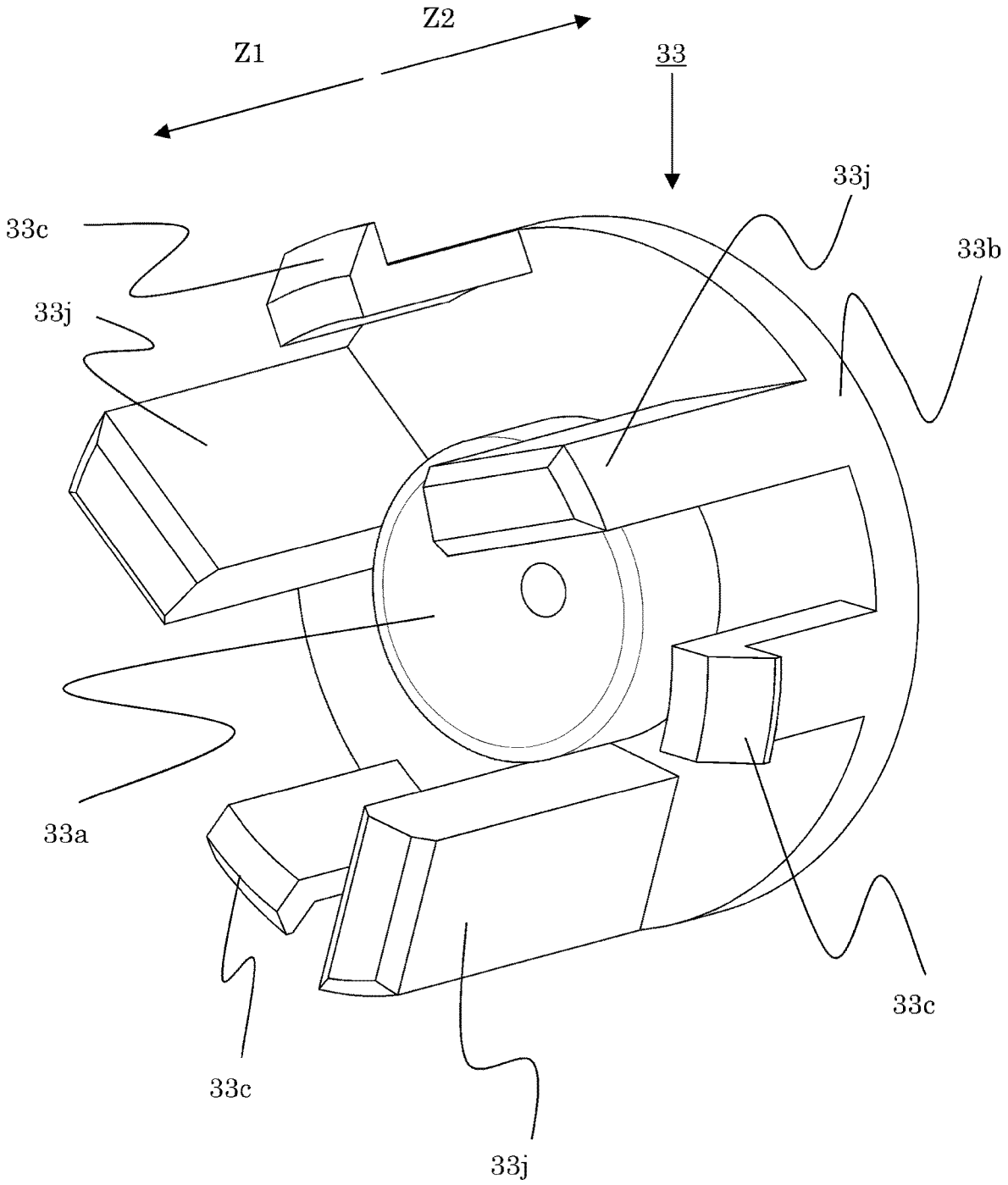
FIG. 18 is a perspective view of an aligning member 33.

FIG. 18 is a perspective view of an aligning member 33.

Figure 19:
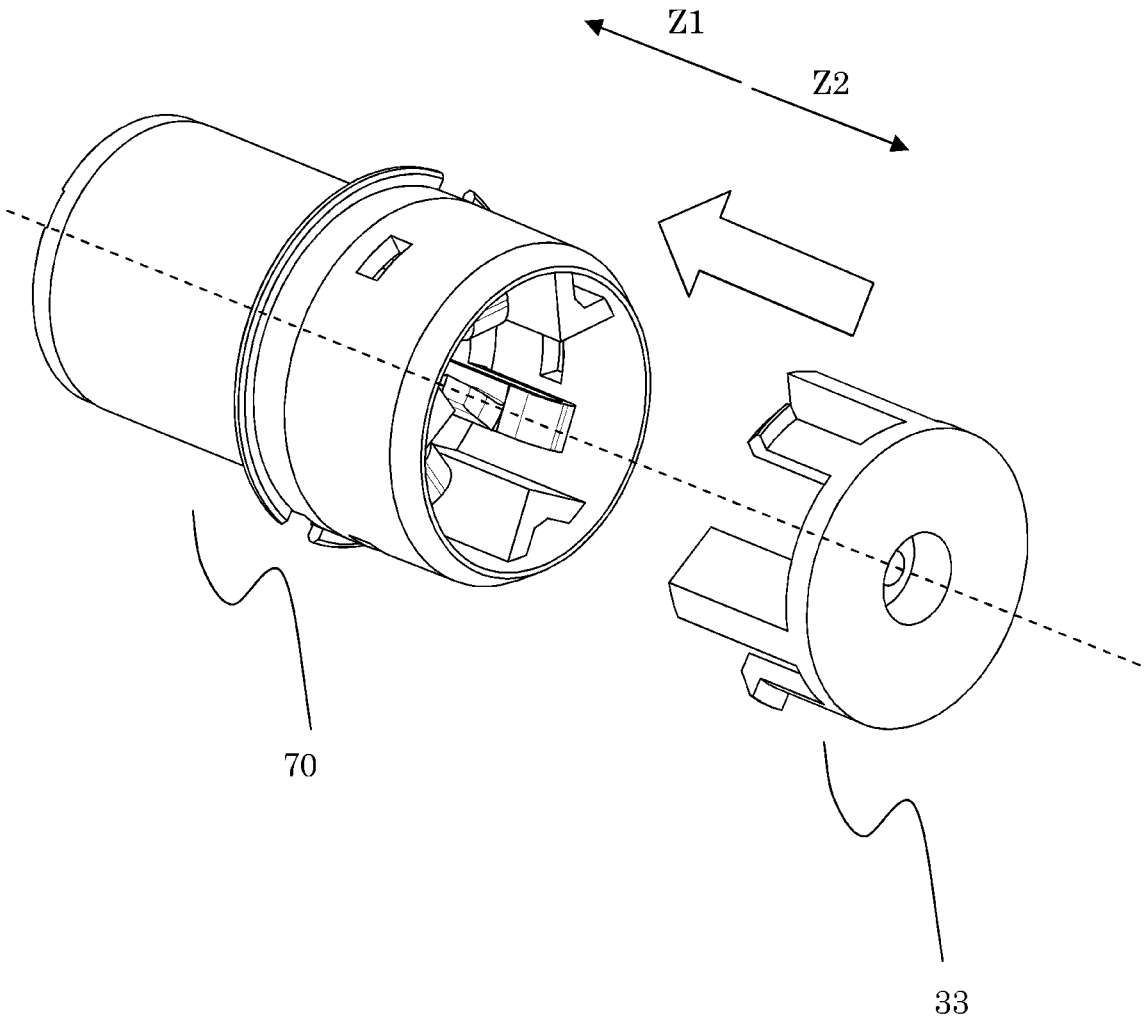
FIG. 19 is a view illustrating a method of assembling the coupling member 28.

FIG. 19 is a view illustrating a method of assembling the coupling member 28.

As shown in FIG. 16, the coupling member 28 comprises the flange member 70 and the aligning member 33.

(Flange Member)

Referring to FIGS. 4, 9, 11, 12, 13, 14, 15, 17, the structure of the flange member 70 will be described.

As shown in FIG. 13, the flange member 70 includes a mounting portion (fixing portion) 72, a cylindrical portion 71, a flange portion 75, an engagement portion 73, a support portion 74, and a force receiving portion 77.

The mounting portion 72 is a portion for mounting to the photosensitive drum 1. As shown in FIG. 11, the mounting portion 72 includes a press-fitting portion 72*d* press-fitted to the inner diameter of the cylinder of the photosensitive drum 1, a clamp groove 72*e*, and a press-fit guide portion 72*f* provided on the back side (the Z2 direction side) of the press-fitting portion 72*d*.

The press-fitting portion 72*d* as a joining portion is press-fitted into the photosensitive drum 1, and press-fitted to the photosensitive drum 1, by which the coupling member 28 is fixed to the photosensitive drum 1. More specifically, the cylinder inner diameter of the photosensitive drum 1 and the outer shape of the press-fitting portion 72*d* are dimensioned so as to be in a press fitting relationship. Here, the above-described relationship is not restrictive in the case of increasing the fastening force by clamping or of fixing the inside diameter portion of the cylinder and the press-fitting portion 72*d* by adhesion.

As shown in FIGS. 11 and 12, the clamp groove 72*e* has a groove shape (a recessed portion) provided on the photosensitive drum 1 side of the press-fitting portion 72*d* in the Z axis direction. The two clamp grooves 72*e* are equidistantly arranged around the rotation axis of the coupling member 28. Here, in the rotation axis direction of the coupling member 28, the clamp groove 72*e* and the flange portion 75 overlap with each other. In other words, when the clamp groove 72*e* and the flange portion 75 are projected perpendicularly onto the rotation axis of the coupling member 28, the projection area of the clamp groove 72*e* and the projection area of the flange portion 75 overlap with each other on the axis.

Here, "X and Y overlap each other in an A direction" means that "when X and Y are projected onto an imaginary line parallel with the direction A, at least a part of the projection area of X and at least a part of the projection area of Y on the imaginary line overlap with each other". By clamping it to a portion of the end of the photosensitive member 1 on the side of the coupling member 28, the photosensitive drum 1 is plastically deformed. By this, a portion of the photosensitive member is inserted into the clamp groove 72*e*, and the photosensitive drum 1 and the coupling member 28 are firmly fixed with each other. Here, clamping is an operation of plastic-working to join a portion or portions of a plurality of parts. In this embodiment, plastically deforming a portion of the cylinder (aluminum) of the photosensitive drum 1 is elastically deformed, so that the cylinder of the photosensitive drum 1 is coupled to the coupling member 28. In this embodiment, as an example of a means for firmly fixing the coupling member 28 to the photosensitive drum 1, a structure using the clamp groove 72*e* is used, but another fixing means such as fixing the cylinder inner diameter portion and the press-fitting portion 72*d* by adhesion can be used. Therefore, the clamp groove 72*e* is not essential in the present invention.

The press-fit guide portion 72*f* has such a shape that when assembling the coupling member 28 to the photosensitive drum 1, it is easy to assemble the coupling member 28 to the photosensitive drum 1, and the press-fitting of the press-fitting portion 72*d* into the photosensitive drum 1 is stabilized. More specifically, the outer diameter of the press-fit guide portion 72*f* is smaller than the outer diameter of the press-fitting portion 72*d* and the cylinder inner diameter of the photosensitive drum 1, and it is provided with a guide taper 72*g* on a leading end side in the mounting direction to the photosensitive drum 1. The guide taper 72*g* is an inclined portion provided on the coupling member 28 in order to facilitate the insertion of the coupling member 28 into the photosensitive drum 1.

The cylindrical portion 71 has a bearing receiving portion 71*c* as described above (FIGS. 4 and 11). The supported portion 71*c* is rotatably supported by the drum unit bearing member 39R. As shown in FIG. 13, the inner diameter D2 of the inner peripheral surface 71*b* of the cylindrical portion 71 is smaller than the inner diameter D9 of the inner peripheral surface 72*m* of the mounting portion 72. In addition, as shown in FIGS. 13 and 14, the inner peripheral surface 71*b* of the cylindrical portion 71 is provided with a tapered shape at the front end (Z1 direction) free end. This tapered shape is an inclined portion (inclined surface) for guiding the main assembly driving shaft 101 being inserted into the cylindrical portion 71. The main driving shaft 101 can be guided so as to follow the coupling member 28 so as to reduce the axial misalignment between the rotation center of the cylindrical portion 71 and the rotation center of the shaft portion 101*f* when the drum cartridge 13 is being inserted into the image forming apparatus main assembly 100A. In addition, as shown in FIG. 8, the inner diameter D2 of the inner peripheral surface 71*b* is larger than the outer diameter D6 of the shaft portion 101*f* of the main assembly driving shaft 101. Therefore, after the drum cartridge 13 is mounted on the image forming apparatus main assembly 100A, the inner peripheral surface 71*b* does not contact the rough guide portion 101*g*.

As shown in FIG. 14, the flange portion 75 has a shape projecting outward from the press-fitting portion 72*d* in the radial direction. The shape thereof is a shape for determining the positions of the photosensitive drum 1 and the coupling member 28 in the Z direction, by the end surface of the photosensitive drum 1 abutting against the end surface 75*b* of the flange portion 75, when assembling the coupling member 28 to the photosensitive drum 1.

As shown in FIG. 12, the engaging portion 73 projects at least inward in the radial direction of the coupling member 28 in order to engage with the main assembly driving shaft 101. The engaging portions 73 are arranged at three positions (120° intervals, substantially equally spaced) at equal intervals in the circumferential direction of the coupling member 28. Similarly, three base portions 74 of the support portion are also arranged at equal intervals in the circumferential direction of the flange member 70. In addition, as shown in FIG. 12, the engaging portion 73 has a drive receiving surface 73*a*. The base 74 is provided with a backed-up surface 74*i* and a contact surface 74*h*.

The drive receiving surface 73*a* is a driving force receiving portion for receiving the driving force from the main assembly driving shaft 101 by contacting with the driving transmission groove 101*a*. The flange member 70 is a driving force receiving member for receiving the driving force by way of the drive receiving surface 73*a*.

The contact surface 74*h* provided on the base portion 74 of the support portion is a curved surface where the coupling member 28 abuts against the shaft portion 101*f* when engaged with the main assembly driving shaft 101, and is a circular arc surface having a shape following the shape, in the circumferential direction (rotational direction), of the coupling member 28. As shown in FIG. 9, the radius R1 of the arc defining the inner diameter of the contact surface 74*h* is substantially the same as the radius R2 of the shaft portion 101*f*. The backed-up surface 74*i* contacts with the backup surface 33*t* of the backup portion 33*j* of the aligning member 33 which will be described hereinafter, and it is disposed on the downstream side of the drive receiving surface 73*a* with respect to the rotational direction (shown in FIG. 12). In addition, as shown in FIG. 15, the angle J formed by the backed-up surface 74*i* and the drive receiving surface 73*a* is an acute angle. That is, the drive receiving surface 73*a* is inclined with respect to the backup surface 33*t* of the backup portion 33*j*.

The drive receiving surface (driving force receiving portion) 73*a* is movably supported by the supporting portions (73, 74). The supporting portion (73, 74) has a U-shaped snap fit portion.

A cylindrical member 70 constituting the coupling member 28 has a cylindrical shape (hollow shape). That is, the cylindrical member 70 has a hollow portion (a portion including a cavity inside) of the coupling member 28. The base portion 74 of the support portion (73, 74) includes a base portion 74*a* which is a fixed end, and the base portion 74*a* is fixed to the inner surface of the cylinder 70.

At least a portion of the supporting portion (73, 74) is arranged inside the cylindrical member 70. In this embodiment, the entire support portion (73, 74) is arranged inside the cylindrical member 70.

As shown in FIG. 13, 14, and the base portion 74 extends from the inner surface of the hollow portion (the cylindrical member 70) of the coupling member 28 with the base portion (fixed end) 74*a* of the base portion 74 as a starting point. In addition, the base portion 74 is provided with an elastically deformable portion (elastic deformed portion). By this, the base portion 74 movably supports an engaging portion 73 provided at the free end (free end) of the base portion 74.

More particularly, the base portion 74 includes a base side extending portion (a fixed end side extending portion) 74*t*, a folded portion (a bent portion, a connecting portion) 74*r*, and a free end side extending portion (a leading side extending portion) 74*s*. Backup surface 74*i* and contact surface 74*h* are provided on the free end side extending portion 74*s*.

The base side extending portion 74*t* is an extending portion extending from the base portion (fixed end) 74*a* in the Z2 direction (that is, toward the inside of the drum unit 30 in the axial direction) substantially parallel with the rotation axis of the flange member 70. That is, the base side extending portion 74*t* extends in the Z2 direction toward the folded portion 74*r*.

The base side extending portion 74*t* is disposed radially outward with respect to the engaging portion 73 and the free end side extending portion 74*s*.

The folded portion 74*r* is continuously formed with the base side extending portion 74*t* and also continues to the free end side extending portion 74*s*. That is, the folded portion 74*s* is a bent portion provided between the root side extending portion 74*t* and the free end side extending portion 74*s*. The folded portion 74*s* is a connecting portion for connecting the free end side extending portion 74*s* and the root side extending portion 74*t*. In this embodiment, the angle at which the folded portion 74*r* bends is larger than 90°. More specifically, the angle was about 180°.

The folded-back portion 74*r* and the base side extending portion 74*t* are elastic portions that can be elastically deformed.

The free end side extending portion 74*s* extends from the folded portion 74*r* as a starting point in the Z1 direction (that is, the outer side of the drum unit 30 in the axial direction) substantially parallel with the rotation axis of the flange member 70. The free end side extending portion 74*s* is disposed radially inward with respect to the base side extending portion 74*t*.

By bending the integrally formed base portion 74, the free end extending portion 74*s* and the base side extending portion 74*t* are formed. With such a structure, it is possible to simplify the structure of the support portions (73, 74).

However, it is possible that the connecting portion, the base side extending portion 74*t*, and the free end side extending portion 74*s* are formed as separate bodies (separate members), and the base side extending portion 74*t* and the free end side extending portion 74*s* are connected to the connecting member.

The free end side extending portion 74*s* is also a portion for supporting the drive receiving surface 73*a*. That is, the free end side extending portion 74*s* has an engaging portion (projecting portion, protruding portion) 73 on which the drive receiving surface 73*a* is formed.

The engaging portion 73 is a projecting portion provided at the free end of the free end side extending portion 74*s* and projects inward in the radial direction. That is, the direction (axial direction) in which the free end side extending portion 74*s* extends and the direction (radial direction) in which the engaging portion 73 projects intersect with each other. The engagement portion 73 enters the inside of the main assembly drive transmission groove 101*a* and engages with the main assembly drive transmission groove 101*a*.

The structure is such that at least parts of the base side extending portion 74*t* and the free end side extending portion 74*s* overlaps with each other in the axial direction of the drum unit 30. That is, the structure is such that when the base side extending portion 74*t* and the free end side extending portion 74*s* are perpendicularly projected on the axis line of the drum unit 30, the projected areas of them at least partially overlap with each other.

The drive receiving surface 73*a* provided in the engaging portion 73 intersects the rotational direction (circumferential direction) of the coupling member 28. In addition, the drive receiving surface 73*a* is also a surface extending radially inward from the free end side extending portion 74*s*.

Here, in this embodiment, the base side extending portion 74*t* and the free end side extending portion 74*s* are straight portions extending parallel to the axial direction. However, the present invention is not necessarily limited to such a structure.

That is, it will suffice for each extending portion (74*t*, 74*s*) to extend at least in the axial direction. In other words, a vector extended in a direction in which each extending portion (74*t*, 74*s*) extends may have a component in the axial direction. As an example thereof, FIG. 64 and FIG. 65 show modification examples of this embodiment. As shown in these Figures, the base side extending portion 74*t* may extend in the Z2 direction with inclination relative to relative to the axial direction. In addition, as shown in FIG. 64 and FIG. 65, the free end side extending portion 74*s* may also extend in the Z1 direction with the inclination relative to the axial direction. Even in such a case, the base side extending portion 74*t* and the free end side extending portion 74*s* are considered to extend at least in the axial direction. The base side extending portion 74*t* and the free end side extending portion 74*s* are regarded as extending in different directions along the axial direction.

In addition, as long as the base side extending portion 74*t* and the free end side extending portion 74*s* extend at least in the axial direction, they do not have to extend linearly.

The free end of the engaging portion 73 (that is, the free end of the free end side extending portion 74*s*) is disposed closer to the Z1 side than the folded portion 74*r*. In addition, the root (fixed end) 74*a* of the base portion 74 is also disposed on the Z1 side of the folded portion 74*r*.

The inner side surface of the base side extending portion 74*t* is arranged to be the same as the diameter of the inner peripheral surface 71*b* of the cylindrical portion 71 or to project toward the inner diameter side.

The engaging portion 73 is supported by an elastically deformable base portion 74, it can move radially of the coupling member 28 by deformation of the base portion 74. In other words, the base portion 74 is deformed when subjected to an external force, and a restoring force (elastic force) is produced in a direction returning to a position in the spontaneous state.

The base side extending portion 74*t* is deformed so as to be inclined with the root 74*a* being as a starting point. The folded portion 74*r* is deformed so as to incline the free end side extending portion 74*s*. As a result, the engaging portion 73 can be moved in a direction crossing with the direction in which each extending portion (74*t*, 74*s*) extends.

More specifically, when the engaging portion 73 contacts the outer peripheral surface of the main assembly driving shaft 101, it moves radially outwardly along the outer peripheral surface of the main assembly driving shaft 101 by elastic deformation of the base 74. Thereafter, when the engaging portion 73 becomes at the same position (same phase) as the main assembly side drive transmission groove 101*a* provided on the outer peripheral surface of the main assembly driving shaft 101, the engaging portion 73 moves in a direction in which the elastic deformation of the base portion 74 is freed. Then, the engaging portion 73 moves inward in the radial direction and therefore, a portion of the engagement portion 73 can enter the main assembly drive transmission groove 101*a*.

In addition, the drive receiving surface 73*a* of the flange member 70 has a shape twisted about the axis of the flange member 70, and in this embodiment, the amount of twisting is the same as that of the main assembly drive transmission surface 101*b*.

Here, it will suffice if the drive receiving surface 73*a* has a different phase, in the rotational direction, of two points contacting the driving shaft 101. That is, the drive receiving surface 73*a* may not necessarily have a twisted shape as long as it has the same function as the twisted surface.

For example, it will suffice if an outside of the drive receiving surface 73*a* (z1 direction side) is disposed on the upstream side of the inner side (the Z2 direction side) with respect to the rotational direction of the photosensitive drum 1. In other words, the structure is such that a straight line connecting the cylinder inner end portion and the cylinder outer end portion along the cylinder axial direction of the engaging portion 73 as the driving force receiving portion intersects the rotation axis of the cylinder. The drive receiving surface 73*a* is inclined relative to the axis of the coupling member 28.

As described above, the drive receiving surface 73*a* has a twisted shape or an inclined shape, and therefore, when the drive receiving surface 73*a* is driven, the photosensitive drum unit 30 receives such a force that it is pulled in toward the bearing portion 101*d* of the main assembly driving shaft 101.

As shown in FIG. 14, the engaging portion 73 is provided with an insertion tapered surface 73*d* as a mounting force receiving portion on the outer side (the Z1 direction side) of the photosensitive drum unit 30 in the Z direction. In addition, the engaging portion 73 is provided with a removing tapered surface 73*e* as a removal force receiving portion on the inner side (the Z2 direction side) of the photosensitive drum unit 30 in the Z direction. By this, the mounting and dismounting properties of the coupling member 28 relative to the main driving shaft 101 can be improved.

At the time of mounting, the insertion tapered surface 73*d* abuts against the semispherical shape 101*c*, and the engaging portion 73 is moved toward the outside in the radial direction of the driving shaft. In addition, in the dismounting operation, the removing tapered surface 73*e* and the main assembly side removing taper 101*i* are brought into contact with each other, and the engaging portion 73 is moved outward in the radial direction of the main assembly driving shaft 101.

In addition, as shown in FIG. 14, the length L2 of the drive receiving surface 73 is selected so as to satisfy the relationship of L1>L2, in the Z direction, relative to the distance L1 from the front end surface of the cylindrical portion 71 to the front end surface of the engaging portion 73.

As shown in FIG. 15, the force receiving portion 77 is disposed on the downstream side in the rotational direction of the engaging portion 73, and is provided with a receiving surface 77*a* and a rib 77*e*. The backup portion 33*j* of the aligning member 33 which will be described hereinafter is sandwiched between the backed-up surface 74*i* provided on the free end extended portion 74*s* and the receiving surface 77*a*. The receiving surface 77*a* and the drive receiving surface 73 are arranged substantially in parallel with each other. As shown in FIG. 15, the rib 77*e* is arranged starting from the inner diameter side end of the receiving surface 77*a* so that it abuts against the inner peripheral surface 72*m* of the mounting portion 72 substantially perpendicularly to the receiving surface 77*a*.

Here, at least parts of the support portions (73, 74) and the drive receiving surface 73*a* are arranged inside the supported portion 71*c* in the axial direction of the drum unit 30. Therefore, the support portions (73, 74) and the drive receiving surface 73*a* can be protected by the supported portion 71*c* and the bearing member 19R. In particular, in this embodiment, the entirety of the support portions (73, 74) and the drive receiving surface 73*a* is arranged inside the supported portion 71*c* in the axial direction of the drum unit 30.

Furthermore, at least a portion of the supporting portion (73, 74) is placed in the internal space of the photosensitive drum 1. That is, at least a portion of the support portion (73, 74) is located inside the end portion of the photosensitive drum 1 in the axial direction. In other words, when the supporting portion (73, 74) and photosensitive drum 1 are projected perpendicularly to the axis of photosensitive drum 1, at least a part of the projection area of the support portion (73, 74) and the projection area of the photosensitive drum 1 overlap with each other. In addition, at least a part of the supporting portions (73, 74) is also place inside the photosensitive drum 1 also in the radial direction of the drum unit.

Similarly, at least a part of the driving force receiving portion (drive receiving surface 73*a*) is placed inside the photosensitive drum 1. Therefore, when the drive receiving surface 73*a* and the photosensitive drum 1 are projected perpendicular to the axis of the photosensitive drum 1, at least parts of the projection area of the drive receiving surface 73*a* and the projection area of the photosensitive drum 1 overlap with each other.

If at least a part of the supporting portions (73, 74) and at least a part of the drive receiving surface 73*a* are placed inside the photosensitive drum 1, it is possible to protect the support portions (73, 74) and the drive receiving surface 73*a* by the photosensitive drum 1.

In particular, in this embodiment, the entirety of the supporting portions (73, 74) and the whole of the drive receiving surface 73*a* are placed inside the photosensitive drum 1.

In addition, by place in the base portion 74*a* which is the fixed end of the support portion (73, 74), inside the photosensitive drum 1, the following advantageous effects are provided. The base portion 74*a* is disposed inside the photosensitive drum 1, so that the flange member 70 (the coupling member 28) is covered with the photosensitive drum 1 around the base portion 74*a* and fixed to the photosensitive drum 1. The photosensitive drum 1 has a high rigidity, and therefore, the portion covered with the photosensitive drum 1 of the flange member 70 is hardly deformed.

The support portions (73, 74) can be elastically deformed with the base portion 74*a* as a starting point, but even if the support portion (73, 74) is elastically deformed, it is possible to suppress the influence of the deformation to the outside of the base portion 74*a* by the photosensitive drum 1.

If the deformation of the flange member 70 is suppressed, the borne portion 71*c* of the flange member 70 can be stably supported by the bearing member 39R. In addition, the supporting portion (73, 74) is supported by the portion which is difficult to deform of the flange member 70. As a result, the driving force receiving portion (the drive receiving surface 73*a*) provided in the supporting portions (73, 74) can receive the driving force from the main assembly driving shaft 101 in a stable manner.

By providing the drive receiving surface 73*a* inside the photosensitive drum 1, the main assembly driving shaft 101 can be made longer. The main assembly driving shaft 101 is supported by the main assembly of the device at the fixed end (bearing portion 101*d*), and is supported by the drum unit at its free end (the shaft portion 101*f*). Then, the longer the distance between the bearing portion 101*d* and the shaft portion 101*f*, the smaller the inclination of the main assembly driving shaft 101 with respect to the drum unit. That is, when the cartridge 7 is mounted in the apparatus main assembly, it is easy to maintain the main assembly driving shaft 101 and the drum unit parallel.

By placing the drive receiving surface 73*a* inside the photosensitive drum 1, the shaft portion 101*f* can be inserted into the photosensitive drum 1 and the shaft portion 101*f* can be supported inside the photosensitive drum 1. With this structure, it is easy to assure the length of the main assembly driving shaft 101 (the distance between the supported portion 101*d* and the shaft portion 101*f*) while suppressing the increase in size of the apparatus main assembly.

(Manufacturing Method)

The flange member 70 of this embodiment is manufactured by injection molding (insert molding) using a mold.

Referring to FIG. 17, the structure of a mold used for forming the flange member 70 will be described.

The flange member 70 has a shape in which the flange portion 75 projects outward in the radial direction. In the case of molding such a shape, it is preferable that it is a metal mold as shown in FIG. 17.

More specifically, as shown in the drawing, the metal mold has a two-piece structure including a left mold (cylindrical mold 60) and a right mold (mounting portion mold 61). By combining the left and right molds, a space portion (mold cavity, hollow part) having the same shape as the molded portion is defined. The material is poured into this space and solidified in the mold, so that the flange member 70 is formed. The mold has a mold parting portion 62 (a surface for separating the molds, a surface for combining the molds) which is a portion where the right and left molds are fitted in the neighborhood of the space forming the flange portion 75. And, the cylindrical mold 60 has a space for molding the outer periphery of the cylindrical portion 71. Similarly, the mounting portion side mold 61 has a space for molding the mounting portion 72.

In the case of forming the flange member 70 using such a metal mold, from the standpoint of mass productivity, it is preferable to use a thermoplastic resin. More specifically, POM, PPS, and other materials are suitable. However, in order to satisfy requirements such as strength, other materials may be appropriately selected. More specifically, a thermosetting resin or a metal material may be used.

As described in the foregoing, the engaging portion 73 has an insertion taper 73*d* at one end in the Z direction and a removing taper 73*e* at the other end. Therefore, it is difficult to place the parting portion 62 of the mold on either one of the end surfaces of the engagement portion 73 in the Z direction. When using a mold for dividing into two bodies, if the parting portion 62 is placed on one of the two end surfaces of the engaging portion 73, it is difficult to remove the molded flange member 70 from the mold. That is, this is because when attempting to part the two molds from the engaging portion 73 after the engaging portion 73 is molded, at least one of the molds cannot move due to interfering with the engaging portion 73.

It is easier to manufacture the mold if the mold parting portion 62 is made as straight as possible. By this, it is possible to manufacture the parting portion 62 with high accuracy. By this, if the mold parting portion 62 is made as straight as possible, the possibility of occurrence of resin leakage or the like can be reduced.

In order to make the parting portion 62 of the engaging portion 73 straight, it is necessary to place the drive receiving surface 73*a* at the back side (the Z2 side) of the photosensitive drum unit 30 at least as compared with the insertion taper 73*d*. Under the circumstances, in this embodiment, the end of the insertion taper 73*d* and the end of the drive receiving surface 73*a* are placed at the same position in the Z direction.

In addition, when forming the flange member 70 of this embodiment, the mold parting portion 62 is arranged so as to be as follows. That is, the drive receiving surface 73*a* and the surface of the base portion 74 as seen from the Z2 direction side are formed by the mounting portion side mold 61. In addition, insertion taper 73*d*, and the surface visible from the Z1 direction side of the base 74 are formed by the cylindrical mold 60. As described in the foregoing, the inner side surface of the base side extending portion 74*t* is disposed so as to project to the same diameter as the inner peripheral surface 71R of the cylindrical portion 71 or project toward the inner diameter side. By this it is possible to prevent the base side extending portion 74*t* from interfering with the cylindrical portion side mold 60 and hindering the movement of the cylindrical portion side mold 60.

In addition, as viewing the flange member 70 in the Z direction (as the flange member 70 is seen along the axial direction), it is necessary to dispose the force receiving portion 77 so as not to overlap the engaging portion 73 and the base portion 74, as shown in FIG. 12. That is, as viewing the flange member 70 along the axial direction, it is necessary for the force receiving portion 77 to be disposed spaced apart from the engaging portion 73 and the base portion 74. Considering the thickness of the mold, it is preferable that the force receiving portion 77 is disposed with a gap of about 1 mm from the engaging portion 73 and the base portion 74.

(Aligning Member)

Referring to FIGS. 10, 15, 16, 18, and 19, the structure of the aligning member (positioning member) 33 will be described.

In this embodiment, the aligning member 33 has a recess portion (reverse conical shape 33*a*) narrowed toward the bottom. The inverted conical shape 33*a* is a substantially conical recess (recess) and is disposed on the axis of the drum unit 30. In the axial direction of the drum unit 30, it is arranged inside the drive receiving surface 73*a*. In the following, the detailed shape of the aligning member 33 will be described.

As shown in FIG. 18, the aligning member 33 has an inverted conical shape portion 33*a*, a fitting portion 33*b*, a retaining portion 33*c*, and a backup portion 33*j*.

As shown in FIG. 19, the aligning member 33 is assembled from the Z2 side to the Z1 side of the flange member 70 along the rotation axis, thereby constructing the coupling member 28.

As shown in FIG. 10, the inverted conical shape 33*a* is disposed on the inner side (the Z2 direction side) of the photosensitive drum unit 30 than the engaging portion 73. In addition, the flange member 70 and the aligning member 33 are assembled so that the center of the inverted conical shape 33*a* coincides with the center of the photosensitive drum 1 as viewing the aligning member 33 along the Z direction.

The inverted conical shape 33*a* has an contact portion 33*e* which abuts on the semispherical shape 101*c* at the free end of the main assembly driving shaft 101 when the photosensitive drum 1 is rotationally driven. Here, the inverted conical shape 33*a* has a substantially inverted conical shape (a shape recessed in a substantially conical shape). As shown in FIG. 10, the aligning member 33 is mounted to the flange member 70 so that the center 101*h* of the semispherical shape 101*c* of the main driving shaft 101 is within the range of the drive receiving surface 73*a* in the Z direction in the state that the contact portion 33*e* and the semispherical shape 101*c* are in contact with each other.

The contact portion 33*e* provided in the inverted conical shape 33*a* contacts with the semispherical shape 101*c* of the main assembly driving shaft 101 the drum unit 30 is positioned with respect to the main assembly driving shaft 101.

That is, the inverted conical shape 33*a* can determine the position in the axial direction of the drum unit 30 and the position in the radial direction relative to the main driving shaft 101. That is, the inverted conical shape 33*a* is the radial position determining portion, and it is also the axial direction positioning portion.

Here, the radial positioning portion and the longitudinal positioning portion need not be conical recess such as a recess having the inverted conical shape 33*a*. The shape of the radial position determining portion and the longitudinal direction positioning portion may be of any shape as long as it can determine the position of the photosensitive drum unit 30 with respect to the main assembly driving shaft 101 when it contacts the main assembly driving shaft 101. For example, a recess portion (recess portion) having a portion narrowed toward the bottom portion is preferable. As such a shape, it is also possible to use a polygonal cone shape such as a pyramid (square pyramid and so on) which is not a circular cone. However, as long as it is a conical recess portion that is symmetrical with respect to the axis of the coupling member 28 like the inverted conical shape 33*a* of this embodiment, it is possible to maintain the position of the coupling member 28 (the position of the drum unit 30) with particularly high accuracy.

Here, it will suffice if the inverted conical shape 33*a* has an area for contacting the main assembly driving shaft 101, and therefore, the region not touched may have any shape. For example, the bottom of the inverted conical shape 33*a* which is not in contact with the main driving shaft 101 may not be necessary, it may be bottomless recess of an inverted conical shape 33*a*.

The fitting portion 33*b* is provided for mounting the aligning member 33 to the flange member 70 and as shown in FIG. 10, the flange member 70 has a fitting portion 72*a* at a position corresponding to the fitting portion 33*b*. In addition, the fitting portion 33*b* is provided on the inner side (the Z2 direction side) of the photosensitive drum unit 30 than the contact portion 33*e*.

As shown in FIG. 18, the retaining portion 33*c* has a hook shape, thereby preventing the aligning member 33 from dropping off the flange member 70. In addition, as shown in FIG. 11, the flange member 70 has a hole shape 72*b* at a position corresponding to the regaining portion 33*c*.

As shown in FIG. 15, the backup portion 33*j* is assembled in a gap between the backed-up surface 74*i* of the flange member 70 and the receiving surface 77*a*, and it has a shape which is effective to prevent the engagement portion 73 from tilting toward the upstream side in the rotational direction. Therefore, the thickness of the backup portion 33*j* is substantially the same as the gap between the backed-up surface 74*i* and the receiving surface 77*a*.

That is, the backup portion 33*j* restrains the engagement portion 73 (the drive receiving surface 73*a*) from moving in the circumferential direction of the flange member 70 by contacting the backed-up surface 74*i*. The aligning member 33 is a backup member including a backup portion 33*j*.

The aligning member 33 is also a positioning member for determining the relative position of the flange member 70 (the drum unit 30) with respect to the main driving shaft 101. The recessed portion (inverted conical shape 33*a*) provided in the aligning member 33 contacts the free end of the main assembly driving shaft 101 as a positioning portion. By this, the relative position in the axial direction and the relative position in the radial direction of the flange member 70 are both determined with respect to the main assembly driving shaft 101.

In addition, as viewed in the Z direction, the center of the circle passing through the ridge line of the engaging portion 73 side of the backup portion 33*j* is the same as the center of the inverted conical shape 33*a*, and the diameter of the circle is D8. The diameter D8 is selected so as to be approximately the same as the outer diameter D5 of shaft portion 101*f* of main assembly driving shaft 101 or so as to satisfy D8≥D5 in view of dimensional accuracy thereof. In addition, as shown in FIG. 16, the backup portion 33*j* is disposed so as to overlap the drive receiving surface 73*a* in the Z direction.

[Mounting of Cartridge to Image Forming Apparatus Main Assembly]

Figure 20:
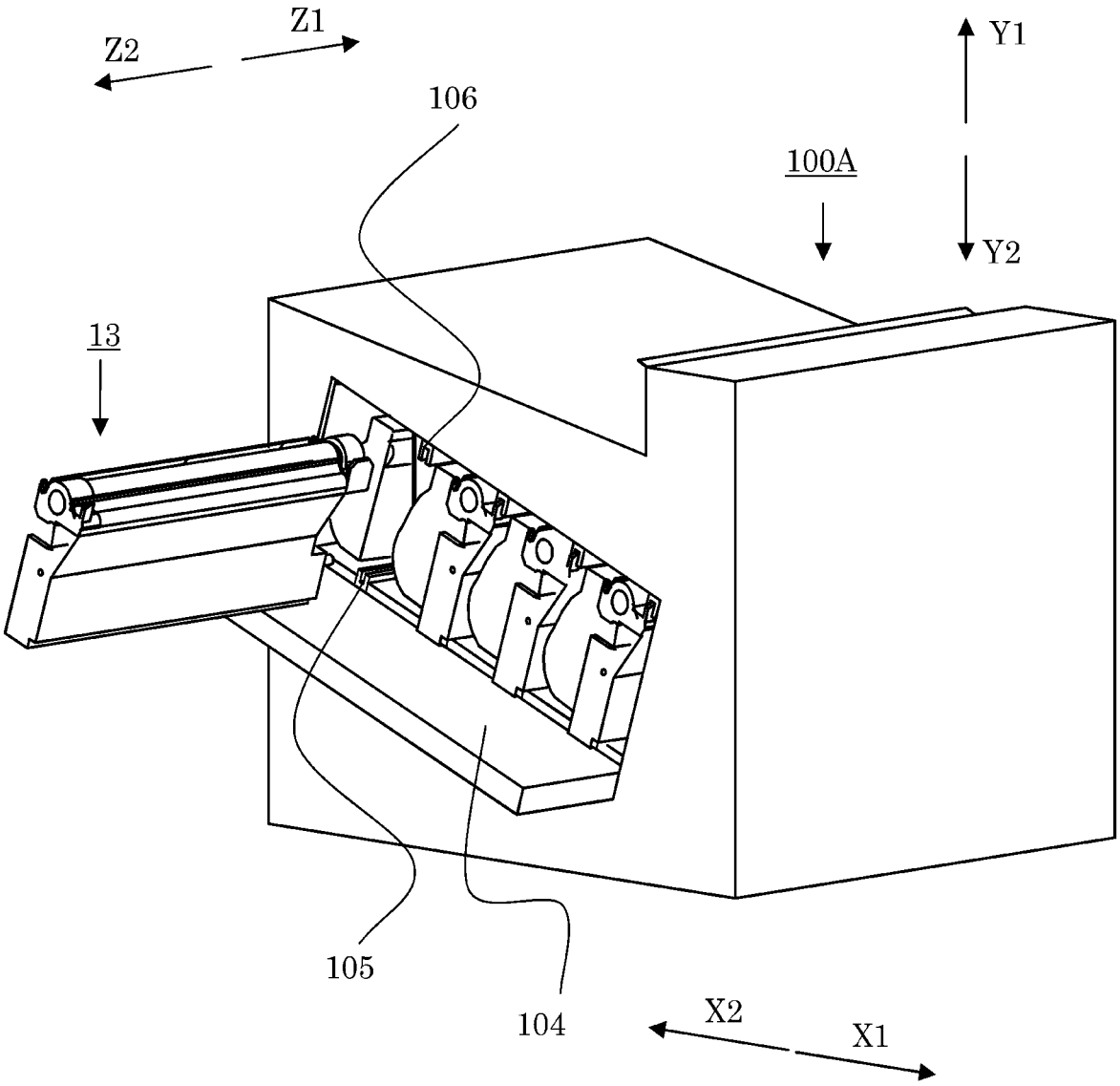
FIG. 20 is a perspective view illustrating the mounting of the drum cartridge 13 to the image forming apparatus main assembly 100A.

Referring to FIGS. 20 and 21, mounting and dismounting of the drum cartridge 13 to and from the image forming apparatus main assembly will be described.

FIG. 20 is a perspective view illustrating the mounting of the drum cartridge 13 to the image forming apparatus main assembly 100A.

FIG. 21 is a cross-sectional view illustrating the mounting operation of the drum cartridge 13 to the image forming apparatus main assembly 100A.

The image forming apparatus main assembly 100A of this embodiment employs a structure capable of mounting a cartridge in a substantially horizontal direction. More specifically, the image forming apparatus main assembly 100A includes therein a space in which a cartridge can be mounted. And, there is provided a cartridge door 104 (front door) for inserting the cartridge into the above space on the front side (the side on which the user stands in use) of the image forming apparatus main assembly 100A.

As shown in FIG. 20, the cartridge door 104 of the image forming apparatus main assembly 100A is openable and closable. As will be seen when the cartridge door 104 is opened, there are provided a lower cartridge guide rail 105 for guiding the drum cartridge 13 is disposed on the bottom surface of the space and an upper cartridge guide rail 106 is disposed on the upper surface. The drum cartridge 13 is guided to the mounting position by the upper and lower guide rails (105, 106) provided above and below the aforementioned space. The drum cartridge 13 is inserted into the mounting position substantially along the axis line of the photosensitive drum unit 30.

Referring to FIG. 21, the operation of mounting and dismounting the cartridge to the image forming apparatus main assembly 100A will be described.

As shown in part (a) of FIG. 21, the drum unit bearing member 39R and the photosensitive drum 1 do not contact the intermediary transfer belt 5 at the start of insertion of the drum cartridge 13. In other words, the dimensions are selected such that the photosensitive drum 1 and the intermediary transfer belt 5 do not come in contact with each other in the state that the end portion on the far side in the inserting direction of the drum cartridge 13 is supported by the lower cartridge guide rail 105.

As shown in part (b) of FIG. 21, the image forming apparatus main assembly 100A includes a rear side lower cartridge guide 107 that projects upward with respect to the direction of gravity from the lower cartridge guide rail 105 on the rear side in the inserting direction of the lower cartridge guide rail 105. The rear side lower cartridge guide 107 has a tapered surface 107*a* on the upstream side in the inserting direction of the drum cartridge 13. With the insertion, the drum cartridge 13 rides on the tapered surface 107*a* and is guided to the mounting position.

Here, the position and shape of the rear side lower cartridge guide 107 are selected so that a portion of the cartridge does not rub against the image forming area 5A of the intermediary transfer belt 5 when inserting the cartridge into the apparatus main assembly 100A. Here, the image forming area 5A is a region where a toner image to be transferred onto the recording material 12 of the intermediary transfer belt 5 is carried. In addition, in this embodiment, in the cartridge maintaining the mounting attitude, the unit bearing member 39R provided on the downstream side in the inserting direction of the drum cartridge 13 projects most upward with respect to the direction of gravity. Therefore, arrangement and shape of each element are appropriately selected so that the trace (hereinafter referred to as insertion trace) drawn when the end of the drum unit bearing member 39R, which is the deepest in the inserting direction, is inserted, does not interfere with the image forming area 5A.

Thereafter, as shown in part (c) of FIG. 21, the drum cartridge 13 is inserted further into the back side of the image forming apparatus main assembly 100A from a state in which it rides on the rear side lower cartridge guide 107. And, the drum unit bearing member 39R abuts against the rear cartridge positioning portion 108 provided in the image forming apparatus main assembly 100A. At this time, the drum cartridge 13 (the photosensitive drum unit 30) is in a state of being inclined by about 0.5 to 2° with respect to those in the state of completion of mounting in the image forming apparatus main assembly 100A (part (d) of FIG. 21). That is, the downstream side of the drum cartridge 13 (photosensitive drum unit 30) is higher than the upstream side in the direction of inserting the drum cartridge 13.

Part (d) of FIG. 21 shows the state of the apparatus main assembly and the cartridge in a state where the cartridge door 104 is closed. The image forming apparatus 100A has a front side lower cartridge guide 109 on the upstream side, in the inserting direction, of the lower cartridge guide rail 105. The structure is such that the front side lower cartridge guide 109 moves up and down in interrelation with the opening and closing of the cartridge door (front door) 104.

When the user closes the cartridge door 104, the front side lower cartridge guide 109 is raised. And, the drum unit bearing member 39L and the front side cartridge positioning portion 110 of the image forming apparatus main assembly 100A come into contact with each other, whereby the drum cartridge 13 is positioned relative to the image forming apparatus main assembly 100A.

With the above operation, the mounting of the drum cartridge 13 to the image forming apparatus main assembly 100A is completed.

In addition, removal of the drum cartridge 13 from the image forming apparatus main assembly 100A is in the reverse order of the above-described inserting operation.

As described above, oblique mounting structure is employed, and therefore, it is possible to suppress rubbing between the photosensitive drum and the intermediary transfer belt when the drum cartridge 13 is mounted in the apparatus main assembly 100A. Therefore, it is possible to suppress the occurrence of fine scratches on the surface of the photosensitive drum or the surface of the intermediary transfer belt.

In addition, according to the structure disclosed in this embodiment, the structure of the image forming apparatus main assembly 100A can be simplified compared to the structure in which the entire cartridge is lifted up after mounting the cartridge by horizontally moving the cartridge in the main assembly of the apparatus.

[Engaging Process of Coupling Member to Main Assembly Shaft]

Referring to FIGS. 22 and 23, a process of engaging the coupling member 28 and the main assembly driving shaft 101 will be described in detail.

FIG. 22 is a cross-sectional view illustrating the mounting operation of the coupling member 28 to the main assembly driving shaft 101.

FIG. 23 is a sectional view illustrating the mounting operation of the coupling member 28 to the main assembly driving shaft 101, when the main assembly driving shaft 101 rotates from the state in which the main assembly drive transmission groove 101*a* and the engagement portion 73 (the drive receiving surface 73*a*) are out of phase to the state in which they are in phase.

Part (a) of FIG. 22 illustrates a state in which the coupling member 28 starts engaging with the main assembly driving shaft 101. In addition, part (e) of FIG. 22 shows a state in which the drum cartridge 13 is mounted to the image forming apparatus main assembly 100A. In particular, part (e) of FIG. 23 shows a state in which the front-side lower cartridge guide 109 is raised, and in this state, as the cartridge door 104 closes, the drum cartridge 13 is positioned relative to the image forming apparatus main assembly 100A.

Here, parts (b) to (d) of FIG. 22 illustrate the process of mounting the coupling member 28 and the main assembly driving shaft 101 between part (a) of FIG. 22 and part (e) of FIG. 22. Here, the main driving shaft 101 is in a lower position in the direction of gravity by a small angle due to its own weight.

In addition, part (a) of FIG. 23 illustrates a state where the phases of the main assembly drive transmission groove 101*a* and the engagement portion 73 (the drive receiving surface 73*a*) are not aligned.

As described using part (b) of FIG. 21, the drum cartridge 13 rides on the rear-side lower cartridge guide 107. That is, the drum cartridge 13 becomes in a state of being inclined by about 0.5 to 2° while gradually increasing the inclination angle from the state of part (a) of FIG. 21 to the state of part (b) of FIG. 21. And, the drum cartridge 13 rides on the rear side lower cartridge guide 107.

Similarly, as shown in part (a) of FIG. 22, the coupling member 28 is inserted toward the main assembly driving shaft 101 in a state inclined by about 0.5 to 2 degrees compared to the state (see part (e) of FIG. 22) in which the drum cartridge 13 is positioned in place relative to the image forming apparatus main assembly 100A.

As shown in FIG. 6, the main assembly driving shaft 101 is cantilevered at the supported portion 101*d*. In addition, the gear portion 101*e* meshes with a gear (not shown) for transmitting the drive to the gear portion 101*e*. Part (a) of FIG. 22 shows the main assembly driving shaft 101 in a state where it does not contact the coupling member 28. In this state, it tilts by an angle θ1 with respect to the direction determined by the self weight and the mating direction with respect to the bearings 101*d* as the rotation center compared to the state in which the drum cartridge 13 is positioned in place with respect to the image forming apparatus main assembly 100A (shown in part (e) of FIG. 22).

As shown in part (b) of FIG. 22, the free end of the inner peripheral surface 71*b* of the cylindrical portion 71 of the coupling member 28 first contacts the rough guide portion 101*g* of the main assembly driving shaft 101. As shown, the main assembly driving shaft 101 is cantilevered in the supported portion 101*d*. Therefore, the rough guide portion 101*g* of the main assembly driving shaft 101 is inserted into the main assembly driving shaft 101 in a state where it follows the inner peripheral surface 71*b* of the coupling member 28. As described in the foregoing, in the Z direction, the engaging portion 73 is formed so that the distance L1 from the front end surface of the cylindrical portion 71 to the front end surface of the engaging portion 73 and the length L2 of the drive receiving surface 73 satisfy the relationship of L1>L2 (FIG. 14). For this reason, the rough guide portion 101*g* of the main assembly driving shaft 101 follows the inner peripheral surface 71*b* of the coupling member 28 before the semispherical shape 101*c* at the free end of the main assembly driving shaft 101 abuts to the engaging portion 73. By this, the main assembly driving shaft 101 is guided with respect to the coupling member 28. By this, the semispherical shape 101*c* at the free end of the main assembly driving shaft 101 can be prevented from being damaged by abutting against the unexpected portion of the engaging portion 73 or the base portion 74.

As shown in part (c) of FIG. 22, when the coupling member 28 is further inserted from the part (b) of FIG. 22 toward the rear side of the main assembly driving shaft 101, the insertion tapered surface 73*d* of the engaging portion 73 and the semispherical shape 101*c* at the free end of the main assembly driving shaft 101 come into contact with each other. Due to the inclined surface of the insertion tapered surface 73*d* and the spherical shape of the semispherical shape 101*c*, the main assembly driving shaft 101 is guided to the substantially central portion of the three engagement portions 73.

Furthermore, when the coupling member 28 is inserted into the main assembly driving shaft 101, the base portion 74 elastically deforms radially outward so that the engaging portion 73 follows the semispherical shape 101*c*. As a result, as shown in part (a) of FIG. 23, the engaging portion 73 moves (retracts) to the outer diameter portion of the shaft portion 101*f* of the main assembly driving shaft 101. As shown in part (d) of FIG. 22, with this movement, the coupling member 28 is mounted to the main assembly driving shaft 101 until the removing tapered surface 73*e* of the engaging portion 73 reaches the rear side in the Z direction from the main assembly side removing taper 101*i* of the main assembly driving shaft 101. As described in the foregoing, the base portion 74 has the base side extending portion 74*t* and the folded portion 74*r* which can be elastically deformed. When the engaging portion 73 moves radially outward, the base portion 74*t* and the folded portion 74*r* of the base portion 74 are elastically deformed, respectively, and therefore, it becomes deformable radially outwardly with a smaller force as compared with a structure in which only the base side extending portion 74*t* is elastically deformed. Therefore, the mounting force of the drum cartridge 13 to the image forming apparatus main assembly 100A can be low.

In addition, since the base portion 74 is provided with the folded portion 74*r*, the base portion 74 can be provided in a limited space in the Z direction.

As described above, the mounting force of the drum cartridge 13 to the image forming apparatus main assembly 100A can be suppressed low without increasing the size of the flange member 70 in the Z2 direction.

Thereafter, as described above, the drum cartridge 13 is lifted so that the drum unit bearing member 39L of the drum cartridge 13 abuts against the front side cartridge positioning portion 110. By lifting the drum cartridge 13, the drum cartridge 13 is positioned relative to the image forming apparatus main assembly 100A (as shown in part (d) of FIG. 21). As shown in part (e) of FIG. 22, by the operation of the drum cartridge 13, the inclination of the coupling member 28 is eliminated.

And, when the main assembly driving shaft 101 rotates, as shown in part (b) of FIG. 23, the main assembly drive transmission groove 101*a* and the engagement portion 73 becomes in phase. By this, at least a part of the elastic deformation of the base portion 74 is eliminated, and a part of the engagement portion 73 enters the main assembly drive transmission groove 101*a*, and then the coupling member 28 and the main assembly driving shaft 101 are brought into engagement with each other.

Here, when the phases of the main assembly drive transmission groove 101*a* and the engagement portion 73 are matched, the elastic deformation of the base portion 74 is canceled at the stage of part (d) of FIG. 22, and the state of part (b) of FIG. 23 is reached so that the driving force of the main assembly driving shaft 101 can be transmitted to the drum cartridge 13 by way of the coupling member 28.

As explained above, as the drum cartridge 13 is mounted to the apparatus main assembly 100A, the main assembly drive transmission groove 101*a* and the engagement portion 73 can be engaged with each other. Therefore, it is unnecessary to move the main assembly driving shaft 101 in order to engage with the coupling member 28. That is, it is unnecessary to provide a mechanism, in the main assembly 100A of the image forming apparatus, for moving the main assembly driving shaft 101 so as to engage with the coupling member 28. In addition, a mechanism for engaging the main assembly driving shaft 101 with the coupling member 28 after mounting the drum cartridge 13 to the image forming apparatus main assembly 100A can be omitted from the apparatus main assembly 100A.

Here, when the drum cartridge 13 is mounted to the apparatus main assembly 100A, the engaging portion 73 of the coupling member 28 is retracted radially outward by contacting the main assembly driving shaft 101. And, the engagement portion 73 is constituted to engage with a groove (main assembly drive transmission groove 101*a*) of the main assembly driving shaft 101 by moving inward in the radial direction.

Here, it is also possible to provide a groove for receiving drive on the coupling member, and to provide a movable portion capable of engaging with the groove by moving in the radial direction on the driving shaft 101 side. However, as compared with the drum cartridge 13, the image forming apparatus main assembly 100A is required to have higher durability. It is preferable to provide a movable portion (engaging portion 73) that moves in the radial direction on the coupling member 28 side of the drum cartridge 13 as in this embodiment, from the stand point of enhancing the durability of the image forming apparatus main assembly 100A.

[Drive of Coupling Member by Main Assembly Driving Shaft]

Referring to FIG. 15, the transmission of the rotational drive from the main driving shaft 101 to the coupling member 28 will be described.

When the drive receiving surface 73*a* of the coupling member 28 comes in contact with the main assembly drive transmission surface 101*b*, the cleaning blade 26, the charging roller 22, and so on apply a load to the photosensitive drum unit 30. That is, the drive receiving surface 73*a* rotates integrally with the driving transmission surface 101*b* while receiving the load (driving force) F1.

This driving force F1 received by the drive receiving surface 73*a* can be divided into a component Fv in a direction perpendicular to the backed-up surface 74*i* and a component Fh in a direction parallel to the backed-up surface 74*i*, because the angle J formed by the backed-up surface 74*i* and the drive receiving surface 73*a* is an acute angle. As shown in FIG. 15, the component in the vertical direction Fv is transmitted to the backed-up surface 74*i* opposite to the drive receiving surface 73*a* of the engaging portion 73. The engaging portion 73 is backed up by the mounting portion 72 by way of the backup portion 33*j* and the rib 77*e*, and therefore, the engaging portion 73 substantially does not deform toward the downstream side in the rotational direction.

Also, when the engaging portion 73 receives the component Fv in the parallel direction, the contact surface 74*h* comes into contact with the shaft portion 101*f* of the main assembly driving shaft 101, and the engaging portion 73 is backed up.

By the force component Fv parallel to the backed-up surface 74*i*, the engaging portion 73 (the drive receiving surface 73*a*) is urged radially inward toward the inside of the drive transmission groove 101*a*.

That is, the backup surface 33*t* of the backup portion 33*j* and the backed-up surface 74*i* are inclined relative to the drive receiving surface 73*a*. By this, when the drive receiving surface 73*a* receives a force from the drive transmission groove 101*a* of the main assembly driving shaft 101 and the backed-up surface 74*i* comes into contact with the backup surface 33*t*, the engaging portion 73 moves radially inward along the backup surface 33*t*. That is, since the backup surface 33*t* and the backed-up surface 74*i* are inclined with respect to the drive receiving surface 73*a*, the force urging the engaging portion 73 in the radially inward direction is produced when the backup surface 33*t* and the backed-up surface 74*i* contact with each other.

In the cross-section of FIG. 15, a straight line extending along the drive receiving surface 73*a* and a straight line extending along the backup surface 33*t* intersects at an outside of the driving force receiving surface 73*a* in the radial direction of the coupling member.

Further, in the radial direction of the coupling member 28, the backup surface 33*t* is inclined so that inner diameter side thereof is on the downstream side of the outer diameter side in the rotational direction. This also applies to the backed-up surface 74*i*.

The driving force receiving surface 73*a* provided in the engaging portion 73 is an inclined portion inclined relative to the moving direction of the engaging portion 73. The engaging portion 73 is movable so as to retract outward in the radial direction of the coupling member 28, but the driving force receiving surface 73*a* is inclined with respect to the direction.

In other words, in the state that the driving force receiving surface 73*a* is in contact with the drive transmission groove

101*a*, the drive receiving surface 73*a* is inclined so that the drive receiving surface 73*a* bites into the driving transmission groove 101*a*. For these reasons, in a state in which the drive receiving surface 73*a* is receiving the driving force from the driving transmission groove 101*a*, it is difficult for the engagement portion 73 to retreat from the drive transmission groove 101*a*. The engagement state between the engagement portion 73 and the drive transmission groove 101*a* is stabilized.

More particularly, on the drive receiving surface 73*a*, the inner diameter side (free end side) of the coupling member 28 is provided on the upstream side of the outer diameter side (rear end side) in the rotational direction of the coupling member 28. That is, the drive receiving surface 73*a* is inclined so as to face outside at least in the radial direction of the coupling member 28. That is, the normal vector extending perpendicularly to the drive receiving surface 73*a* and facing the drive receiving surface 73*a* has a component directed outward in the radial direction.

Therefore, when the coupling member 28 (the photosensitive drum unit 30) rotates, the force received by the drive receiving surface 73*a* acts in a direction to engage the engaging portion 73 with the main assembly drive transmission groove 101*a*. That is, the engaging portion 73 is urged inward in the radial direction by the driving force received by the drive receiving surface 73*a*. By this, the engagement state between the engagement portion 73 and the main assembly drive transmission groove 101*a* is stabilized and the disengagement between the engagement portion 73 and the main assembly drive transmission groove 101*a* is suppressed.

By the above-described structure, the drive receiving surface 73*a* can be stably brought into contact with the main assembly drive receiving surface 101*a* and the photosensitive drum unit 30 can be retracted to the side of the main assembly driving shaft 101 to be held by the bearing portion 101*d*. In addition, even if the load F1 fluctuates, the engaging portion 73 is backed up as described above, and therefore, deformation of the engaging portion is suppressed. Therefore, the rotation amount of the photosensitive drum 1 does not substantially change, and as a result, the quality of the image can be maintained.

Here, in this embodiment, the backup portion 33*i* is provided in the aligning member (positioning member) 33. However, the backup portion 33*i* may be provided on a member different from the aligning member 33.

That is, the backup portion 33*i* may be provided in a member different from the positioning portion (reverse conical shape 33*a*) for positioning the drum unit 30 with respect to the main assembly driving shaft 101.

[Removal of Coupling Member from Main Assembly Drive Shaft]

Referring to FIG. 24, the removal operation of the coupling member 28 from the main driving shaft 101 will be described.

FIG. 24 is a cross-sectional view illustrating the removal operation of the coupling member 28 from the main assembly driving shaft 101.

As shown in part (a) of FIG. 24, when the rotation drive of the main assembly driving shaft 101 is stopped, the drive receiving surface 73*a* and the main assembly drive transmission surface 101*b* are in contact with each other. In this state, a portion of the engagement portion 73 enters the main assembly drive transmission groove 101*a*.

When the cartridge door 104 opens, the front-side lower cartridge guide 109 lowers, and the drum unit bearing member 39L separates from the front side cartridge positioning portion 110 of the image forming apparatus main assembly 100A. At this time, as shown in part (b) of FIG. 24, the coupling member 28 and the main assembly driving shaft 101 are inclined by about 0.5 to 2° relative to the mounting complete state (Z direction).

As shown in part (c) of FIG. 24, when removing the drum cartridge 13 from the image forming apparatus main assembly 100A, the removing tapered surface 73*e* of the engaging portion 73 abuts against the main assembly side removing taper 101*i*. As the removing tapered surface 73*e* abuts against the main assembly side removing taper 101*i*, the base portion 74 begins to elastically deform and moves the engaging portion 73 along the main assembly side removing taper 101*i* radially outward.

Furthermore, when the coupling member 28 is removed from the main assembly driving shaft 101, the base portion 74 is further elastically deformed to move the engaging portion 73 to the outer diameter of the shaft portion 101*f* of the main assembly driving shaft 101. As shown in part (d) of FIG. 24, by moving the engaging portion 73 to the outer diameter of the shaft portion 101*f*, the coupling member 28 can be removed from the main assembly driving shaft 101.

Furthermore, as shown in part (e) of FIG. 24, when the coupling member 28 is removed from the main assembly driving shaft 101, the elastic deformation of the base portion 74 is released and the position of the engaging portion 73 also returns to the position which is taken before the elastic deformation.

As described in the foregoing, when the coupling member of this embodiment is used, it is possible to suppress the size increase of the flange member 70 in the Z2 direction. And, it is possible to suppress the mounting force of the drum cartridge 13 to the image forming apparatus main assembly 100A, suppress the change in the rotation amount of the photosensitive drum 1, and maintain the image quality.

In addition, in this embodiment, in the base portion 74, one folded portion 74*r* is provided at each position, but it is also possible to use a structure including a plurality of folded portions 74*r* as long as it can be arranged in the space of the inner peripheral surface 72*m* of the coupling member 28.

For example, it is also possible that the following structures are sequentially arranged from the fixed end of the base portion 74 toward the free end. That is, it comprises (1) an extending portion extending inward in the axial direction, (2) a folded-back portion, (3) an extending portion extending outward in the axial direction, (4) a folded-back portion, (5) a extension which extends inward. In such a case, the base 74 has three extended portions and has an S-shape. Either in the case of one folded portion or in the case of two or more folded portions, the base portion 74 has at least first extending portions and second extending portions extending in mutually different directions in the axial direction. In this example shown in FIG. 13, FIG. 14, and so on, one of the root side extending portion 74*t* and the free end side extending portion 74*s* extending in mutually different directions corresponds to the first extending portion, and the other corresponds to the second extending portion.

For example, when the free end side extending portion 74*s* disposed on the most free end side of the supporting portion is the first extending portion, the base side extending portion 74*t* connected thereto is the second extending portion. In this case, the first extending portion (74*s*) extends from the second extending portion (74*t*) toward the free end of the supporting portion the second extending portion (74*t*)

may be said to extend from the fixed end of the supporting portion toward the first extending portion (74*s*).

Embodiment 2

Referring to FIGS. 25 to 30, Embodiment 2 will be described. FIG. 25 is a cross-sectional view of the coupling member 128 according to this embodiment, taken along the center of the rotation axis (center of rotation axis)

FIG. 26 is a cross-sectional view of the coupling member 128 and the main assembly driving shaft 101 according to this embodiment taken along a direction perpendicular to the rotation axis at a position passing through the drive receiving surface 73*a*.

FIG. 27 is a view of the flange member 170 according to this embodiment as viewed from the Z direction, and a cross sectional view thereof.

FIG. 28 is a view of the inner cylindrical member 140 according to this example as viewed from the Z1 side to the Z2 side, and a side view thereof.

FIG. 29 is an explanatory sectional view illustrating a procedure of assembling the coupling member 128 according to this embodiment.

FIG. 30 is a view of the procedure of assembling the coupling member 128 according to this embodiment as viewed from the outer side in the Z direction and from the side.

When the elements of this embodiment correspond to the elements described in Embodiment 1, the same names are given. The elements, functions and the like which are different from the elements of the embodiment described above will be described in detail with respect to such elements, and the description of the same points as those described above may be omitted in some cases.

Elements which are substantially equivalent to the elements of the above-described embodiments are denoted by the same reference numerals and characters in addition to the same names, and a detailed description thereof will be omitted.

In Embodiment 1, the coupling member 28 comprises two portions of the flange member 70 and the aligning member 33. In this example, as shown in FIG. 25, the coupling member 128 comprises the flange member 170 and the inner cylindrical member 140.

More specifically, as shown in FIG. 27, the flange member 170 includes a mounting portion 172, a cylindrical portion 171, a flange portion 175, a force receiving portion 177, a centering portion 133*a*, and a cylindrical member pressing portion 178. As shown in FIG. 28, the inner cylindrical member 140 includes a base portion 174, an engaging portion 173, a fitting portion 140*a*, a retaining portion 140*b*, and a rotation stopper portion 140*c*.

The base portion 174 and the engaging portion 173 form a supporting portion for supporting the driving force receiving portion (the drive receiving surface 173*a*), similarly to the base portion 74 and the engaging portion 73 of Embodiment 1. This support portion (174, 173) is a snap fit portion with a U shape. The inner cylindrical member 140 is a driving force receiving member for receiving the driving force from the apparatus main assembly by the drive receiving surface 173*a* (FIG. 28) provided in the engaging portion 173.

The flange member 170 is a member to be transmitted (transmitted member) to which the driving force is transmitted from the inner cylindrical member 140.

(Flange Member)

As described in the foregoing, as shown in FIG. 27, the flange member 170 includes a mounting portion 172, a cylindrical portion 171, a flange portion 175, a force receiving portion 177, an inverted conical shape 133*a*, and a cylindrical member pressing portion 178.

The mounting portion 172 is a portion to be mounted to the photosensitive drum 1, similarly to the mounting portion 72 of Embodiment 1. The mounting portion 172 is adhered to the inner periphery of the photosensitive drum 1 or press-fitted to the inner periphery of the photosensitive drum 1.

The cylindrical portion 171 is provided with a bearing portion equivalent to that of the bearing receiving portion 71*c* of Embodiment 1, and is rotatably supported by the drum unit bearing member 39R in this portion to be supported.

The flange portion 175 has a shape for determining the positions of the photosensitive drum 1 and the coupling member 128 in the Z direction, similarly to Embodiment 1.

The force receiving portion 177 is in contact with a backed-up surface 174*i* of an inner cylinder to be described hereinafter and has a shape for preventing the engaging portion 173 from being deformed toward the downstream side in the rotational direction when the coupling member 128 is driven by the main assembly driving shaft 101. Therefore, in the state of the coupling member 128, it is disposed on the downstream side in the rotational direction of the engaging portion 173.

The force receiving portion 177 is provided with a receiving surface 177*a* which is parallel to the backed-up surface 174*i* and abuts against the backed-up surface 174*i* a rib 177*e* which is perpendicular to the receiving surface 177*a* and extends from the inner diameter end of the receiving surface to the mounting portion 172. The receiving surface 177*a* is a backup portion which suppresses the movement of the engaging portion 173 (the drive receiving surface 173*a*) in the circumferential direction of the coupling member 128. The flange member 170 is a backup member including a backup portion (receiving surface 177*a*).

Furthermore, by the receiving surface 177*a* coming into contact with the backed-up surface 174*i*, it receives the driving force from the inner cylindrical member 140. That is, the driving force received by the drive receiving surface 173*a* of the engaging portion 173 from the apparatus main assembly is transmitted from the inner cylindrical member 140 to the cylindrical member 170 by way of the backed-up surface 174*i* and the receiving surface 177*a*. The receiving surface 177*a* is also a transmitted portion for transmitting the driving force from the inner cylindrical member 140.

The inverted conical shape portion 133*a* has a substantially inverted conical shape as in Embodiment 1. It is provided on the flange member 170 so that the center 101*h* of the semispherical shape 101*c* of the main assembly driving shaft 101 is within the range of the drive receiving surface 173*a* with the abutting portion 133*e* and the semispherical shape 101*c* in contact with each other.

The cylindrical member pressing portion 178 is a gap provided on the back side (Z2 side) of the force receiving portion 177.

As shown in FIG. 25, the radius R19 of the portion corresponding to the engaging portion 173 in the radial direction of the inner peripheral surface 172*m* of the mounting portion 172 is larger than the radius R12 of the inner peripheral surface 171*b* of the cylindrical portion 171.

(Inner Cylinder)

As described in the foregoing, the inner cylindrical member 140 is provided with a base portion 174 of the supporting portion, an engaging portion 173 of the supporting portion, a fitting portion 140*a*, a retaining portion 140*b*, and a rotation stopper portion 140*c* (FIG. 28).

The engaging portion 173 has a drive receiving surface 173*a* as in Embodiment 1.

The base portion 174 is provided with a base side extending portion 174*t*, a folded portion 174*r*, and a free end side extending portion 174*s* similarly to Embodiment 1. The free end side extending portion 174*s* is provided with a backed-up surface 174*i* and a contact surface 174*h*.

In this embodiment, the base side extending portion 174*t* and the free end side extending portion 174*s* extend in the direction opposite to the extending direction of the root side extending portion 74*t* and the free end side extending portion 74*s* of Embodiment 1.

The base side extending portion 174*t* extends from the base portion 174*a* in the Z1 direction (outside in the drum unit axial direction) substantially in parallel with the rotation axis of the flange member 170 and is disposed radially outward with respect to the base side extending portion 174*s* and the engaging portion 173.

The folded portion 174*r* is a bent portion which continuously connects the fixed end side of the base side extending portion 174*s* and the free end side of the base side extending portion 174*t* with each other.

The base side extending portion 174*s* is provided with an engaging portion 173 substantially over its entire area. The engaging portion 173 is a projection portion of the base side extending portion 174*s*, and a drive force receiving portion (drive receiving surface 173*a*) is provided in the engaging portion 173.

In the base portion 174, each of the base side extending portion 174*t* and the folded portion 174*r* is elastically deformed. It is possible to deform radially outward with smaller force than in the structure where only the base side extending portion 174*t* is elastically deformed. This is the same as in Embodiment 1.

Both of the free end side of the engaging portion 173 (the free end side of the free end extending portion 174*s*) and the base portion 174*a* of the base portion 174 are disposed on the Z2 side of the folded portion 174*r*.

The fitting portion 140*a* is disposed in the rear side of the base portion 174 and the engaging portion 173 and is fitted to the outer peripheral face of the aligning portion 133*a*, thereby adjusting the center of the flange member 170 and the inner cylindrical member 140 with high accuracy.

The retaining portion 140*b* prevents disengagement of the inner cylindrical member 140 from the flange member 170. More specifically, after the inner cylindrical member 140 is incorporated in the flange member 170, it is inserted into the cylindrical member pressing portion 178 to prevent disengagement. As shown in part (a) of FIG. 29, the retaining portion 140*b* is provided with a relief portion 140*d* in order to avoid interference with the force receiving portion 177 of the flange member 170 on the upstream side in the rotational direction, in a state (part (b) of FIG. 29) in which the flange member 170 is incorporated in the inner cylindrical member 140.

The rotation stopper portion 140*c* regulates rotation of the inner cylindrical member 140 in the rotational direction toward upstream side, after the inner cylindrical member 140 is incorporated in the flange member 170, thereby preventing the retaining portion 140*b* from being disengaged from the cylindrical member pressing portion 178. As shown in part (B) of FIG. 28, it has a snap-fit shape.

(Assembling of Coupling Member)

As described in the foregoing, the coupling member 128 has a flange member 170 and an inner cylindrical member 140. Referring to FIG. 29, FIG. 30, assembling of the coupling member 128 will be described.

Part (c) of FIG. 29 and part (c) of FIG. 30 show assembling completion states of the coupling member 128, respectively.

First, as shown in part (a) of FIG. 29 and part (a) of FIG. 30, the coupling member 128 is assembled to the flange member 170 such that the inner cylindrical member 140 is oriented in the direction from the Z1 side to the Z2 side. At this time, the inner cylindrical member 140 is assembled with a phase on the upstream side in the rotational direction of the coupling member 128 with respect to the assembled state shown in part (c) of FIG. 29 and part (c) of FIG. 30. In this phase, the relief portion 140*d* of the retaining portion 140*b* is in phase with the force receiving portion 177. For this reason, as shown in part (b) of FIG. 29 and part (b) of FIG. 30, in the Z direction, the retaining portion 140*b* is assembled to the same position as the cylindrical member pressing portion 178 which is a gap provided on the back side of the force receiving portion 177. At this time, by fitting the fitting portion 140*a* of the inner cylindrical member 140 to the outer periphery of the inverted conical shape 133*a* of the flange member 170, the center of rotation of the flange member 170 and the inner cylindrical member 140 can be aligned with high precision. In addition, at this time, the rotation stopper portion 140*c* including the snap fit shape is in a deflected state.

Thereafter, as shown in part (c) of FIG. 29 and part (c) of FIG. 30, the inner cylindrical member 140 is rotated to the downstream side in the rotational direction with respect to the flange member 170. With this rotation, the backed-up surface 174*i* of the engaging portion 173 of the inner cylindrical member 140 can contact the receiving surface 177*a* of the force receiving portion 177 of the flange member 170. In addition, at this time, the deflection of the rotation stopper 140*c* including the snap fit shape is released and the mounting of the inner cylindrical member 140 to the flange member 170 is completed.

That is, the movement in the rotational direction of the inner cylindrical member 140 with respect to the flange member 170 is restricted. That is, the inner cylindrical member 140 can rotate within the range until the backed-up surface 174*i* comes into contact with the receiving surface 177*a* on the downstream side in the rotational direction. On the upstream side in the rotational direction, the inner cylindrical member 140 can rotate in a range until the rotation stopper portion 140*c* comes into contact with the flange member 170.

[Driving of Coupling Member by Main Assembly Driving Shaft]

Referring to FIG. 26, the transmission of rotational drive from the main driving shaft 101 to the coupling member 128 will be described.

When the drive receiving surface 173*a* of the coupling member 128 comes in contact with the main assembly drive transmission surface 101*b*, the drive receiving surface 173*a* rotates integrally with the driving transmission surface 101*b* while receiving the load (driving force) F1 as in Example 1.

When this drive force F1 is received by the drive receiving surface 173*a*, the angle J formed by the backed-up surface 174*i* and the drive receiving surface 173*a* is an acute angle, and therefore, the driving force F1 can be divided into a component Fv in the direction perpendicular to the backed-up surface 174*i* and a component Fh in the horizontal direction. As shown in FIG. 15, the component in the vertical direction Fv is transmitted to the backed-up surface 174*i* opposite to the drive receiving surface 173*a* of the engaging portion 173. When the drive receiving surface 173*a* of the coupling member 128 comes in contact with the main assembly drive transmission surface 101*b*, the drive receiving surface 173*a* rotates integrally with the driving transmission surface 101*b* while receiving the load (driving force) F1 as in Example 1.

When this drive force F1 is received by the drive receiving surface 173*a*, the angle J formed by the backed-up surface 174*i* and the drive receiving surface 173*a* is an acute angle, and therefore, the driving force F1 can be divided into a component Fv in the direction perpendicular to the backed-up surface 174*i* and a component Fh in the horizontal direction. As shown in FIG. 15, the component in the vertical direction Fv is transmitted to the backed-up surface 174*i* opposite to the drive receiving surface 173*a* of the engaging portion 173. The engaging portion 173 is backed up by the mounting portion 172 by way of the rib 177*e*, and therefore, the engaging portion 173 does not substantially deform toward the downstream side in the rotational direction. When the engaging portion 173 receives the vertical component Fh, the contact surface 174*h* comes into contact with the shaft portion 101*f* of the main assembly driving shaft 101, and the engaging portion 173 is backed up.

By this, the drive receiving surface 73*a* can stably abut the main assembly drive receiving surface 101*a* so that the photosensitive drum unit 30 can be retracted to the bearing portion 101*d* side of the main assembly driving shaft 101. In addition, even if the load F1 fluctuates, the engaging portion 73 is backed up as described above, and therefore, it is not substantially deformed, and for this reason, the rotation amount of the photosensitive drum 1 does not substantially change, and the quality of the image can be maintained.

Embodiment 3

Referring to FIGS. 31 to 34, Embodiment 3 will be described.

FIG. 31 is a cross-sectional view of the flange member 270 according to this embodiment taken along the center of the rotation axis (the center of the rotation axis).

FIG. 32 is a cross-sectional view of the coupling member 228 and the main assembly driving shaft 101 according to this embodiment cut at a position passing through the base portion 274 in a direction perpendicular to the rotation axis.

FIG. 33 is a perspective view of the aligning member 233 according to this example.

FIG. 34 is a view illustrating another embodiment of the coupling member 228 according to this embodiment.

Among the elements of this embodiment, those corresponding to the elements described in the above embodiments are denoted by the same names as the elements of the foregoing embodiments. In regard to those, we will explain in detail the composition and action and so on which are different from the above-mentioned elements, and sometimes omit explanation on the same points as the above-mentioned elements.

FIG. 32 is a cross-sectional view of the coupling member 228 and the main assembly driving shaft 101 according to this embodiment taken at a position passing through the base portion 274 along a direction perpendicular to the rotation axis.

FIG. 33 is a perspective view of the aligning member 233 according to this embodiment.

FIG. 34 is a view illustrating another embodiment of the coupling member 228 according to this embodiment.

Among the elements of this embodiment, those corresponding to the elements described in the above embodiments are denoted by the same names as the elements of the foregoing embodiments. In regard to those, the structure and operation and so on which are different from the above-mentioned elements will be described in detail, and the description on the same LM in the as in the foregoing embodiments may be omitted.

Of the elements of this embodiment, those which are substantially equivalent to those of the above-described embodiments are denoted by the same name and the same reference numeral, and the detailed description thereof will be omitted. In this embodiment, as shown in FIG. 31, the base side extending portion 274*t* is disposed on the downstream side in the rotational direction with respect to the engaging portion 273 and extends from the base portion (fixed end) 274*a* in the Z2 direction (inside with respect to the axial direction of the drum unit 30). And, the base side extending portion 274*t* is substantially parallel to the rotation axis of the flange member 270. In addition, the folded-back portion 274*r* is continuously formed with the base side extending portion 274*t* and is also continuously connected to the free end side extending portion 274*s*.

The free end side extending portion 274*s* extends in the axial direction from the folded back portion 274*r* toward the Z1 direction (outside in the axial direction of the drum unit 30).

An engaging portion (projecting portion) 273 is formed in the free end side extending portion 274*s*.

The folded-back portion 274*r* is disposed on the back side (Z2 side) of the engaging portion 273 in the drum unit 30 with respect to the axial direction.

Here, in this embodiment, the free end side extending portion 274*s* and the base side extending portion 274*t* are arranged at different positions in the circumferential direction (rotational direction) of the drum unit 30. In other words, the free end side extending portion 274*s* and the base side extending portion 274*t* are arranged at positions shifted from each other in the circumferential direction (rotational direction). In other words, the free end side extending portion 274*s* is disposed on the upstream side of the base side extending portion 274*t* in the rotational direction (FIG. 32). This point is different from Embodiment 1.

Here, a support portion for movably supporting the driving force receiving portion (drive receiving surface 273*a*) is formed by the base portion 274 that has a contact surface 274*h* and a backed-up surface 274*i* (within a force receiving portion having an inner peripheral surface 272*m* and a receiving surface 277*a*) and the engaging portion 273 as in Embodiment 1.

Similarly to Embodiment 1, the aligning member 233 includes an inverted conical shape 233*a*, a fitting portion 233*b*, a retaining portion 233*c*, and a backup portion 233*j* (FIG. 33). As shown in FIG. 32, the transmission of the driving force F1 at the time of driving the coupling member 228 by the main assembly driving shaft 101 is also the same as in Embodiment 1 and the engaging portion 273 is backed up by the mounting portion 272 via the backup portion 233*j* and a rib as in Example 1. Even in this embodiment, the aligning member 233 is a backup member and is a positioning member.

In addition, when the cartridge 1 is mounted on the image forming apparatus main assembly 100, the engaging portion 273 moves radially outward. On that occasion, as with Embodiment 1, the base 1 side extended portion 274*t* and the folded back portion 274*r* of the base portion 274 are elastically deformed so that the cartridge 1 can be mounted at a low load.

As shown in FIG. 32, the transmission of the driving force F1 at the time of driving the coupling member 228 by the main assembly driving shaft 101 is also the same as in Embodiment 1 and the engaging portion 273 is backed up by the mounting portion 272 by way of the backup portion 233*j* and the rib as in Example 1. Also in this embodiment, the aligning member 233 is a backup member and is a positioning member.

In addition, when the cartridge 1 is mounted on the image forming apparatus main assembly 100, the engaging portion 273 moves radially outward. On that occasion, as with Embodiment 1, the base 1 side extended portion 274*t* and the folded back portion 274*r* of the base portion 274 are elastically deformed so that the cartridge 1 can be mounted at a low load.

In addition, in this embodiment, for explanation, the base side extending portion 274*t* is disposed on the downstream side of the engaging portion 273 and the free end side extending portion 274*s* in the rotational direction. However, the base side extending portion 274*t* may be disposed on the upstream side of the engaging portion 273 and the free end side extending portion 274*s* in the rotational direction (part (a) of FIG. 34). Or, as shown in part (b) of FIG. 34, the base side extending portion 274*t* may be disposed on both the upstream side and the downstream side of the engaging portion 273 and the free end side extending portion 274*s* in the rotational direction. At this time, of course, the folded-back portion 274*r* is also disposed on both sides of the engaging portion 273 and the free end side extending portion 274*s* in the rotational direction.

That is, in the structure shown in part (b) of FIG. 34, the support portions (273, 274) are provided with two root side extending portions 274*t* for supporting the free end side extending portion 274*s*. In other words, the free end side extending portion 274*s* is connected to the two base side extending portions 274*t* by way of the two folded-back portions 274*r*. Such support portions (273, 274) are M-shaped (part (b) of FIG. 34).

Embodiment 4

Referring to FIGS. 35 to 41, Embodiment 4 will be described.

FIG. 35 is a cross-sectional view of the coupling member 328 according to this embodiment taken along the center of the rotation axis (center of rotation axis).

FIG. 36 is a view of a flange member 370 according to this embodiment as viewed in the Z direction outer side, and a sectional view thereof.

FIG. 37 is a perspective view of the inner cylindrical member 340 according to this embodiment.

FIG. 38 is a perspective view of the aligning member 333 according to this example.

FIG. 39 is an illustration of the assembly of the coupling member 328 according to this embodiment.

FIG. 40 is a cross-sectional view of the coupling member 328 and the main assembly driving shaft 101 according to this embodiment taken along a direction perpendicular to the rotation axis at a position passing through the driving force receiving surface 373*a*.

FIG. 41 is a view illustrating another embodiment of the inner cylindrical member 340 according to this embodiment.

Those corresponding to the elements described in the above embodiment are given the same names as those in the above-described embodiments. In regard to those, the structure and operation and so on will be described in detail for those different from the above-mentioned elements, and for the elements same as in the foregoing embodiments, the description may be omitted.

Of the elements of this embodiment, those substantially equivalent to those of the above-described embodiments are denoted by the same name and the same reference numerals, and the detailed description thereof will be omitted.

In this embodiment, especially the points different from Embodiment 3 will be described in detail. Each of the free end side extending portion 374*s* and the fixed end side extending portion 374*t* of this embodiment is different in the extending direction from the free end side extending portion 274*s* and the fixed end side extending portion 274*t* of Embodiment 3.

In Embodiment 3, the coupling member 228 includes the flange member 270 and the aligning member 233, and the flange member 270 includes the engaging portion 273 and the base portion 274. In the base portion 274, the folded-back portion 274*r* is disposed on the back side (Z2 side) of the engaging portion.

By contrast, in this embodiment, as shown in FIG. 35, the coupling member 328 comprises the flange member 370, the inner cylindrical member 340, and the aligning member 333. The inner cylindrical member 340 is the driving force receiving member like Embodiment 2, and the aligning member 333 is a backup member as in Embodiment 2 and is a member to be transmitted and also a positioning member.

More specifically, as shown in FIG. 36, the flange member 370 includes a mounting portion 372, a cylindrical portion 371, a flange portion 375, and a force receiving portion 377.

In addition, as shown in FIG. 37, the inner cylindrical member 340 includes a base portion 374, an engaging portion 373, and a fitting portion 340*a*. The base portion 374 includes a base side extending portion 374*t* and a folded portion 374*r* as in Embodiment 3, as well as a contact surface 374*h* (FIG. 40).

In this embodiment, as shown in FIG. 37, the base side extending portion 374*t* is disposed on the downstream side of the engaging portion 373 and the free end side extending portion 374*s* in the rotational direction. The base side extending portion 374*t* extends from the base portion 374*a* in the Z1 direction (outside in the axial direction of the drum unit 30) and is substantially parallel to the rotation axis of the flange member 370. In addition, the folded-back portion 374*r* is formed continuously with the base side extending portion 374*t* and is continuously connected to the free end side extending portion 374*s*.

The folded portion 374*r* is disposed closer to the Z1 side than the free end of the free end extended portion 374*s* (the free end of the engaging portion 373).

The free end side extending portion 374*s* extends from the folded portion 374*r* in the Z2 direction (inside in the axial direction of the drum unit 30) and is substantially parallel to the rotation axis line of the flange member 370.

An engaging portion 373 is formed in substantially the entire area of the free end side extending portion 374*s*. The engaging portion 373 is provided with a driving force receiving surface 373*a* which is a driving force receiving portion.

As shown in FIG. 38, the aligning member 333 includes an inverted conical portion 333*a*, an aligning member fitting portion 333*i*, a retaining portion 333*j*, and an inner cylindrical member fitting portion 333*k*. As shown in FIG. 39, the aligning member fitting portion 333*i* is fitted to the inner peripheral surface 372*m* (FIG. 36) of the mounting portion 372 of the flange member 370. The retaining portion 333*j* has a snap-fit shape extending in the Z direction, as shown in FIG. 38. As shown in FIG. 39, the flange member 370 includes a hole shape 372*b* at a position corresponding to the retaining portion 333*j*. As shown in FIG. 39, the inner cylindrical member fitting portion 333*k* is engaged with the fitting portion 340*a* of the inner cylindrical member 340.

As shown in FIG. 39, the inner cylindrical member 340 and the aligning member 333 are assembled to the flange member 370 from the Z2 side to the Z1 side to form a coupling member 328. As shown in FIG. 35, the inner cylindrical member 340 is sandwiched between the flange member 370 and the aligning member 333 in the assembled state of the coupling 328, thereby regulating the movement in the Z direction. The inner cylindrical member 340 is constituted so as to be rotatably assembled to the flange member 370 until the engaging portion 373 abuts against the force receiving portion 377 on the upstream side and the downstream side in the rotational direction.

As shown in FIG. 40, when the coupling member 328 is driven by the main assembly driving shaft 101, the backed-up surface 374*i* of the engaging portion 373 is backed up by the mounting portion 372 via the rib 377*e* of the force receiving portion 377, as in Embodiment 2. Therefore, the engaging portion 373 does not substantially deform toward the downstream side in the rotational direction.

In addition, as in Embodiment 1, in mounting the cartridge 1 to the image forming apparatus main assembly 100, when the engaging portion 373 moves radially outward, the base side extending portion 374*t* and the folded portion 374*r* of the base portion 374 are elastically deformed so that the cartridge 1 can be mounted with a low load.

In addition, in this embodiment, for explanation, in the inner cylindrical member 340, the base side extending portion 374*t* is disposed on the downstream side in the rotational direction of the engaging portion 373. However, as shown in part (a) of FIG. 41, the inner cylindrical member 340 may be disposed on the upstream side in the rotational direction, or as shown in part (b) of FIG. 41, they may be disposed on both sides in the rotational direction.

Here, in Embodiment 4 and Embodiments 1 to 3 described above, the structure of the coupling member for receiving the driving force for driving the photosensitive drum 1 of the drum cartridge 13 has been described.

It is also possible to provide the above-described coupling members (28, 128, 228, 328) in the developing cartridge 4. In this case, each of the coupling members (28, 128, 228, 328) receives a driving force for driving elements provided in the developing cartridge 4 such as the developing roller 17, the toner supply roller 18, the stirring member 23 and/or the like. Examples of such a structure will be described in detail in the following Embodiments 5 and 6.

Embodiment 5

Referring to FIGS. 42 to 57, Embodiment 5 will be described.

In this embodiment, a coupling member 528 for driving a developing roller 17, a toner supplying roller 18, and a stirring member 23 of the developing cartridge 4 are provided in the developing cartridge 4. In order to transmit the driving force to the coupling member 528, a main assembly driving shaft 5101 is provided in the image forming apparatus main assembly 100A.

In the above-mentioned Embodiments 1 to 4, the structure of the main assembly of the apparatus and the drive coupling portion (coupling member and main assembly driving shaft 101) of the drum cartridge has been described. In this embodiment and Embodiment 6 will be described hereinafter, these structures are used as the structure of the drive main assembly of the apparatus and the driving connection portion of the developing cartridge (the coupling member 528 and the main assembly driving shaft 5101).

Therefore, among the elements of this embodiment, those corresponding to the elements described in the above embodiments are denoted by the same names as in the above-mentioned elements. Structure and the operation and so on which are different from the above-mentioned elements will be described in detail, and the description on the same elements is in the foregoing embodiments may be omitted.

Of the elements of this embodiment, the same names and the same reference numerals are mounted to the same elements as those of the above-described embodiment and the detailed description will be omitted.

[Structure of Main Assembly Driving Shaft]

Referring to FIG. 42 and FIG. 43, the structure of the main assembly driving shaft 5101 will be described.

FIG. 42 is an external view of the main assembly driving shaft 5101.

FIG. 43 is a cross-sectional view of the main assembly driving shaft 5101 mounted to the image forming apparatus main assembly, taken along the rotation axis (rotation axis) thereof.

As shown in FIG. 42, the main assembly driving shaft 5101 includes a gear member 5101*e*, an intermediate member 5101*p*, an output member 5101*q*, and a drive transmission member 5101*r*.

The image forming apparatus main assembly 100A is provided with a motor (not shown) as a drive source. The gear member 5101*e* is supplied with rotational driving force from this motor, the driving force is transmitted in the order of the intermediate member 5101*p*, the output member 5101*q* and the drive transmission member 5101*r* so that the main assembly driving shaft 5101 rotates.

In addition, the gear member 5101*e*, the intermediate member 5101*p*, and the output member 5101*q* have a mechanism of an Oldham coupling, and therefore, it can move a certain distance in the X direction and Y direction. Therefore, the drive transmission member 5101*r* provided through the Oldham coupling on the cartridge side of the main assembly driving shaft 5101 can also move a certain distance in the X direction and the Y direction. And, the drive transmission member 5101*r* is provided with a rotatable shaft portion 5101*f*, and the rotational driving force received from the motor is transmitted to the developing cartridge 4 side by way of the groove-shaped drive transmission groove 5101*a* (recessed portion, drive passing portion) provided on the shaft portion 5101*f*. In addition, the shaft portion 5101*f* has a conical shape 5101*c* at its free end.

The main assembly drive transmission groove 5101*a* has a shape allowing a portion of an engaging portion 573 described later to enter. More specifically, it is provided with a main assembly drive transmission surface 5101*b* as a surface which contacts the drive receiving surface (drive receiving portion) 573*a* of the coupling member 528 and transmits the driving force.

In addition, as shown in FIG. 42, the main assembly drive transmission surface 5101*b* is not a flat surface, but has a shape twisted about the rotation axis of the main assembly driving shaft 5101. The direction of the twisting is such that the Z1 direction side of the main assembly driving shaft 5101 is on the upstream side of the Z2 direction side in the rotational direction of the main assembly driving shaft 5101. In this embodiment, the amount of twist along the rotation axis direction of the cylinder of the engaging portion 573 is about 1° per 1 mm. The reason why the main assembly drive transmission surface 5101*b* is twisted will be described later.

In addition, on the Z2 direction side surface of the main assembly drive transmission groove 5101*a*, a main assembly side removing taper 5101*i* is provided. The main assembly side removing taper 5101*i* is a taper (inclined surface, inclined portion) for helping the engaging portion 573 to be disengaged from the drive transmission groove 5101*a*, when removing the developing cartridge 4 from the apparatus main assembly 100A.

As shown in FIG. 43, the bearings 5101*d* provided in the gear member 5101*e* are rotatably supported (journaled) by a bearing member 5102 provided in the image forming apparatus main assembly 100A. The output member 5101*q* is rotatably supported by a coupling holder 5101*s*. In addition, the drive transmission member 5101*r* is supported on the output member 5101*q* so as to be movable in the Z direction and is biased toward the developing cartridge 4 (in the Z2 direction) by the spring member 5103. However, the movable amount (play) of the drive transmission member 5101*q* in the Z direction is about 1 mm, which is sufficiently smaller than the width of the drive receiving surface 573*a*, which will be described hereinafter, in the Z direction.

Furthermore, the coupling holder 5101*s* is urged substantially in the Y2 direction by the urging spring 5101*t*, and as will be described hereinafter, when the developer cartridge 4 is mounted, the drive transmission member 5101*r* is in a position shifted substantially in the Y2 direction with respect to the axis of the gear member 5101*e*.

As described above, the drive transmission member 5101*r* is provided with the main assembly drive transmission groove 5101*a*, and an engaging portion 573 is provided on the coupling member 528 so that drive is transmitted from the apparatus main assembly 100A to the developing cartridge 4.

Here, as will be described in detail hereinafter, the engaging portion 573 is provided at the free end of the elastically deformable base portion 574. Therefore, the engaging portion 573 is movable radially outward when the developing cartridge 4 is mounted on the apparatus main assembly 100A. By this, with the insertion of the developing cartridge 4 into the apparatus main assembly 100A, the engaging portion 573 enters the drive transmission groove 5101*a* so that the engaging portion 573 and the main assembly drive transmission groove 5101*a* can engage with each other.

The engaging portion 573 includes a driving force receiving portion for receiving the driving force from the outside of the developing cartridge 4. Similarly to the above-described embodiments, the base portion 574 and the engaging portion form a supporting portion for movably supporting the driving force receiving portion.

[Structure of Coupling Member]

Referring to FIG. 44, FIG. 45, FIG. 46, FIG. 47, FIG. 48, and FIG. 49, the coupling member 528 of this embodiment will be described in detail.

FIG. 44 is a cross-sectional view of the coupling member 528 taken along the rotation axis.

FIG. 45 is a cross-sectional view of the cylindrical member 570 taken along the rotation axis.

FIG. 46 is a sectional view of the coupling member 528 and the main assembly driving shaft 5101 taken along a direction perpendicular to the rotation axis of the coupling member 528 so as to pass through the drive receiving surface 573*a*.

FIG. 47 is a perspective view of the aligning member 533.

FIG. 48 illustrates assembling of the coupling member 528.

FIG. 49 is a sectional view of the developing cartridge 4 taken along the axis of the toner supply roller 20 and the developing roller 17.

As shown in FIG. 44, the coupling member 528 is formed of two members by combining the cylindrical member 570 and the aligning member 533. However, depending on the selection of material, molding method, structure and so on, it is not necessary to be two-piece structure, and it may be constituted by combining three or more members. As in Embodiment 1, the cylindrical member 570 is a driving force receiving member provided with a drive receiving surface 573*a* for receiving a driving force from the apparatus main assembly. As in Embodiment 1, the aligning member 533 is a member to be transmitted to which the driving force is transmitted from the cylindrical member 570. The aligning member 533 is also a backup member provided with a backup portion for restraining the drive receiving surface 573*a* from moving in the circumferential direction of the cylindrical member 570.

As shown in FIG. 48, the aligning member 533 is assembled to the cylindrical member 570 in the axial direction (indicated by an arrow) of the cylindrical member 570. Furthermore, by rotating the aligning member 533 in the counterclockwise direction (shown by the arrow), the retaining portion 533*c* is engaged with the catching portion 572 so that the aligning member 533 is unitized together with the cylindrical member 570.

(Flange Member)

As shown in FIG. 45, as in Embodiment 1, the cylindrical member 570 includes the engaging portion 573 and the base portion 574. As in Embodiment 1, the engaging portion 573 and the base portion 574 are support portions for movably supporting the driving force receiving portion (drive receiving surface 573*a*).

As in Embodiment 1, as shown in FIG. 46, the engaging portions 573 are arranged at three positions (120° spacing, substantially equal intervals) at equal intervals in the circumferential direction of the coupling member 528, and they have drive receiving surfaces 573*a*. The base 574 has a backed-up surface 574*i* and a contact surface 574*h*.

The drive receiving surface 573*a* is a surface which transmits the driving force of the main assembly driving shaft 5101 to the coupling member 528 by being in contact with the main assembly drive transmission surface 5101*b* of the main assembly driving shaft 5101.

The contact surface 574*h* is a surface abutting against the shaft portion 5101*f*, and when the coupling member 528 is engaged with the main driving shaft 5101, the radius R51 of the arc forming the inner diameter is substantially the same as the radius R52 of the shaft portion 5101*f*.

The backed-up portion 574*i* is a surface which contacts with the receiving surface 577*a* of the force receiving portion 577 of the aligning member 533, which will be described later, and when the coupling member 528 is engaged with the main assembly driving shaft 5101, it is disposed on the downstream side of the drive receiving surface 573*a* in the rotational direction (FIG. 46). As shown in FIG. 46, the angle J formed between the backed-up surface 574*i* and the drive receiving surface 573*a* is acute.

Here, it will suffice if the drive receiving surface 573*a* has different phases in the rotational direction of two points in contact with the drive transmission member 5101*r*. That is, the drive receiving surface 573*a* does not necessarily have to have a twisted shape as long as it has the same function as the twisted surface. By forming the drive receiving surface 573*a* into a twisted shape or an inclined shape, when the drive receiving surface 573*a* is driven, a force pulling to the outer side (the Z1 direction side) of the developing cartridge 4 is applied to the coupling member 528.

Furthermore, as shown in FIG. 45, the engaging portion 573 has an insertion tapered surface 573*d* as a mounting force receiving portion on the outer side (the Z1 direction side) of the developing cartridge 4 in the Z direction. In addition, the engaging portion 573 has a removing tapered surface 573*e* as a dismounting force receiving portion on the inner side (the Z2 direction side) of the developing cartridge 4 in the Z direction. By this, the mountability and dismountability of the coupling member 4028 to the main driving shaft 5101 can be improved.

Upon the mounting, the insertion tapered surface 573*d* and the conical shape 5101*c* come into contact with each other, and the engaging portion 573 is moved toward the outside in the radial direction of the driving shaft. In addition, the removing taper surface 573*e* and the main assembly side removing taper 5101*i* are brought into contact with each other, and the engaging portion 573 is moved toward the outside in the radial direction of the main assembly driving shaft 5101.

As in Embodiment 1, the base portion 574 has a base side extending portion 574*t*, a folded portion 574*r*, and a free end side extending portion 574*s*. As in Embodiment 1, the base side extending portion 574*t* extends in the Z2 direction (inside in the axial direction of the developing roller) substantially parallel to the rotation axis of the cylindrical member 570 from the base portion 574*a*. The base side extending portion 574*t* is disposed radially outwardly of the engaging portion 573 and the free end side extending portion 574*s*.

The folded portion 574*r* is formed continuously with the root side extending portion 574*t*, and it is also a portion that continues continuously with the free end extended portion 574*s*.

The base side extending portion 574*t* extends from the folded portion 574*r* in a direction substantially parallel to the rotation axis of the cylindrical member 570 in the Z1 direction (outside in the axial direction of the developing roller).

The free end of the engaging portion 573 (the free end of the free end side extending portion 574*s*) and the base portion 574*a* of the base portion are disposed closer to the Z1 side than the folded portion 574*r*.

The engaging portion 573 is a projection provided on the free end side extending portion 574*s* and has a driving force receiving portion (drive receiving surface 573*a*).

As in Embodiment 1, the engaging portion 573 can move in the radial direction of the coupling member 528 by the elastic deformation of the base portion 574. In other words, the base portion 574 is deformed by being subjected to an external force, and it produces a restoring force (elastic force) in a direction returning to a position in a spontaneous state.

As in Embodiment 1, when the coupling member 528 is engaged with the main driving shaft 5101, both the base side extending portion 574*t* and the folded portion 574*r* are elastically deformed, whereby the coupling member 528 can be mounted to the main assembly driving shaft 5101 with a low mounting force.

In addition, the drive receiving surface 573*a* of the coupling member 528 has a shape twisted about the axis of the coupling member 528, and in this embodiment, the amount of twisting is the same as that of the main assembly drive transmission surface 5101*b*.

(Aligning Member)

As shown in FIG. 47, the aligning member 533 includes an inverted conical shape 533*a*, a force receiving portion 577, a retaining portion 533*c*, and an aligning member drive transmission surface (hereinafter simply referred to as a driving transmission surface).

The inverted conical shape 533*a* is a portion for determining the position in the axial direction and the position in the radial direction of the main assembly driving shaft 5101. By contacting the conical shape 5101*c* of the drive transmission member 5101*r* in the inverted conical shape of the inverted conical shape 533*a*, the movement of the drive transmission member 5101*r* in the axial direction and the radial direction of the main driving shaft 5101 is restricted.

In the assembled state of the coupling 528, the force receiving surface 577 includes a receiving surface 577*a* (FIG. 46) which is a surface contacting the backed-up surface 574*i* provided in the engaging portion 573, and a rib 577*e* (FIG. 46) perpendicular to the receiving surface 577*a*. Similarly to Embodiment 1, the receiving surface 577*a* is the backup portion and also the transmitted portion for receiving the driving force from the cylindrical member 570.

As shown in FIG. 48, the drive transmission surface 533*m* is a surface (driven portion) to which drive is transmitted from the cylindrical member 570 to the aligning member 533. The cylindrical member 570 has a corresponding cylinder drive transmission surface (drive transmission portion) 570*m*. Three positions thereof (120° spacing, approximately equal intervals) are arranged at equal intervals in the circumferential direction of the aligning member 533 and the cylindrical member 570.

In addition, the cylinder drive transmission surface 570*m* and the drive transmission surface 533*m* are twisted along the axis of the cylindrical member 570 and the aligning member 453, respectively, and the twisting amount is about 2° per 1 mm.

Regarding this twist amount, the following relationship holds. The cylindrical member 570 receives the force Fz1 attracting toward the outer side (Z1 direction side) of the developing cartridge 4 at the drive receiving surface 573*a*. And, the cylindrical member 570 receives a force Fz2 attracting inward (toward the Z2 direction side) of the developing cartridge 4 at the flange drive transmission surface 570*m*. In this case, Fz2>Fz1 is always satisfied.

Therefore, the cylindrical member 570 is assuredly retracted in the Z2 direction. Additionally, at least a portion of the engagement portion D in the Z direction between the cylinder drive transmission surface 570*m* and the drive transmission surface 33*m* overlaps the receiving surface 573*a* and the receiving surface 577*a* of the force receiving portion 577, in the Z direction. By this, it is possible to suppress the deformation amount of the cylindrical member 570.

In this embodiment, as shown in FIG. 49 a mounting portion 533*d* (FIG. 37) which is a D-shaped hole provided in the aligning member 533 is mounted to the shaft of the toner supply roller 20. And, when the drive is transmitted from the aligning member 533 to the shaft of the toner supply roller 20, the toner supply roller 20 is rotatable. Next, the driving force is transmitted to the toner supply roller gear 598 provided on the side of the axis of the toner supply roller 20 in the Z1 direction. Finally, the drive is transmitted from the toner supply roller gear 598 to the developing roller gear 599 provided on the side of the shaft of the developing roller 17 in the Z1 direction, so that the developing roller 17 can rotate. The ends of the developing roller 17 are rotatably supported by the development bearings 519R and 519L, respectively.

[Mounting of Cartridge to Image Forming Apparatus Main Assembly]

Referring to FIG. 50 and FIG. 51, attachment/dismounting of the developing cartridge 4 to/from the image forming apparatus main assembly 100A will be described.

FIG. 50 is a perspective view illustrating the mounting of the developing cartridge 4 to the image forming apparatus main assembly 100A.

FIG. 51 is a cross-sectional view illustrating the mounting operation of the developing cartridge 4 to the image forming apparatus main assembly 100A.

The image forming apparatus main assembly 100A of this embodiment employs a structure in which the developing cartridge 4 can be mounted in the horizontal direction. More specifically, the image forming apparatus main assembly 100A includes therein a space in which the developing cartridge 4 can be mounted. And, there is provided a cartridge door 5104 (front door) for inserting the developing cartridge 4 into the above-described space in front of the image forming apparatus main assembly 100A (the direction in which the user stands when used).

As shown in FIG. 50, the cartridge door 5104 of the image forming apparatus main assembly 100A is provided so as to be opened and closed. When the cartridge door 5104 is opened, the lower cartridge guide rail 5105 for guiding the developing cartridge 4 is disposed on the bottom surface of the space, and the upper cartridge guide rail 5106 is disposed on the upper surface. The developing cartridge 4 is guided to the mounting position by the lower guide rails (5105, 5106) provided above and below the space. The developing cartridge 4 is inserted into the mounting position substantially along the axis of the developing roller 20.

In the following, referring to FIG. 51, the mounting and dismounting operation of the developing cartridge 4 relative to the image forming apparatus main assembly 100A will be described.

As shown in part (a) of FIG. 51, the developing cartridge 4 is supported and guided by the lower cartridge guide rail 5105 on the lower side of the end portion on the rear side in the inserting direction. The developing cartridge 4 is guided by the upper cartridge guide rail 5106 (not shown) on the upper side of the end portion on the rear side in the inserting direction. In this state, the developing cartridge 4 is inserted into the apparatus main assembly. At this time, the developing frame 18 and the development bearing 19 (19L, 19R) are dimensioned so as not to contact the intermediary transfer belt 5.

As shown in part (b) of FIG. 51, the developing cartridge 4 is horizontally inserted while being supported by the lower cartridge guide rail 5105 until reaching a back side cartridge positioning portion 5108 provided in the image forming apparatus main assembly 100A.

In addition, when the developing cartridge 4 is mounted, as described above, the drive transmission member 5101*r* of the image forming apparatus main assembly 100A is engaged with the coupling member 528 while being urged substantially in the Y2 direction.

Part (c) of FIG. 51 is a view illustrating the state of the image forming apparatus main assembly 100A and the developing cartridge 4 in a state where the cartridge door 5104 is closed. The structure is such that the lower cartridge guide rail 5105 of the image forming apparatus main assembly 100A moves up and down in interrelation with the opening and closing of the cartridge door (front door) 5104.

When the cartridge door 5104 is closed by the user, the lower cartridge guide rail 5105 is raised. And, both end portions of the developing cartridge 4 contact the cartridge positioning portions (5108, 5110) of the image forming apparatus main assembly 100A, and the developing cartridge 4 is positioned with respect to the image forming apparatus main assembly 100A. In addition, the drive transmission member 5101*r* of the image forming apparatus main assembly 100A also rises following the developing cartridge 4.

With the above operation, the mounting of the developing cartridge 4 to the image forming apparatus main assembly 100A is completed.

In addition, the removal of the developing cartridge 4 from the image forming apparatus main assembly 100A is in the reverse order of the above-described inserting operation.

[Engaging Process of Coupling Member to Main Assembly Drive Shaft]

Subsequently, the engagement process between the coupling member 528 and the main assembly driving shaft 5101 will be described in detail.

FIG. 52 is a cross-sectional view illustrating the mounting operation of the coupling member 528 to the main assembly driving shaft 5101.

Part (a) of FIG. 52 is a view illustrating a state before the coupling member 528 starts engaging with the drive transmission member 5101*r*. In addition, part (d) of FIG. 52 shows a state in which the developing cartridge 4 is mounted to the image forming apparatus main assembly 100A. In particular, part (d) of FIG. 52 shows the state in which as the cartridge door 5104 closes, the lower cartridge guide rail 105 is raised, and the developing cartridge 4 is positioned with respect to the image forming apparatus main assembly 100A.

Here, parts (b) and (c) of FIG. 52 illustrate the process of mounting the coupling member 528 and the drive transmission member 5101*r* between the position shown in part (a) of FIG. 52 and the position shown in part (d) of FIG. 52. Here, the drive transmission member 5101*r* is urged substantially in the Y2 direction by the urging spring 5101*t*, and the axis of the drive transmission member 5101*r* is urged up to the position shifted substantially in the Y2 direction from the axis of the coupling member 528.

As described referring to FIG. 51, the developing cartridge 4 is horizontally inserted while being supported by the lower cartridge guide rail 5105 of the image forming apparatus main assembly 100A.

Part (a) of FIG. 52 is a view illustrating a state in which the drive transmission member 5101*r* does not abut on the coupling member 528. As described in the foregoing, in this state, the axis of the drive transmission member 5101*r* and the axis of the coupling member 528 are deviated from each other.

As shown in part (b) of FIG. 52, when the coupling member 528 is further inserted from the part (a) of FIG. 52 toward the rear side of the drive transmission member 5101*r*, the insertion tapered surface 573*d* of the coupling member 528 first contacts the conical shape 5101*c* of the drive transmission member 5101*r*. The insertion tapered surface 573*d* of the coupling member 528 is guided by the conical shape 5101*c* of the drive transmission member 5101*r*, and the axis of the coupling member 528 and the axis of the drive transmission member 5101*r* are substantially aligned with each other.

Part (c) of FIG. 52 shows a state in which the coupling member 528 is further inserted from the part (b) of FIG. 52 toward the rear side of the drive transmission member 5101*r*. As the base portion 574 undergoes elastic deformation, the engaging portion 573 deforms radially outwardly of the coupling member 528 so that the insertion tapered portion 573*d* of the engaging portion 573 deforms so as to match the conical shape 5101*c*. Furthermore, when the coupling member 528 is inserted in the Z1 direction, the removed tapered surface 573*e* of the engaging portion 573 of the coupling member 528 is inserted into the drive transmission member 5101*r* until it comes to the Z direction rear side (Z1 side) from the main assembly side removing taper 5101*i* of the drive transmission member 5101*r*. Next, until the positioning portion 533*a* of the coupling member 528 and the conical shape 5101*c* of the drive transmission member 5101*r* are brought into contact with each other, the coupling member 528 is inserted into the drive transmission member 5101*r*.

Thereafter, as described above, by raising the developing cartridge 4 by the lower cartridge guide rail 5105, the developing cartridge 4 is positioned relative to the image forming apparatus main assembly 100A (part (c) of FIG. 51). In addition, as shown in part (d) of FIG. 51, as the developing cartridge 4 rises, the drive transmission member 5101*r* also moves up. Thereafter, as in Embodiment 1, when the main assembly driving shaft 5101 rotates and the phases of the engaging portion 573 and the drive transmission groove 5101*a* match, the elastic deformation of the base portion 574 is released, and the engaging portion 573 enters the drive transmission groove 5101*a*.

[Drive of coupling Member by Main Assembly Driving Shaft]

Referring to FIG. 46, the rotational drive transmission from the main driving shaft 5101 to the coupling member 528 will be described.

When the drive receiving surface 573*a* of the coupling 528 abuts against the main assembly drive transmission surface 5101*b*, the developing blade 21 and the like supply a load by way of the developing roller 17 and the developing roller 17. That is, the drive receiving surface 573*a* rotates integrally with the driving transmission surface 101*b* while receiving the load (driving force) F51.

When this driving force F51 is received by the drive receiving surface 753*a*, the angle J formed by the backed-up surface 574*i* and the drive receiving surface 573*a* is an acute angle, and therefore, the load can be divided into the component Fv in the direction perpendicular to the backed-up surface 574*i* and the component Fh in the horizontal direction. As shown in FIG. 46, the component in the vertical direction Fv is transmitted to the backed-up surface 574*i* opposite to the drive receiving surface 573*a* of the engaging portion 573. The backed up surface 574*i* is backed up by the abutment against the force receiving surface 577*a* or by the rib 577*e* in the direction perpendicular to the force receiving surface 577*a*. By this, even if the load F51 fluctuates, the engaging portion 573 is backed up as described above, and therefore, it is not substantially deformed, and for this reason, the amounts of rotation of the toner supply roller 20 and the developing roller 17 also hardly changes, and as a result, the quality of the image can be maintained.

In addition, the removal of the developing cartridge 4 from the image forming apparatus main assembly 100A is executed in the reverse order of the above-described inserting operation.

In this embodiment, the base side extending portion 574*t* extends to the rear side (Z2 direction) substantially in parallel with the rotation axis of the cylindrical member 570. And, the base side extending portion 574*t* is disposed radially outside the engaging portion 573, and both of the free end side of the engaging portion 573 and the root 574*a* of the base portion are disposed on the Z1 side of the folded portion 574*r*.

As shown in FIG. 53, as another embodiment, both the free end side of the engaging portion 573 and the root 574*a* of the base portion may be arranged on the Z2 side of the folded portion 574*r*.

As shown in part (a) of FIG. 54, FIG. 55, the base side extending portion 574*t* may be disposed on the downstream side in the rotational direction with respect to the engaging portion 573 and extend toward the rear side (the Z2 direction) of the base portion 274*a*. As shown in part (b) of FIG. 54, the base side extending portion 574*t* may be disposed on the upstream side the engaging portion 573 in the rotational direction and extend toward the rear side (the Z2 direction) of the base portion 274*a*. As shown in part (c) of FIG. 54, the base side extending portion 574*t* may be disposed on both sides of the engaging portion 573 in the rotational direction.

As shown in part (a) of FIG. 56 and FIG. 57, the base side extending portion 574*t* may be disposed on the downstream side in the rotational direction beyond the engaging portion 573 and the free end side extending portion 574*s* and may extend in the Z1 direction from the base portion 574*a*. As shown in part (b) of FIG. 56, the base side extending portion 574*t* may be disposed on the upstream side in the rotational direction beyond the engaging portion 573 and the free end side extending portion 574*s* and may extend in the Z1 direction from the base portion 574*a*. As shown in part (c) of FIG. 56, the base side extending portion 574*t* may be disposed on both sides in the rotational direction relative to the engaging portion 573 and the free end side extending portion 574*s*.

Embodiment 6

Referring to FIGS. 58 to 63, Embodiment 6 will be described.

FIG. 58 is a perspective view of the aligning member 633 according to this example.

FIG. 59 is a cross-sectional view of the aligning member 633 according to this embodiment cut along the rotation axis.

FIG. 60 is a cross-sectional view of the coupling member 628 according to this embodiment and taken through the drive receiving surface 673*a* along a direction perpendicular to the rotation axis.

FIG. 61 is a perspective view of the cylindrical member 670 according to this embodiment.

FIG. 62 is a cross-sectional view of the coupling member 628 according to this embodiment cut along the rotation axis.

FIG. 63 is a view illustrating assembly of the coupling member 628 according to this embodiment.

Elements corresponding to the elements disclosed in the above embodiments are given the same names. In addition, the description will be made in detail as to the structure and the operation and so on which are different from the above-described elements, and the description on the same points as described above may be omitted. The same names and the same reference numerals are assigned to substantially the same elements as those described above, and the detailed description is omitted. In this embodiment, especially the points different from Embodiment 5 will be described in detail.

In Embodiment 5, the coupling member 528 comprises a cylindrical member 570 and the aligning member 533, and the cylindrical member 570 includes a cylinder drive transmission surface 570*m*, a base portion 574, and an engaging portion 573, and the aligning member 533 includes a force receiving portion 577 and a drive transmission surface 533*m*.

On the other hand, in this embodiment, a backup portion 670*j* is provided in the cylindrical member 670, and the aligning member 633 includes a base portion 674, an engaging portion 673, and a force receiving portion 677.

More specifically, as shown in FIG. 58, the aligning member 633 has a base portion 674, an engaging portion 673, a force receiving portion 677, an inverted conical shape 633*a*, and a retaining portion 633*c*.

As shown in FIG. 59, the base portion 674 is provided with a base portion 674*a* on the Z1 side and includes a base side extending portion 674*t* extending in the axial direction of the coupling member 628, a free end side extending portion 674*s*, a base side extending portion 674*t*, and a folded portion 674*r*.

The engaging portion 673 is provided with a drive receiving surface 673*a*, similarly to Embodiment 5. That is, the aligning member 633 is a driving force receiving member provided with a driving force receiving portion for receiving a driving force from the apparatus main assembly.

Further, the free end extended portion 674*s* is provided with a backed-up surface 674*i* and a contact surface 674*h*.

The angle j formed by the drive receiving surface 673*a* and the backed-up surface 674*i* is an acute angle, as in Embodiment 5.

As shown in FIG. 60, the force receiving portion 677 is disposed on the downstream side in the rotational direction of the engaging portion 673, and includes a receiving surface 677*a* and a rib 677*e*. The receiving surface 677*a* is a surface for sandwiching the backup portion 670*j* of the cylindrical member 670 which will be described hereinafter in cooperation with the backed-up surface 674*i* of the base portion 674. The receiving surface 677*a* and the backed-up surface 674*i* are substantially parallel. As shown in FIG. 60, the rib 677*e* is disposed substantially perpendicularly to the receiving surface 677*a* starting from the inner diameter side end of the receiving surface 677*a*.

In addition, the inverted conical shape 633*a* is a portion for determining the positions of the coupling member 628 and the main assembly driving shaft 5101, as in Embodiment 5.

The retaining portion 633*c* engages with a catch portion 672 provided in the cylindrical member 670 to unitize the aligning member 633 and the cylindrical member 670.

As shown in FIG. 61, the cylindrical member 670 has a backup portion 670*j* and a catch portion 672. That is, the cylindrical member 670 is a backup member including a backup portion.

As shown in FIG. 60, the backup portion 670*j* is assembled in a gap between the backed-up surface 674*i* of the aligning member 633 and the receiving surface 677*a* and has a shape which prevents the engaging portion 673 from tilting to the upstream side in the rotational direction. Therefore, the thickness of the backup portion 670*j* is substantially the same as the gap between the backed-up surface 674*i* and the receiving surface 677*a*. In addition, as viewed in the Z direction, a circle passing through the ridge line on the side of the engaging portion 673 of the backup portion 670*j* is arranged so that its center is the same as the inverted conical shape 633*a*. The diameter D68 of the circle is made approximately the same as the outer diameter D65 of the shaft portion 5101*f* of the main assembly driving shaft 5101 or is made so that D68≥D65 is satisfied as the respective dimensional accuracy is taken into consideration. In addition, as shown in FIG. 62, the backup portion 670*j* is disposed so as to overlap the drive receiving surface 673*a* in the Z direction.

By aligning the aligning member 633 with respect to the cylindrical member 670 on the front side from the rear side in the Z direction (from the Z2 side toward the Z1 side), a coupling member 628 is formed (FIG. 62). At this time, as mentioned above, the retaining portion 633*c* of the aligning member 633 is engaged with the catch portion 672 provided in the cylindrical member 670.

As shown in FIG. 60, when the coupling member 628 is driven by the main assembly driving shaft 5101, the drive receiving surface 673*a* of the engaging portion 673 receives the driving force F1. In the force components, the force Fv in the direction perpendicular to the backed up surface is backed up by the backed-up surface 674*i*, the backup portion 670*j*, the receiving surface 670*a*, and the rib 670*e*, and therefore, the engaging portion 673 is prevented from being deformed toward the downstream side in the rotational direction. In addition, with respect to the force Fh in the direction parallel to the backed-up surface 674*i*, it is possible to prevent the engaging portion 673 from being deformed in the radial direction by the contact surface 674*h* of the base portion 674 abutting against the shaft portion 5101*f* of the main assembly driving shaft 5101.

In addition, in Embodiment 5, an engaging portion 573 is provided on the cylindrical member 570 and placed on the aligning member 533 so as to straddle the inverted conical shape 533*a* and another portion. Therefore, the cylinder drive transmission surface 570*m* is provided on the cylindrical member 570, and the drive transmission surface 533*m* is provided on the aligning member 533. By this, by pulling the cylindrical member 570 toward the aligning member 533 side (Z2 direction side), the position of the engaging portion 573 and the inverted conical shape 533*a* in the Z direction is stabilized.

By contrast, in this embodiment, the engaging portion 673 and the inverted conical shape 633*a* are arranged on the aligning member 633, and therefore, it is not necessary to pull the cylindrical member 670 toward the aligning member 633 side.

As another embodiment, as in FIG. 53 of Embodiment 5, the base portion 674*a* of the root side extending portion 674*t* of the base portion 674 may be provided on the Z2 side and the folded back portion 674*r* may be provided on the Z1 side of the base side extending portion 674*t* (not shown). In addition, similarly to the cases shown in FIGS. 54 and 56, the base side extending portion 674*t* may be disposed on the rotational direction, the upstream side, the downstream side, and both sides of the engaging portion 673. Here, the structures of the above-described Examples 1 to 6 are summarized as follows. According to the structures described in the present application, the support portion supporting the driving force receiving portion (drive receiving surface) has the first extending portion and the second extending portion extending in mutually different directions, and a certain length of the support portion can be assured even in the middle. That is, the support portion can support the driving force receiving portion movably while keeping the coupling and the cartridge small. Also, with such a structure of the supporting portion, when the cartridge is mounted in the image forming apparatus main assembly, the driving force receiving portion (engaging portion) can be engaged with the main assembly driving shaft provided in the image forming apparatus main assembly.

INDUSTRIAL APPLICABILITY

According to the present invention, there is provided a photosensitive drum unit dismountably mountable to a main assembly of an electrophotographic image forming apparatus.

The invention claimed is:

1. A drum unit for a cartridge, the drum unit comprising:

a photosensitive drum; and a coupling operatively connected to the photosensitive drum so as to transmit a driving force to the photosensitive drum, the coupling including (i) a projection configured to receive the driving force from outside of the drum unit and (ii) a supporting portion movably supporting the projection, wherein the supporting portion includes (i) a first extended portion supporting the projection, (ii) a second extended portion, and (iii) a connecting portion provided between the first extended portion and the second extended portion, wherein the first extended portion and the second extended portion extend at least in an axial direction of the coupling, and wherein the supporting portion is bent at the connecting portion such that a first direction in which the first extended portion extends from the connecting portion and a second direction in which the second extended portion extends to the connecting portion are different from each other.

2. A drum unit according to claim 1, wherein the projection projects inwardly in a radial direction of the coupling.

3. A drum unit according to claim 1, wherein the first extended portion extends from the connecting portion toward a free end of the supporting portion.

4. A drum unit according to claim 1, wherein the second extended portion has a fixed end of the supporting portion.

5. A drum unit according to claim 1, wherein the coupling includes a cylindrical portion, and a fixed end of the supporting portion is fixed to an inner surface of the cylindrical portion.

6. A drum unit according to claim 1, wherein the supporting portion supports the projection so as to be movable at least in a radial direction of the drum unit.

7. A drum unit according to claim 1, wherein the supporting portion is elastically deformable.

8. A drum unit according to claim 1, wherein the first extended portion is positioned closer to an axis of the coupling in a radial direction of the coupling than the second extended portion is positioned to the axis of the coupling in the radial direction of the coupling.

9. A drum unit according to claim 1, wherein the first extended portion and the second extended portion are offset in a circumferential direction of the coupling.

10. A drum unit according to claim 1, wherein the supporting portion includes a plurality of such second extended portions.

11. A drum unit according to claim 10, wherein the first extended portion is connected to the plurality of the second extended portions.

12. A drum unit according to claim 1, wherein the coupling includes a plurality of the projections and a plurality of the supporting portions.

13. A drum unit according to claim 1, wherein the coupling includes:

(i) a first driving force receiving member provided with the supporting portion and the projection, and (ii) a second driving force receiving member for transmitting the driving force from the first driving force receiving member toward the photosensitive drum.

14. A drum unit according to claim 1, wherein the coupling includes a back-up portion for restricting movement of the projection in a circumferential direction of the coupling.

15. A drum unit according to claim 1, wherein at least a part of the projection is positioned within the photosensitive drum.

16. A drum unit according to claim 1, wherein the first extended portion, the second extended portion, and the connecting portion are integrally formed.

17. A drum unit according to claim 1, wherein the first extended portion, the second extended portion, and the connecting portion are separate members.

18. A drum unit according to claim 1, wherein the first extended portion is connected to a body of the coupling via the second extended portion.

19. A drum unit according to claim 1, wherein the photosensitive drum has a first end and a second end opposite to the first end in the axial direction, wherein the coupling is positioned at the first end of the photosensitive drum, and wherein one of the first direction and the second direction is a direction toward the second end of the photosensitive drum, and the other of the first direction and the second direction is a direction away from the second end of the photosensitive drum.

20. A cartridge comprising a drum unit according to claim 1, and a frame rotatably supporting the drum unit.

21. A cartridge comprising:

a rotatable member that is rotatable with a toner carried on an outer surface thereof; and a coupling operatively connected to the rotatable member so as to transmit a driving force to the rotatable member, the coupling including (i) a projection configured to receive the driving force from outside of the cartridge and (ii) a supporting portion movably supporting the projection, wherein the supporting portion includes (i) a first extended portion supporting the projection, (ii) a second extended portion, and (iii) a connecting portion provided between the first extended portion and the second extended portion, and wherein the first extended portion and the second extended portion extend at least in an axial direction of the coupling, and wherein the supporting portion is bent at the connecting portion such that a first direction in which the first extended portion extends from the connecting portion and a second direction in which the second extended portion extends to the connecting portion are different from each other.

22. A cartridge according to claim 21, wherein the projection projects inwardly in a radial direction of the coupling.

23. A cartridge according to claim 21, wherein the first extended portion extends from the connecting portion toward a free end of the supporting portion.

24. A cartridge according to claim 21, wherein the second extended portion has a fixed end of the supporting portion.

25. A cartridge according to claim 21, wherein the coupling includes a cylindrical portion, and a fixed end of the supporting portion is fixed to an inner surface of the cylindrical portion.

26. A cartridge according to claim 21, wherein the supporting portion supports the projection so as to be movable at least in a radial direction of the coupling.

27. A cartridge according to claim 21, wherein the supporting portion is elastically deformable.

28. A cartridge according to claim 21, wherein the first extended portion is disposed closer to an axis of the coupling than the second extended portion is to in a radial direction of the coupling.

29. A cartridge according to claim 21, wherein the first extended portion and the second extended portion are offset in a circumferential direction of the coupling.

30. A cartridge according to claim 21, wherein the supporting portion includes a plurality of such second extended portions.

31. A cartridge according to claim 30, wherein the first extended portion is connected to the plurality of the second extended portions.

32. A cartridge according to claim 21, wherein the coupling includes (i) a first driving force receiving member provided with the supporting portion and the projection, and (ii) a second driving force receiving member for transmitting the driving force from the first driving force receiving member toward the rotatable member.

33. A cartridge according to claim 21, wherein the coupling includes a back-up portion for restricting movement of the projection in a circumferential direction of the coupling.

34. A cartridge according to claim 21, wherein at least a part of the projection is positioned within the rotatable member.

35. A cartridge according to claim 21, wherein the coupling includes a cylindrical portion, and at least a part of the supporting portion is positioned within the cylindrical portion.

36. A cartridge according to claim 21, wherein the rotatable member is a photosensitive drum.

37. A cartridge according to claim 21, wherein the rotatable member is a developing roller.

38. A cartridge according to claim 37, further comprising a supplying roller for supplying the toner to the developing roller.

39. A cartridge according to claim 38, wherein the supplying roller is configured to be rotated by the driving force received by the projection.

40. A cartridge according to claim 38, wherein the developing roller is configured to receive the driving force from the coupling through the supplying roller.

41. A cartridge according to claim 21, wherein the rotatable member is a supplying roller for supplying the toner to a developing roller.

42. A cartridge according to claim 21, wherein the rotatable member includes a shaft, and the coupling is mounted to the shaft.

43. A cartridge according to claim 21, wherein the first extended portion, the second extended portion, and the connecting portion are integrally formed.

44. A cartridge according to claim 21, wherein the first extended portion, the second extended portion, and the connecting portion are separate members.

45. A cartridge according to claim 21, wherein the first extended portion is connected to a body of the coupling via the second extended portion.

46. A cartridge according to claim 21, wherein the cartridge has a first side and a second side opposite to the first side in the axial direction, wherein the coupling is positioned at the first side of the cartridge, and wherein one of the first direction and the second direction is a direction toward the second side of the cartridge, and the other of the first direction and the second direction is a direction away from the second side of the cartridge.

47. An electrophotographic image forming apparatus comprising a cartridge according to claim 21, and an electrophotographic image forming apparatus main assembly to which the cartridge is mountable.

* * * * *